US009033421B2

(12) United States Patent
Wilkinson et al.

(10) Patent No.: US 9,033,421 B2
(45) Date of Patent: May 19, 2015

(54) CHAIR, A SUPPORT, AND COMPONENTS

(75) Inventors: Paul Michael Wilkinson, Wellington (NZ); Kent Wallace Parker, Lower Hutt (NZ); Peter Alan Tierney, Upper Hutt (NZ); Lyall Douglas Stewart, Porirua (NZ); Gregory William Baum, Kapiti (NZ)

(73) Assignee: Formway Furniture Limited, Lower Hutt (NZ)

( * ) Notice: Subject to any disclaimer, the term of this patent is extended or adjusted under 35 U.S.C. 154(b) by 429 days.

(21) Appl. No.: 13/133,347

(22) PCT Filed: Dec. 11, 2009

(86) PCT No.: PCT/NZ2009/000282
§ 371 (c)(1),
(2), (4) Date: Oct. 4, 2011

(87) PCT Pub. No.: WO2010/068122
PCT Pub. Date: Jun. 17, 2010

(65) Prior Publication Data

US 2012/0025574 A1 Feb. 2, 2012

Related U.S. Application Data

(60) Provisional application No. 61/122,283, filed on Dec. 12, 2008.

(51) Int. Cl.
*A47C 7/02* (2006.01)
*A47C 7/00* (2006.01)
(Continued)

(52) U.S. Cl.
CPC ..... *A47C 7/004* (2013.01); *Y10T 29/49826* (2013.01); *A47C 7/282* (2013.01);
(Continued)

(58) Field of Classification Search
USPC ..... 297/452.3, 452.26, 452.56, 452.63, 297/452.64, 440.11
See application file for complete search history.

(56) References Cited

U.S. PATENT DOCUMENTS 3,197,789 A * 8/1965 Ashkouti ..... 5/110
3,235,308 A 2/1966 Conner
(Continued)

FOREIGN PATENT DOCUMENTS

CA 975281 9/1975
CA 1001966 12/1976
(Continued)

OTHER PUBLICATIONS

PCT/NZ2009/000282, May 4, 2010, International Search Report.
(Continued)

*Primary Examiner* — David E Allred
(74) *Attorney, Agent, or Firm* — Workman Nydegger

(57) ABSTRACT

A chair has a seat support (101), a seat portion (13), a back portion (15), and a supporting frame. The supporting frame is formed by a castored base (11), a height adjustment mechanism (17), and a main transom (21). The seat portion (13) is selectively moveable relative to the supporting frame, with the seat portion having a locked configuration and a released configuration. The back portion has a back frame (25) and a compliant cover (61). The back frame has hook features for receiving a portion of the compliant cover (61). The back portion (15) is reclinable relative to the supporting frame between an upright position and a reclined position. A recline mechanism has deformable members operatively connecting the seat portion and the supporting frame. A recline resistance mechanism is selectively engageable to resist movement of the back portion toward the reclined position.

14 Claims, 49 Drawing Sheets

(51) Int. Cl.

| | |
|---|---|
| ***A47C 7/28*** | (2006.01) |
| ***A47C 1/03*** | (2006.01) |
| ***A47C 7/14*** | (2006.01) |
| ***A47C 7/40*** | (2006.01) |
| ***A47C 31/02*** | (2006.01) |
| ***A47C 1/032*** | (2006.01) |
| *A47C 7/16* | (2006.01) |

(52) U.S. Cl.

CPC .. *A47C 7/16* (2013.01); *A47C 1/03* (2013.01); *A47C 7/14* (2013.01); *A47C 7/40* (2013.01); *A47C 31/02* (2013.01); *A47C 1/03255* (2013.01); *A47C 1/03277* (2013.01); *A47C 1/03288* (2013.01)

(56) References Cited

U.S. PATENT DOCUMENTS

| | | | | |
|---|---|---|---|---|
| 3,709,559 | A | 1/1973 | Rowland | |
| 4,119,343 | A | 10/1978 | Pentzien | |
| 4,183,494 | A | 1/1980 | Cleveland | |
| 4,340,250 | A | 7/1982 | Ward | |
| 4,411,468 | A | 10/1983 | Apissomian | |
| 4,575,150 | A | 3/1986 | Smith | |
| 4,743,065 | A | 5/1988 | Meiller et al. | |
| 4,790,598 | A | 12/1988 | Locher | |
| 4,911,501 | A | 3/1990 | Decker et al. | |
| 5,046,780 | A | 9/1991 | Decker et al. | |
| 5,069,496 | A | 12/1991 | Kunh et al. | |
| 5,090,770 | A | 2/1992 | Heinrichs et al. | |
| 5,114,211 | A | 5/1992 | Desanta | |
| 5,121,934 | A | 6/1992 | Decker et al. | |
| 5,338,091 | A * | 8/1994 | Miller | 297/218.4 |
| 5,409,295 | A | 4/1995 | Edstrom | |
| 5,439,271 | A * | 8/1995 | Ryan | 297/452.56 |
| 5,599,064 | A | 2/1997 | Vanderminden, Sr. | |
| 5,645,321 | A * | 7/1997 | Seroldi | 297/452.63 |
| 5,755,488 | A | 5/1998 | Beda et al. | |
| 5,806,930 | A | 9/1998 | Knoblock | |
| 5,899,530 | A | 5/1999 | Tedesco | |
| 5,934,758 | A | 8/1999 | Ritch et al. | |
| 5,979,984 | A | 11/1999 | DeKraker et al. | |
| 5,984,567 | A | 11/1999 | Gollin et al. | |
| 6,059,368 | A | 5/2000 | Stumpf et al. | |
| 6,152,534 | A * | 11/2000 | Maeda et al. | 297/452.56 |
| 6,168,236 | B1 | 1/2001 | Chen | |
| 6,193,313 | B1 | 2/2001 | Jonsson | |
| 6,315,364 | B1 * | 11/2001 | Fujita et al. | 297/452.56 |
| 6,349,992 | B1 | 2/2002 | Knoblock et al. | |
| 6,375,269 | B1 | 4/2002 | Maeda et al. | |
| 6,378,949 | B1 * | 4/2002 | Maeda et al. | 297/452.56 |
| 6,394,548 | B1 * | 5/2002 | Battey et al. | 297/342 |
| 6,439,665 | B1 | 8/2002 | Cvek | |
| 6,543,843 | B1 | 4/2003 | Moilanen | |
| 6,550,866 | B1 * | 4/2003 | Su | 297/452.42 |
| 6,588,843 | B1 | 7/2003 | Ebenstein | |
| 6,669,292 | B2 | 12/2003 | Koepke et al. | |
| 6,669,301 | B1 | 12/2003 | Funk et al. | |
| 6,702,390 | B2 * | 3/2004 | Stumpf et al. | 297/452.56 |
| 6,722,741 | B2 * | 4/2004 | Stumpf et al. | 297/452.3 |
| 6,733,080 | B2 * | 5/2004 | Stumpf et al. | 297/411.36 |
| 6,742,843 | B2 | 6/2004 | Golynsky | |
| 6,817,667 | B2 | 11/2004 | Pennington et al. | |
| 6,880,886 | B2 | 4/2005 | Bodnar et al. | |
| 6,899,398 | B2 * | 5/2005 | Coffield | 297/452.56 |
| 6,910,741 | B2 | 6/2005 | Footitt | |
| 6,955,402 | B2 | 10/2005 | VanDeRiet et al. | |
| 6,979,059 | B1 | 12/2005 | Conlin | |
| 6,983,997 | B2 * | 1/2006 | Wilkerson et al. | 297/452.56 |
| 7,055,911 | B2 * | 6/2006 | Simpson et al. | 297/440.11 |
| 7,066,538 | B2 | 6/2006 | Machael et al. | |
| 7,147,285 | B2 | 12/2006 | Lin | |
| 7,425,039 | B2 * | 9/2008 | Lin | 297/452.56 |
| 7,604,299 | B2 | 10/2009 | Su | |
| 7,647,714 | B2 | 1/2010 | Coffield et al. | |
| 7,730,594 | B2 * | 6/2010 | Hsiao | 24/265 C |
| 8,109,576 | B2 * | 2/2012 | Lin | 297/452.56 |
| 8,297,708 | B2 * | 10/2012 | Mizobata et al. | 297/452.56 |
| 2002/0038843 | A1 | 4/2002 | Footitt et al. | |
| 2002/0109384 | A1 | 8/2002 | Hansen | |
| 2003/0168901 | A1 * | 9/2003 | Wilkerson et al. | 297/452.56 |
| 2004/0183356 | A1 * | 9/2004 | Philippot et al. | 297/452.18 |
| 2004/0245839 | A1 * | 12/2004 | Bodnar et al. | 297/452.63 |
| 2005/0022357 | A1 * | 2/2005 | Coffield et al. | 29/448 |
| 2005/0029848 | A1 | 2/2005 | Heidmann et al. | |
| 2005/0046254 | A1 | 3/2005 | Knoblock et al. | |
| 2005/0146193 | A1 * | 7/2005 | Shieh | 297/440.11 |
| 2005/0206209 | A1 | 9/2005 | Schweikarth et al. | |
| 2006/0071521 | A1 | 4/2006 | Davis | |
| 2006/0138849 | A1 * | 6/2006 | Wilkerson et al. | 297/452.56 |
| 2006/0192420 | A1 * | 8/2006 | Haimoff | 297/440.11 |
| 2007/0102987 | A1 * | 5/2007 | Chen | 297/452.56 |
| 2007/0152488 | A1 | 7/2007 | York et al. | |
| 2007/0170756 | A1 * | 7/2007 | Kang | 297/218.5 |
| 2007/0278840 | A1 * | 12/2007 | Wang | 297/440.11 |
| 2009/0085388 | A1 * | 4/2009 | Parker et al. | 297/311 |
| 2010/0133732 | A1 * | 6/2010 | Yamaguchi et al. | 267/140.4 |
| 2010/0133893 | A1 * | 6/2010 | Raftery et al. | 297/452.63 |
| 2010/0259089 | A1 * | 10/2010 | Mizobata et al. | 297/452.56 |

FOREIGN PATENT DOCUMENTS

| | | | | |
|---|---|---|---|---|
| CN | 200189002 | Y | 2/2009 | |
| DE | 29601154 | | 5/1997 | |
| DE | 202005005947 | | 9/2005 | |
| EP | 0065116 | | 11/1982 | |
| EP | 0107627 | | 5/1984 | |
| EP | 0801913 | | 10/1997 | |
| GB | 2150426 | | 7/1985 | |
| JP | 10286142 | | 10/1998 | |
| JP | 2003250649 | | 9/2003 | |
| JP | 2004049687 | | 12/2004 | |
| JP | 2006087618 | | 4/2006 | |
| JP | 2006218047 | | 8/2006 | |
| JP | 2008206766 | | 9/2008 | |
| JP | 2008229384 | | 10/2008 | |
| WO | WO 83/00610 | | 3/1983 | |
| WO | 99/21456 | | 5/1999 | |
| WO | 03/051157 | | 6/2003 | |
| WO | 2005/047057 | | 5/2005 | |
| WO | 2006/092205 | | 9/2006 | |
| WO | 2007108862 | | 9/2007 | |
| WO | 2007/120371 | | 10/2007 | |
| WO | WO 2007/110729 | | 10/2007 | |
| WO | WO 2007/110732 | | 10/2007 | |
| WO | 2008/041868 | | 4/2008 | |
| WO | WO 2008041868 | A2 * | 4/2008 | A47C 7/46 |
| WO | 2008/084113 | | 7/2008 | |
| WO | 2008/124071 | | 10/2008 | |

OTHER PUBLICATIONS

PCT/NZ2009/000282, May 4, 2010, Written Opinion.

* cited by examiner

CHAIR, A SUPPORT, AND COMPONENTS

FIELD OF THE INVENTION

Aspects of the invention relate generally to chairs and associated components. More particularly, although not exclusively, some aspects of the invention relate to office chairs. An alternative aspect of the invention relates to a support.

BACKGROUND TO THE INVENTION

Traditionally, reclining chairs have required a large number of separate interacting parts to provide reclining motion. The chairs often have a plurality of actuators to be gripped by a user to enable the chair to be adjusted. For example, the chairs may require separate actuators for adjusting the height of the seat, the depth position of the seat, and recline of the back. Having a plurality of actuators can make the chairs difficult to adjust, and often require an occupant to visually inspect the actuators before they are able to make a desired adjustment. Otherwise, the occupant may adjust an incorrect actuator.

With increasing environmental awareness, there is a desire to make office furniture more environmentally friendly. There has been a move toward using recyclable materials in chairs. However, only discrete portions of chairs incorporate recyclable materials, and those materials are generally only used for some components whereas other components use non-recyclable materials or materials of different types. The result is that substantial disassembly or separation is required prior to recycling, which results in high labour costs and a reduced likelihood of the components being recycled.

There is an increasing use of polymeric materials in chair components. However, those chair components often need to be large items with complex strengthening webs to provide sufficient strength in the components. That results in high material usage.

Some supports of chairs have a frame and a cover attached to the frame. To attach the cover to the frame, separate components or fasteners are generally required, such as screws or attachment strips for example. There is generally a significant labour cost involved in that attachment, as well as extra material or component costs.

It is an object of at least preferred embodiments of the present invention to provide a chair that addresses at least one of the disadvantages outlined above, or that at least provides the public with a useful choice. It is an alternative object of at least preferred embodiments of the present invention to provide a support that has a secure connection between the frame and cover, or that at least provides the public with a useful choice. It is an alternative object of at least preferred embodiments of the present invention to provide a chair component that addresses at least one of the disadvantages outlined above, or that at least provides the public with a useful choice.

SUMMARY OF THE INVENTION

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

In accordance with a first aspect of the present invention, there is provided a chair comprising: a seat support; a seat portion for supporting an occupant and that is selectively moveable in a forward and rearward direction relative to the seat support, with the seat portion having a locked configuration in which forward and rearward movement of the seat portion relative to the seat support is minimised or prevented and a released configuration in which forward and rearward movement of the seat portion relative to the seat support is enabled, and the seat portion is adjustable from the locked configuration to the released configuration by raising a forward portion of the seat portion relative to the seat support; and a back portion for supporting the back of a seated occupant when in a normal forward oriented seated position on the seat; wherein one of the seat support and the seat portion comprises rails, and the other of the seat support and the seat portion comprises members that slidably receive the rails, and the members and rails are a closer fit toward a rear portion of the seat portion than toward a forward portion of the seat portion, to provide sufficient movement between the forward portion of the seat portion and the seat support to enable the seat portion to be adjusted to the released configuration.

Preferably, the seat portion is configured such that the raising of the forward portion of the seat portion causes the seat portion to tilt rearwardly.

Preferably, the members comprise left and right channels, with the left and right channels receiving respective rails. Alternatively, the members could comprise separate members, with the seat portion or seat support comprising a rear left member, a front left member, a rear right member, and a front right member, with the left members configured to receive a left rail and the right members configured to receive a right rail.

Preferably, the chair comprises bearing members that provide a sliding interface between the members and the rails. The bearing members preferably comprise liners made of a suitable material, such as nylon, Acetal, or polyester for example. The chair preferably comprises two front bearing members and two rear bearing members, with the front bearing members providing a sliding interface between the members and rails toward the forward portion of the seat portion and the rear bearing members providing a sliding interface between the members and rails toward the rear portion of the seat portion.

The bearing members may be mounted to the members or to the rails, and may slidably engage the other of the members and the rails. Preferably, the bearing members are mounted to the seat portion. Preferably, the seat portion comprises the members and the seat support comprises the rails; however, the seat portion could comprise the rails and the seat support could comprise the members.

The chair may further comprise at least one biasing device to minimise play between the forward portion of the seat portion and the seat support. Preferably, the chair comprises two front bearing members, and each front bearing member comprises an integrally formed biasing device to bias the forward portion of the seat portion downwardly relative to the seat support, to bias the seat portion into the locked configuration.

The seat support may be a fixed part of a supporting frame, and may for example be integrally moulded with a remainder of the supporting frame. Alternatively, the seat support may be moveable relative to a supporting frame, and the chair comprises a recline mechanism configured to move the seat portion upon a reclining action of the back portion. Preferably, the recline mechanism comprises a deformable member operatively connecting a portion of the seat support and the supporting frame, with the recline mechanism configured such that as the back portion of the chair is reclined, the deformable member deforms.

In one embodiment, one of the seat portion and the seat support comprises a projection, and the other of the seat portion and the seat support comprises a plurality of engagement features for the projection, with the projection configured to engage with one of the engagement features when the seat portion is in the locked configuration, the projection further configured to not engage with any of the engagement features when the seat portion is in the released configuration. The engagement features can comprise any suitable type, such as a plurality of recesses or apertures for example. The chair may comprise a plurality of projections configured to engage with the engagement features when the seat portion is in the locked configuration. Preferably, the chair comprises a plurality of projections, with two of the projections configured to engage with the engagement features, when the seat portion is in the locked configuration. Preferably, the projections are provided on the seat support and the engagement features are provided on the seat portion.

Preferably, the chair comprises two groups of engagement features that are each selectively engageable with at least one respective projection when the seat portion is in the locked configuration. Preferably, the two groups of engagement features are each selectively engageable with two respective projections when the seat portion is in the locked configuration. Preferably, the projections are provided on the seat support and the engagement features are provided on the seat portion.

Preferably, the projections and engagement features are offset toward respective sides of the chair from a centre of the chair, so that at least one projection remains in engagement with an engagement feature, if the seat portion is in a locked configuration and side loading is applied to the seat portion.

The seat portion may comprise an indicator to indicate the portion of the seat portion that should be raised to move the seat portion to the released configuration. The indicator may be a visual indicator, a tactile indicator, or a combination thereof. Preferably, the indicator comprises a tactile indicator. Preferably, the tactile indicator is provided on the underside of the front of the seat portion, and comprises a recess to receive a plurality of a user's fingers to enable the user to reach under and lift the front of the seat portion. The visual indicator may be provided in a front or upper surface of the seat portion.

In accordance with a second aspect of the present invention, there is provided a chair comprising: a supporting frame; a seat portion for supporting an occupant; a back portion for supporting the back of a seated occupant; and a recline mechanism configured to move the seat portion upon a reclining action of the back portion, the recline mechanism comprising a rear deformable member operatively connecting a relatively rearward portion of the seat portion and the supporting frame, two front deformable members operatively connecting a relatively forward portion of the seat portion and the supporting frame, a lower deformable member operatively connecting a lower part of the back portion and the supporting frame, and a puller member above the lower deformable member, wherein the front deformable members are elongate members having a forward portion operatively connected to the seat portion and a rear portion operatively connected to the supporting frame, and the two front deformable members extend predominantly in a forward-rearward direction of the chair but diverge from their rear portions to their forward portions such that the forward portions are spaced further apart than the rear portions, the recline mechanism configured such that as the back portion of the chair is reclined, the lower deformable member deforms and the puller member applies a rearward pulling action which causes the seat portion to move and the front and rear deformable members to deform.

Preferably, the front deformable members have a convex curvature relative to a position beneath the front deformable members.

The pulling action preferably causes the seat portion to lift and move rearwardly. The pulling action may cause the seat portion to increase in rearward tilt angle as it lifts and moves rearwardly. Alternatively, the angle of the seat may not change.

The puller member may also be deformable.

One or more of: the rear deformable member, the puller member, and the lower deformable member; may extend transversely to a forward direction of the chair. Preferably, the puller member and the lower deformable member, extend transversely to a forward direction of the chair.

Preferably, one or more of: the front deformable members, the rear deformable member, the puller member, and the lower deformable member; is formed of an elastomeric material. One or more of: the rear deformable member, the puller member, and the lower deformable member; may be an elastomeric panel. The or each elastomeric panel may extend substantially the width of a main transom of the supporting frame. The elastomeric material may comprise rubber, or an elastomeric polymer such as a thermoplastic polyurethane elastomer (TPU) or a nylon elastomer for example. Most preferably, the polymeric material is HYTREL, which is a thermoplastic polyester elastomer available from Du Pont.

The front and rear deformable members may be pre-moulded with an inherent curvature. For example, in a relaxed state, the front and rear deformable members may have a sinuous configuration. Forward movement of the seat as an occupant sits on the seat portion, or rearward movement of the seat as an occupant reclines the back of the chair by leaning back, may cause the front and rear deformable members to initially straighten from the sinuous configuration.

Alternatively, the front and rear deformable members may be substantially planar in the relaxed state. This configuration is preferred, as the chair will not require recline springs. A seated occupant's body weight, along with any loading provided by the deformable members, may provide sufficient resistance to oppose the reclining of the back portion. The front and/or rear deformable members may be provided with one or more shaped faces.

One or more stops is/are preferably provided to support the weight of the seated occupant on the seat portion via the supporting frame when the back portion is not being reclined. Therefore, the front and rear deformable members may be substantially unloaded when the back portion is not undergoing a reclining action.

Preferably, the chair further comprises two stops to at least partly support the weight of the seated occupant on the seat portion via the supporting frame when the back portion is not being reclined, wherein the stops are elongate members having a forward portion to support the seat portion and a rear portion operatively connected to the supporting frame, and wherein the stops extend predominantly in a forward-rearward direction of the chair but diverge from their rear portions to their forward portions.

Preferably, the stops have a convex curvature relative to a position beneath the stops.

Preferably, the stops are positioned adjacent the front deformable members. Preferably, the stops are positioned inwardly of the front deformable members.

In a preferred embodiment, the supporting frame comprises a transom mounted to a height adjustment mechanism, and the configuration of the stops directs loading from a seated occupant toward the height adjustment mechanism.

At least two of the deformable members may form an integrally moulded structure. For example, the lower deformable member and puller may form an integrally moulded structure. Part of the integral structure may comprise a member that interconnects the rear ends of the lower deformable member and the puller. In a preferred form, the front deformable members, rear deformable member, and lower deformable member form an integrally moulded structure. That integrally moulded structure may be over-moulded onto a main transom of the chair.

The lower deformable member and puller may form an integrally moulded structure with the rear deformable member. As an alternative, the lower deformable member and puller, and the front and rear deformable members, may all form an integrally moulded structure.

In a preferred embodiment, the seat portion is supported by a seat support, and the seat portion is selectively moveable in a forward and rearward direction relative to the supporting frame, with the seat portion having a locked configuration in which forward and rearward movement relative to the supporting frame is minimised or prevented and a released configuration in which forward and rearward movement relative to the supporting frame is enabled, and wherein the seat portion is adjustable from the locked configuration to the released configuration by raising a forward portion of the seat portion. The upper end of the front deformable members and the upper end of the rear deformable member may be connected to the seat support.

A forward end of the puller may be connected to the seat portion, seat support, or upper part of the rear deformable member.

The recline mechanism preferably comprises two spaced apart front deformable members, with their forward ends positioned at or toward respective sides of the seat portion. The recline mechanism preferably also comprises two spaced apart rear deformable members, positioned at or toward respective sides of the seat portion.

Preferably, the front deformable members and the rear deformable member(s) are configured to deform into a generally sinuous shape as the back portion of the chair is reclined.

In accordance with a third aspect of the present invention, there is provided a kit of parts for assembling a chair, the kit comprising: a first component comprising a transom, recline mechanism, seat support, and back portion; a second component comprising a seat portion; a third component comprising a castored base; and a fourth component comprising a height adjustment mechanism; wherein the first, second, third, and fourth components can be assembled into a chair by an end user by mounting the fourth component to the third component, mounting the first component to the fourth component, and mounting the second component to the first component.

The first, second, third, and fourth components will each preferably be pre-assembled or pre-formed components, with the four components being provided separately in the kit.

Preferably, the height adjustment mechanism comprises a member having an external taper that converges from an upper end of the taper to a lower end of the taper, the member having a first stop, and the castored base comprises an internal tapered cavity for receiving the external taper of the member, the internal taper converging from an upper end of the taper to a lower end of the taper, and the castored base comprises a second stop near the upper end of the taper, and the member and castored base are configured such that as the height adjustment mechanism is mounted to the castored base, the tapers engage such that a spacing is provided between the first stop and the second stop, with the first stop configured to engage with the second stop if the member moves downwardly relative to the castored base after an extended period of time.

The stops may be in any suitable form. In one form, the first stop comprises a shoulder near the upper end of the taper of the member, and the second stop comprises a shoulder near the upper end of the taper of the castored base. Alternatively, the first stop may comprise a bottom surface of the member, and the second stop may comprise a base member in the internal tapered cavity of the castored base.

Preferably, the portion of the castored base comprising the tapered cavity is a recyclable polymeric material, and the member is adapted to be mounted directly to said portion of the castored base. Preferably, the material is a recyclable polymeric material.

Preferably, the kit further comprises a pair of arm rests. Preferably, the arm rests form part of the first component.

Preferably, the second component is mountable to the first component, the fourth component is mountable to the third component, and the first component is mountable to the fourth component, without the use of tools.

Preferably, the first component comprises an actuator for use by a seated occupant to adjust the height of the height adjustment mechanism, and the actuator self-adjusts to a desired position relative to the height adjustment mechanism when the first component is mounted to the fourth component.

Preferably, the second component comprises a seat panel and a plurality of supports that support the seat panel from the seat support when the second component is mounted to the first component, and the seat panel and supports are a single injection moulded polymeric component. Alternatively, the seat panel may be attached to the supports by suitable features such as clips for example. In one embodiment, the second component further comprises a cushion mounted to the seat panel and a cushion cover, with the cushion and cushion cover comprising recyclable polymeric materials.

Preferably, substantially the entire first component, substantially the entire second component, and substantially the entire third component, comprise one or more recyclable polymeric materials.

Preferably, the chair, once assembled, can be disassembled by separating the second component from the first component, separating the first component from the fourth component, and separating the fourth component from the third component, such that substantially the entire chair can be recycled. Preferably, the components can be separated without the use of tools or using standard hand tool(s).

In accordance with a fourth aspect of the present invention, there is provided a method of assembling a chair from a kit of parts as outlined in relation to the third aspect above, the method comprising:

mounting the fourth component to the third component;

mounting the first component to the fourth component, and mounting the second component to the first component.

The step of mounting the second component to the first component may be undertaken prior to mounting the first component to the fourth component. The step of mounting the first component to the fourth component is undertaken prior to mounting the fourth component to the third component. However, the steps are preferably carried out in the order outlined above.

Preferably, the height adjustment mechanism comprises a member having an external taper that converges from an upper end of the taper to a lower end of the taper, the member having a first stop, and the castored base comprises an internal tapered cavity for receiving the external taper of the member, the internal taper converging from an upper end of the taper to a lower end of the taper, and the castored base comprises a second stop, and the member and castored base are configured such that as the height adjustment mechanism is mounted to the castored base, the tapers engage such that a spacing is provided between the first stop and second stop, with the first stop configured to engage with the second stop if the member moves downwardly relative to the castored base after an extended period of time Preferably, the method is carried out without the use of tools.

Preferably, the method further comprises disassembling the chair by separating the second component from the first component, separating the first component from the fourth component, and separating the fourth component from the third component, such that substantially the entire chair can be recycled. Preferably, the step of disassembling the chair is carried out without the use of tools or using standard hand tool(s).

In accordance with a fifth aspect of the present invention, there is provided a height adjustable arm assembly for a chair, comprising:

a support;

an arm rest for supporting the arm of a chair occupant and that is slidably supported by the support to provide height adjustability of the arm rest on the support;

a locking mechanism for locking the arm rest in a selected height adjusted position relative to the support, comprising a locking member that engages with the support and an actuator positioned for use by a chair occupant;

wherein at least a major part of the arm rest, support, and locking mechanism are manufactured from one or more recyclable polymeric materials that can be recycled together, and wherein the support, locking mechanism, and said at least a major part of the arm rest are recyclable without separating those parts of the arm assembly.

Preferably, substantially the entire support, arm rest, and locking mechanism are manufactured from one or more recyclable polymeric materials. Preferably, the entire support, arm rest, and locking mechanism are manufactured from one or more recyclable polymeric materials.

In one embodiment, the arm rest comprises a cushion that is manufactured from one or more polymeric materials that can be recycled together with the polymeric material(s) of said at least a major part of the arm rest, support, and locking mechanism, so that the cushion does not need to be removed from the remainder of the arm rest for recycling. The arm rest may further comprise a cushion cover, with the cushion cover being manufactured from one or more recyclable polymeric materials that can be recycled together with the polymeric material(s) of said at least a major part of the arm rest, support, and locking mechanism.

In an alternative embodiment, the arm rest comprises a cushion that is manufactured from a material that cannot be recycled with the polymeric material(s) of said at least a major part of the arm rest, support, and locking mechanism. In that embodiment, the cushion would need to be removed from the remainder of the arm rest before recycling the support, remainder of the arm rest, and locking mechanism. In this embodiment, the cushion may comprise any suitable material such as polyurethane for example. Rather than having a cushion cover, the cushion could be a self-skinning article.

Preferably, the recyclable polymeric material(s) comprise material(s) having a polyester base. Preferably, the recyclable polymeric material(s) comprise one or more selected from the group comprising: polyethylene terephthalate, polybutylene terephthalate, polyester, recycled polyethylene terephthalate, recycled polybutylene terephthalate, recycled polyester, glass filled polyethylene terephthalate, and recycled glass filled polyethylene terephthalate.

The support may be part of a back portion of a chair. Alternatively, the support may be adapted to be supported from another part of the chair as part of a standalone arm assembly that may be attached to the supporting frame or seat for example. In a preferred form, the support is mounted to a part of the back portion that supports the back portion from another part of chair.

Preferably, the actuator is positioned to be substantially aligned (in one dimension) with a longitudinal axis of the support, so that a user can apply force in a location substantially aligned with the longitudinal axis of the support, to minimise binding of the arm rest to the support during height adjustment of the arm rest. With that configuration, the support and arm rest need not have additional bearing features to support the sliding movement, although bearing features could be incorporated if desired.

Preferably, the actuator comprises a button on an outer side of part of the arm rest, and the button is positioned so as to be actuable by a chair occupant with a hand on the top of a cushion of the arm rest. The actuator could be any suitable other type. For example, the actuator may comprise a lever that is adapted to be pulled upward to release the locking mechanism. That enables the height of the arm rest component to readily be increased, as the same upward pulling action against the lever will additionally lift the arm rest.

Preferably, the locking member and actuator are a single integrally moulded component.

The support may comprise a channel that is outwardly open to an exterior of the support, a plurality of engagement features are provided in a base of the channel for engagement by the locking member to lock the arm rest, the arm rest comprises a tubular portion that telescopically receives the support, and at least a major part of the actuator including the locking member is received in the channel of the support. The support may have any suitable shape in cross section, such as a general H shape, a general I shape, or a general C shape for example. Alternatively, the support may comprise a tubular portion, with a plurality of engagement features provided in the tubular portion for engagement by the locking member to lock the arm rest, the arm rest comprising a tubular portion that telescopically receives the support, and at least a major part of the actuator including the locking member is received in the tubular member.

Preferably, the arm assembly further comprises a biasing device to bias the locking member into engagement with the support, and the biasing device is manufactured from a recyclable polymeric material. The biasing device may be integrally formed with the locking mechanism, or may be integrally formed with part of the arm rest.

Preferably, substantially the entire arm assembly is recyclable, without separating parts of the arm assembly.

Preferably, the arm assembly is mountable to another part of the chair by one or more fasteners such as bolts or screws for example. Preferably, the configuration is such that the fastener(s) can be removed to separate the arm assembly from the part of the chair, and said at least a major part of the arm rest, the support, and the locking mechanism can be recycled without separating those parts of the arm assembly. Additionally, or alternatively, the support may comprise a hook feature to engage with a corresponding feature on said another part of the chair.

Preferably, the polymeric material(s) contain(s) recycled or renewably sourced content.

In accordance with a sixth aspect of the present invention, there is provided a chair comprising:

a supporting frame;

a seat portion for supporting an occupant;

and a back portion for supporting the back of a seated occupant, the back portion being reclinable relative to the supporting frame between a generally upright position and a generally reclined position; and a recline resistance mechanism that is selectively engageable to resist movement of the back portion toward the generally reclined position, the recline resistance mechanism comprising:

a recess in a first chair component;

a shuttle that is slidably engaged with the recess in said first chair component, at least part of the shuttle being resilient and configured such that as the shuttle slides through at least part of the recess, said at least part of the shuttle is compressed, with friction between the shuttle and the recess resisting movement of the shuttle in the recess;

and an engaging member operatively connected to a second chair component, the engaging member being actuable to selectively operatively engage the shuttle or to selectively release the shuttle;

wherein, when the engaging member is selectively operatively engaged with the shuttle, movement between the shuttle and the further chair component is resisted, so that upon movement of the back portion toward the generally reclined position, the shuttle is caused to slide in the recess, with friction between the shuttle and the recess applying a resistance against movement of the back portion toward the generally reclined position.

Preferably, when the engaging member is released from the shuttle, the recline resistance mechanism applies no resistance against movement of the back portion toward the generally reclined position. Preferably, when the engaging member is disengaged from the shuttle, the shuttle does not slide in the recess as the back portion of the chair is reclined.

Preferably, when the engagement member is selectively operatively engaged with the shuttle, the recline resistance mechanism also resists movement of the back portion of the chair from the generally reclined position toward the generally upright position.

Preferably, the recess comprises a first engagement surface, and the recline resistance mechanism is configured such that as a portion of the shuttle engages the first engagement surface upon initial recline of the back portion toward the generally reclined position, the engagement surface causes a first portion of said at least part of the shuttle to be compressed. Preferably, the shuttle comprises a first engagement surface configured to engage with the first engagement surface of the recess. Preferably, the first engagement surface of the shuttle is a leading surface of the shuttle, in the direction of sliding movement of the shuttle in the recess upon recline of the back portion.

Preferably, the recess comprises a second engagement surface, and the recline resistance mechanism is configured such that as a portion of the shuttle engages the second engagement surface upon further recline of the back portion toward the generally reclined position, the engagement surface causes a second portion of said at least part of the shuttle to be compressed. Preferably, the shuttle comprises a second engagement surface configured to engage with the second engagement surface of the recess. Preferably, the second engagement surface of the shuttle is a trailing surface of the shuttle, in the direction of sliding movement of the shuttle in the recess upon recline of the back portion.

In an alternative embodiment, the first engagement surface of the shuttle could be a trailing surface of the shuttle and the second engagement surface of the shuttle could be a leading surface of the shuttle.

Preferably, the first portion of said at least part of the shuttle remains compressed when the second portion of said at least part of the shuttle is compressed.

Preferably, the total amount of compression of said at least part of the shuttle is greater, and thereby frictional force between the shuttle and the recess is greater, when the second portion of said at least part of the shuttle is also compressed than when only the first portion of said at least part of the shuttle is compressed. Preferably, the frictional force that must be overcome to move the shuttle in the recess is between about 1177 Newtons (about 120 kg) and about 1471 Newtons (about 150 kg), when the first and second portions of said at least part of the shuttle is compressed. Preferably, the force applied by said at least part of the shuttle, in a direction perpendicular to the direction of travel of the shuttle in the recess, is between about 3922 Newtons (about 400 kg) and about 4413 Newtons (about 450 kg), when the first and second portions of said at least part of the shuttle is compressed.

The recess can be in any suitable form. For example, the sides of the recess could be closed or open, as could the upper end of the recess. The recess could be in the form of a channel having one open side, or could be substantially tubular having no open sides.

The first and/or second engagement surfaces of the recess can be of any suitable shape and configuration. In a preferred form, the first and second engagement surfaces of the recess comprise arcuate surfaces. As an alternative, the first and second engagement surfaces of the recess could comprise relatively sharp steps. The first and second engagement surfaces of the shuttle can be of any suitable shape and configuration. Preferably, the first and second engagement surfaces of the shuttle comprise arcuate surfaces. As an alternative, the first and second engagement surfaces of the shuttle could comprise relatively sharp steps.

Preferably, the recess has a first portion having a relatively large dimension, a second portion having a relatively small dimension, and the first engagement surface of the recess comprises a transition surface between said first portion and said second portion, and the recline resistance mechanism is configured such that as part of the shuttle moves from the first portion to the second portion of the recess upon initial recline of the back portion toward the generally reclined position, frictional force between the shuttle and the recess increases due to compression of said at least part of the shuttle.

Preferably, the recess has a third portion of a relatively larger dimension than the first portion and second portion of the recess, with the first portion of the recess positioned between the second portion and third portion of the recess, and the recline resistance mechanism is configured such that as part of the shuttle moves from the third portion to the second portion of the recess upon further recline of the back portion toward the generally reclined position, frictional force between the shuttle and the recess increases further due to further compression of said at least part of the shuttle.

In one embodiment, substantially the entire shuttle could be resilient. However, it is preferred that at least the part of the shuttle having the engagement surface(s) is substantially rigid, so the engagement surface(s) don't deform upon engagement with the engagement surface(s) of the recess. Therefore, a side of the shuttle having the engagement surface(s) is preferably substantially rigid, with said at least part of the shuttle being an opposite side of the shuttle.

Preferably, said at least part of the shuttle comprises a resilient member that is housed at least partly within a body portion the shuttle. Preferably, part of the resilient member projects from the body portion of the shuttle. The resilient member preferably contacts a surface of the recess to provide frictional contact therebetween. The resilient member preferably contacts a wall of the recess to provide frictional contact therebetween. Alternatively, a suitable frictional surface may be attached to the resilient member, with at least part of the frictional surface projecting from the body portion of the shuttle and contacting the surface of the recess to provide frictional contact therebetween.

The resilient member can be made from any suitable material, such as rubber or polyurethane for example. In a preferred form, the resilient member is made from an elastomeric material, and preferably a thermoplastic polyester elastomer, such as HYTREL which is a polymer available from Du Pont. In an alternative, the resilient member could comprise a spring member, such as a compression spring or leaf spring for example, with a frictional pad attached to the spring. In that alternative, the spring could comprise a suitable polymeric material such as acetyl or nylon for example, or could comprise a metallic material. The remainder of the shuttle may be injection moulded from a suitable relatively rigid polymeric material, such as nylon for example.

Preferably, the part of the shuttle comprising the engagement surface(s) is substantially rigid, to prevent or minimise deformation of the engagement surfaces.

The first and second chair components can be any suitable components, provided the first and second chair components move relative to each other upon reclining of the back portion. For example, one of the components may be a supporting frame of the chair, and the other component may be any component that is adapted to move upon recline of the back portion toward the generally reclined position, such as a seat portion, seat support, or the back portion for example.

Preferably, said first component comprises said seat portion or a seat support and said second component comprises said supporting frame. However, that configuration could be reversed.

In an embodiment having a reclinable back portion but which does not move the seat portion upon recline of the back portion, said first component may be one of the supporting frame and the back portion, and said second component may be the other of the supporting frame and the back portion.

Preferably, the engaging member is pivoted to the second component.

The engaging member and the shuttle preferably comprise complementary engagement features. In a preferred embodiment, the engagement features comprise respective hook features, but any other suitable configuration could be used.

The chair preferably comprises an actuator that enables a user to engage or disengage the recline resistance mechanism. The actuator is preferably operatively connected to the engaging member by an overload protection device. The overload protection device can be any suitable form, but in a preferred embodiment the overload protection device comprises a biasing device such as a torsion spring. A different type of biasing device, such as a different type of spring could alternatively be used. The torsion spring is preferably connected directly to the actuator and the engaging member. Alternatively, one or more flexible elongate members, such as cables, could connect the torsion spring to the actuator and the engaging member.

Preferably, the actuator is movable between an engaging position corresponding to an engaged position of the engaging member and the shuttle, and a disengaging position corresponding to the disengaged position of the engaging member and the shuttle.

Preferably, the engaging member can only be disengaged from the shuttle when the back is in the generally upright configuration and is substantially unloaded. The overload protection device is preferably configured to bias the engaging member toward a disengaged position from the shuttle when the actuator is in the disengaging position, so that when the back portion returns to the generally upright configuration and is substantially unloaded, the engaging member will disengage from the shuttle.

Preferably, the engaging member can only be engaged with the shuttle when the back is in the generally upright configuration and is substantially unloaded. The overload protection device is preferably configured to bias the engaging member toward an engaged position with the shuttle when the actuator is in the engaging position, so that when the back portion returns to the generally upright configuration and is substantially unloaded, the engaging member will engage with the shuttle.

Preferably, the chair comprises a single actuator for actuating the recline resistance mechanism and a height adjust mechanism of the chair. Preferably, the single actuator comprises a lever positioned generally beneath a seating surface of the chair. Preferably, the lever is pivotable about a first axis to control the height adjust mechanism and is pivotable about a second axis to control the recline resistance mechanism. Preferably, the first and second axes are substantially perpendicular. Preferably, the first axis is a substantially horizontal axis, and the second axis is a substantially vertical axis. Preferably, the movement about the second axis is indexed.

Any other suitable type of actuator could be used.

The first chair component may be the seat portion or a seat support, and the chair may comprise a recline mechanism configured to move the seat portion or seat support upwardly upon a reclining action of the back portion. Preferably, the recline mechanism is configured to lift the seat portion or seat support upon a reclining action of the back portion. Preferably, the seat portion or seat support lifts and moves rearwardly upon a reclining action of the back portion. The seat portion or seat support may increase in rearward tilt angle as it lifts and moves rearwardly, or may maintain a substantially constant angle.

Preferably, the recline mechanism comprises a deformable member operatively connecting a portion of the seat support and the supporting frame, with the recline mechanism configured such that as the back portion of the chair is reclined, the deformable member deforms. The recline mechanism may comprise a puller that pulls the seat portion rearwardly upon a reclining action of the back portion. The recline resistance mechanism could be used in a chair having a different type of recline mechanism.

In accordance with a seventh aspect of the present invention, there is provided a chair comprising: a supporting frame; a recline mechanism; a seat portion; and a back portion; wherein at least a major part of the chair comprises one or more polymeric materials that contain(s) recycled or renewably sourced content.

Preferably, at least about 60% of the chair, by weight, comprises one or more polymeric materials that contain(s) recycled or renewably sourced content. Preferably, at least about 70% of the chair, by weight, comprises one or more polymeric materials that contain(s) recycled or renewably sourced content. Preferably, at least about 80% of the chair, by weight, comprises one or more polymeric materials that contain(s) recycled or renewably sourced content.

Preferably, the amount of recycled or renewably sourced content in the chair is at least about 40%, by weight. Preferably, the amount of recycled or renewably sourced content in the chair is at least about 50%, by weight. Preferably the chair comprises about 46% recycled content by weight and about 6% of renewably sourced content by weight.

The material(s) is/are preferably recyclable.

Preferably, the supporting frame comprises a castored base, and at least a major part of the castored base is manufactured from one or more polymeric materials that contain(s) recycled or renewably sourced content.

Preferably, the supporting frame comprises a height adjustment mechanism comprising a member having an external taper that converges from an upper end of the taper to a lower end of the taper, the member having a first stop, and the castored base comprises an internal tapered cavity for receiving the external taper of the member, the internal taper converging from an upper end of the taper to a lower end of the taper, and the castored base comprises a second stop, and the height adjustment mechanism and castored base are configured such that as the height adjustment mechanism is mounted to the castored base, the tapers engage such that a spacing is provided between the first and second stops.

The height adjustment mechanism may comprise recycled and virgin materials.

Preferably, the supporting frame comprises a transom having a cavity, and an upper end of the height adjustment mechanism is received in a metallic insert that is fastened in the cavity in the transom. The metallic insert may be fastened in the cavity in the transom with a plurality of fasteners such as screws, or may be moulded into the transom for example. The metallic insert may have an external key detail so the insert can be removed from the transom. Preferably, the insert is removable from the transom using standard hand tool(s) to enable the transom and components connected to the transom to be recycled.

Preferably, the chair further comprises height adjustable arm assemblies, and at least a major part of the arm assemblies are formed from one or more polymeric materials that contain(s) recycled or renewably sourced content. Preferably, the arm assemblies are separable from the remainder of the chair, and once the arm assemblies have been separated from the remainder of the chair, at least a support, a major part of an arm rest, and locking mechanism of the arm assemblies can be recycled as one unit without further disassembly. The arm rests may further comprise cushions that can be recycled with the support, remainder of the arm rest, and locking mechanism, without further disassembly.

Preferably, the polymeric material(s) used for at least a major part of the chair can be recycled together. Preferably, the polymeric material(s) comprise material(s) having a polyester base. Preferably, the polymeric material(s) comprise one or more selected from the group comprising: polyethylene terephthalate, polybutylene terephthalate, polyester, recycled polyethylene terephthalate, recycled polybutylene terephthalate, recycled polyester, glass filled polyethylene terephthalate, and recycled glass filled polyethylene terephthalate.

In accordance with an eighth aspect of the present invention, there is provided a castored base for a chair, comprising:

a body comprising a central portion with a plurality of legs extending radially outwardly therefrom, each leg having an end proximal the central portion, an end distal the central portion, and a flange positioned near a lower portion of the leg, the flange extending along at least a major portion of a distance between the end proximal the central portion and the end distal the central portion.

Preferably, the body comprises an injection moulded polymeric material, such as glass filled PET or nylon for example.

Preferably, each leg comprises two flanges positioned near a lower portion of the leg.

Preferably, the or each flange extends outwardly from the leg.

Preferably, the or each flange extends substantially the entire length of the distance of the leg between the end proximal the central portion and the end distal the central portion.

Preferably, each leg has a lower surface and the or each flange forms part of the lower surface.

Preferably, each leg comprises side walls extending between the end proximal the central portion and the end distal the central portion, and a cavity between the side walls. Preferably, the or each flange has a wall thickness that is equal to or greater than a wall thickness of the side walls.

Preferably, the side walls are generally concave when viewed from the side of the leg. Preferably, each leg further comprises ribs extending between the side walls.

Preferably, the central portion provides support for a height adjustment mechanism.

Preferably, the central portion and plurality of legs comprise an integrally formed component.

Preferably, the castored base comprises five legs.

Preferably, the castored base comprises a polymeric material, more preferably a recyclable polymeric material.

In accordance with a ninth aspect of the present invention, there is provided a castored base for supporting a height adjustment mechanism comprising a member with an external taper that converges from an upper end of the taper to a lower end of the taper, the member having a first stop, the castored base comprising:

a central portion defining an internal tapered cavity for receiving the taper of the member, the internal taper converging from an upper end of the taper to a lower end of the taper;

and a second stop;

wherein the first stop is spaced apart from the second stop when the height adjustment mechanism and the castored base are initially assembled such that their tapers engage, and the second stop is adapted to engage the first stop if the member moves downwardly relative to the castored base after an extended period of time.

The stops may be in any suitable form. In one form, the first stop comprises a shoulder near the upper end of the taper of the member, and the second stop comprises a shoulder near the upper end of the taper of the castored base. Alternatively, the first stop may comprise a bottom surface of the member, and the second stop may comprise a base member in the internal tapered cavity of the castored base.

Preferably, the shoulder is integrally formed with the central portion of the castored base. Alternatively, the shoulder may be a separately formed component.

Preferably, the internal taper of the cavity substantially corresponds to the external taper of the member.

Preferably, the member and the tapered cavity have a substantially circular cross section.

Preferably, the castored base comprises a polymeric material, more preferably a recyclable polymeric material.

In accordance with a tenth aspect of the present invention, there is provided a combination of a castored base as outlined in relation to the ninth aspect above, and a height adjustment mechanism having a member with an external taper that converges from an upper end of the taper to a lower end of the taper, the member having a first stop, wherein the taper of the member engages with the internal taper of the castored base, and the first stop is spaced from the second stop upon initial assembly, with the second stop adapted to engage the first stop if the member moves downwardly relative to the castored base after an extended period of time.

In accordance with an eleventh aspect of the present invention, there is provided a frame for a support surface for a chair comprising:

at least two spaced apart side members, each side member being generally L-shaped in cross-section and having a main frame portion comprising a front face that faces a seated occupant in use, and a flange positioned at an edge of the member, the flange extending at least a major portion of the length of the side member and in a direction generally rearwardly from the front face of the main frame portion.

Preferably, the flange extends in a direction generally perpendicularly from the front face of the main frame portion.

Preferably, the flange has substantially parallel walls. Preferably, the main frame portion has substantially parallel walls.

Preferably, the flange is positioned at an exterior edge of the main frame portion. Alternatively, the flange could be positioned at an interior edge.

The frame may further comprise at least two transverse members interconnecting the at least two side members.

Preferably, the at least two side members are generally serpentine in shape.

Preferably, the support surface comprises a back portion of a chair. Alternatively, the support surface could comprise a seat portion of a chair.

In accordance with a twelfth aspect of the present invention, there is provided a support for a chair comprising:

a frame of the eleventh embodiment;

and a cover connected to and extending between the side members, and extending across an opening between the side members to provide a compliant support surface for a chair occupant.

Preferably, the cover is a body contacting surface of the support surface.

Preferably, the cover is held in tension between the side members, and is suspended between the side members.

Preferably, the cover comprises an elastomeric material. Preferably, the elastomeric material comprises a thermoplastic polyester elastomer, such as HYTREL, which is a polymer available from Du Pont.

In accordance with a thirteenth aspect of the present invention, there is provided a support comprising:

a frame comprising a frame member; and a compliant cover having a plurality of members extending in a first direction and a plurality of members extending in a second transverse direction;

wherein the frame member comprises an attachment feature for attaching the cover to the frame member, the attachment feature comprising a hook feature extending in a direction away from a first edge of the frame member and a recess adjacent the hook feature that extends in said direction, past the hook feature to a position beyond the hook feature, with the recess terminating in a wall spaced from the hook feature;

wherein at least a portion of one of the members of the compliant cover extending in the first direction is received under the hook feature, and wherein a portion of the compliant cover is received in the recess with an edge of that portion abutting the wall of the recess.

Preferably, the wall comprises an undercut, such that a portion of the wall distal a base of the recess is positioned closer to the first edge than a portion of the wall proximal the base of the recess.

In a first preferred embodiment, at least a portion of one of the members of the compliant cover extending in the second transverse direction is received in the recess, with an end of said one of the members extending in the second transverse direction abutting the wall of the recess.

Preferably, the end said one of the members extending in the second transverse direction has a feature complementary to the undercut.

Preferably, the frame member comprises a shoulder on either side of an end portion of the recess that has the wall, with a spacing between the shoulders corresponding substantially to a width of said at least a portion of one of the members of the compliant cover extending in the second transverse direction.

In a second preferred embodiment, an edge of said one of the members of the compliant cover extending in the first direction abuts the wall of the recess.

Preferably, the frame member comprises a plurality of the attachment features. Preferably, in the embodiment in which an edge of said one of the members of the compliant cover extending in the first direction abuts the wall of the recess, adjacent walls are aligned and interconnect, to form a single wall.

Preferably, the frame comprises two opposed frame members, each of which comprises a plurality of the attachment features.

In one embodiment, the frame comprises two side frame members, a first transverse frame member, and a second transverse frame member. Preferably, at least the first transverse frame member and the second transverse frame member each comprise a plurality of the attachment features of the first preferred embodiment. The frame may be a seat frame for a chair, and the first and second transverse frame members may comprise front and rear frame members of the seat. Alternatively, the frame may be a back frame for a chair, and the first and second transverse members may comprise upper and lower frame member of the back.

Preferably, the side frame members of the frame comprise a plurality of the attachment features of the second preferred embodiment.

Preferably, the frame comprises two opposed frame members with an opening therebetween, and the two frame members each comprise a plurality of the attachment features. The compliant cover preferably extends across the opening between the frame members. Preferably, the cover is held in tension between the frame members, and is suspended between the frame members.

The compliant cover is preferably in the form of a mesh, with apertures provided between at least a majority of the members extending in the first direction and extending in the second direction.

The attachment features may be in a body-contacting surface of the frame. Preferably, a forward surface of the frame members and compliant cover are substantially flush. In the embodiment having an opening between the frame members, the recess(es) of the attachment feature(s) preferably extend(s) into the frame member(s) from the opening. In this embodiment, the hook feature(s) will be oriented in a direction away from the opening.

Alternatively, the compliant cover may extend across the opening and around an exterior of the frame members. In that embodiment, the recess(es) of the attachment feature(s) preferably extend(s) into the frame member(s) from edge(s) of the frame member(s) opposite the opening. In this embodiment, the hook feature(s) will be oriented in a direction toward the opening.

The compliant cover may be attached to other frame members by different types of attachment features, or may be attached to all frame members using one of the types of attachment features outlined above.

The same attachment feature(s) could be used for attaching a cover to a frame in a different type of article that has a support. By way of example only, the same attachment feature(s) could be used to form supports of: baby products including car seats, bouncy beds, baby buggies, cots; trampolines; other furniture such as dental chairs, aeroplane seating, stadium seating, outdoor furniture; bedding; or automotive seating.

In accordance with a fourteenth aspect of the present invention, there is provided a method of assembling a support, the method comprising:

providing a frame comprising a frame member having an attachment feature for attaching a cover to the frame member, the attachment feature comprising a hook feature extending in a direction away from a first edge of the frame member and a recess adjacent the hook feature that extends in said direction, past the hook feature to a position beyond the hook feature, with the recess terminating in a wall spaced from the hook feature;

providing a compliant cover having a plurality of members extending in a first direction and a plurality of members extending in a second transverse direction;

and attaching the compliant cover to the frame member by inserting at least a portion of one of the members of the compliant cover extending in the first direction under the hook feature, and inserting a portion of the compliant cover into the recess, such that an edge of that portion abuts the wall of the recess.

The frame and the compliant cover may have any one or more features outlined in relation to the immediately preceding aspect of the invention.

In a first preferred embodiment, the method comprises inserting at least a portion of one of the members of the compliant cover extending in the second transverse direction in the recess, such that an end of said one of the members extending in the second transverse direction abuts the wall of the recess.

In a second preferred embodiment, the method comprises inserting a portion of said one of the members of the compliant cover extending in the first direction into the recess, so that an edge of said one of the members of the compliant cover extending in the first direction abuts the wall of the recess.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

In order that the invention may be more fully understood, some embodiments will now be described by way of example with reference to the accompanying figures in which.

DETAILED DESCRIPTION OF PREFERRED FORMS

Figure 1:
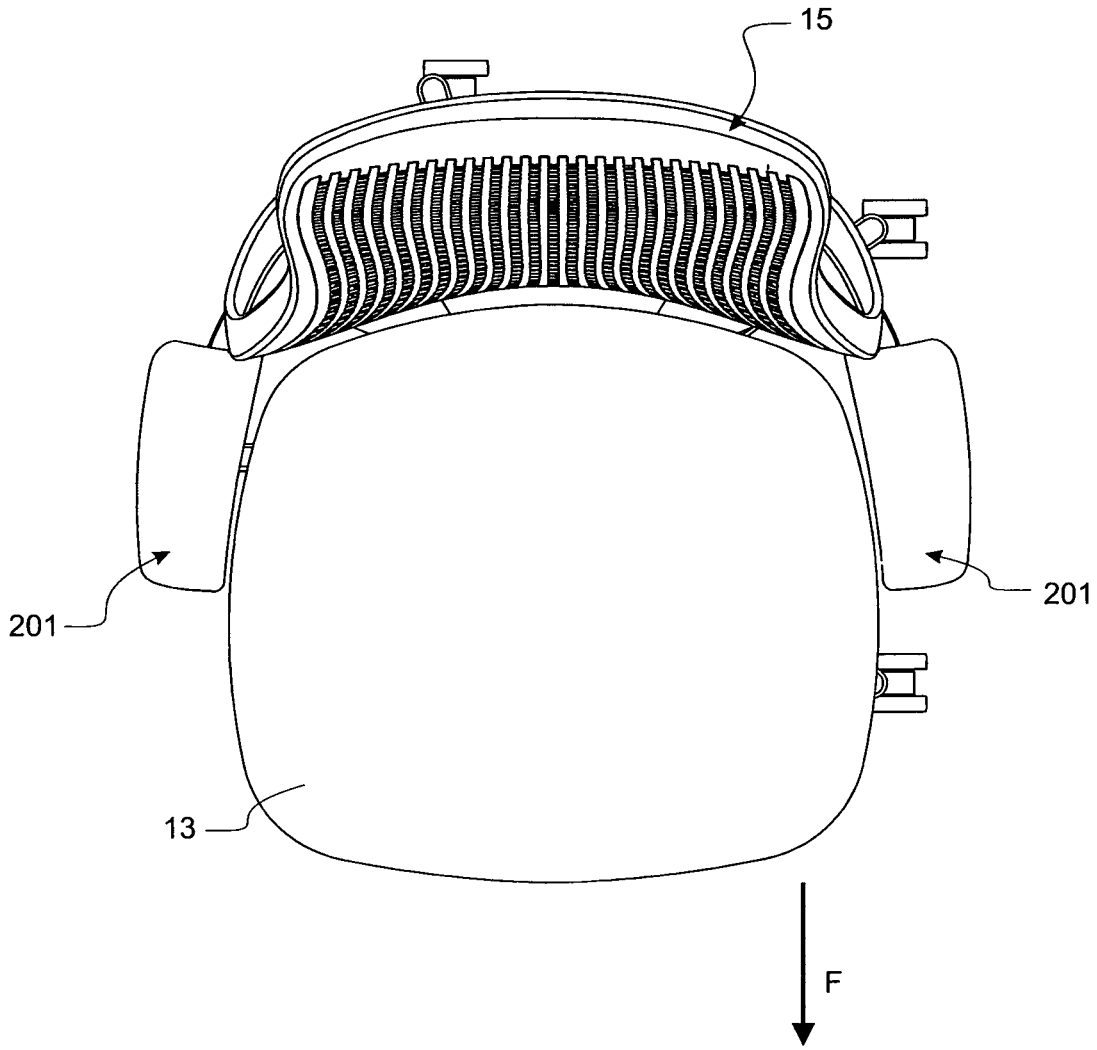
FIG. 1 is an overhead view of a preferred form chair.
Figure 2:
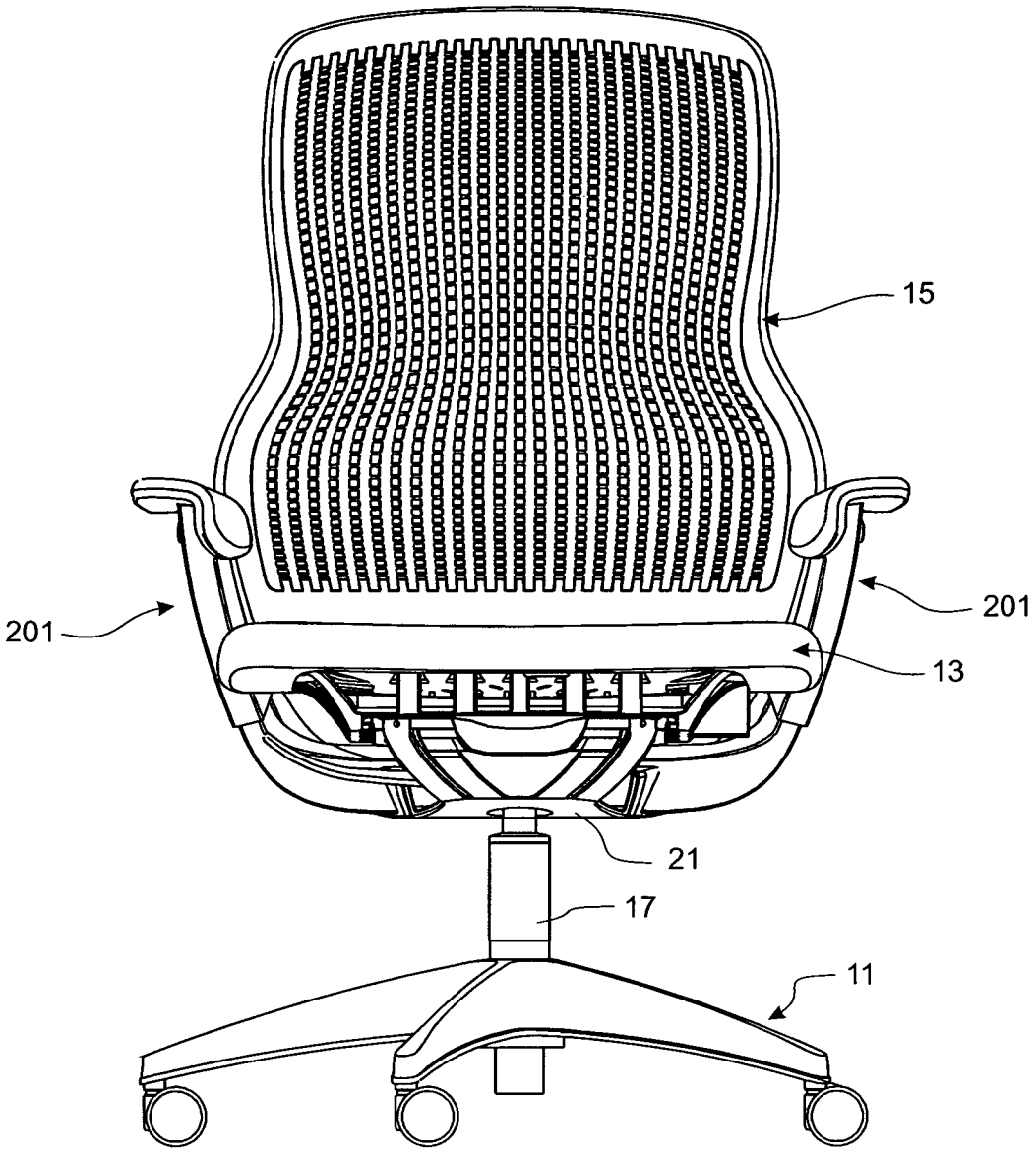
FIG. 2 is a front view of the chair of FIG. 1.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

Since the figures illustrate the preferred form chairs from various different angles as convenient to explain certain parts, an arrow marked "F" has been inserted into the figures where appropriate to indicate a forward direction of the chair. Accordingly the terms forward, rearward, left side, and right side (or similar) should be construed with reference to the forward direction F of the chair, not necessarily with reference to the orientation shown in the particular figure.

The features of the preferred form chairs are described and shown herein to give a full understanding of the components and operation of the preferred form chair. It will be appreciated that not all of the features described herein need be provided in every chair. The preferred form chairs may incorporate or use one or more of the features of the chairs described in our PCT application number PCT/NZ2007/000289 (published as WO 2008/041868), and the content of that specification is incorporated herein in its entirety by way of reference. For the sake of brevity, the present specification does not repeat all of the features that are already described in the referenced PCT application. The reader should refer to that earlier specification for further explanation of features that are not described fully here.

FIGS. 1 to 7 illustrate a preferred form office task chair including a main assembly having a seat portion 13 and a back portion 15. The seat portion 13 and the back portion 15 are operatively supported above the ground by a supporting frame including a wheeled or castored base 11 having a central support column 17 which forms a height adjustment mechanism for selective height adjustment of the main assembly. The base 11 and height adjustment mechanism 17 form a height adjustment pedestal. An upper end of the height adjustment mechanism is connected to the main transom 21 of the chair. The castored base 11, height adjustment mechanism 17, and main transom 21 all form part of the supporting frame.

Details of the castored base will be described below with reference to FIGS. 43 to 49.

Back Portion

Referring to FIGS. 22 to 32, the back portion 15 has a back frame 25. The overall frame width is relatively wide in a lower portion 27, relatively narrow in an intermediate region 29, and an upper portion 31 is wider than the intermediate region 29 but is generally narrower than the lower portion 27. The lower portion 27 is adapted to extend across and support at least a major part of a lower region of a seated adult occupant's back, and the upper portion is adapted to extend across and support at least a major part of an upper region of the occupant's back. In the finished chair the back frame 25 has a compliant cover 61 pulled taut and operatively connected to the upper and lower ends of the back frame and to the sides of the back frame to provide a supporting surface for the back of the seated occupant in a manner described more fully in connection with FIGS. 22 and 33*a* to 34*e*. The back portion has two spaced apart side members S1, S2. The lower portion 27 has a transversely extending lower member 33, and in that region the two spaced apart generally upright side members extend upwardly from the lower member 33 to form side member portions 35*a*, 35*b*. In the form shown, the portions 35*a*, 35*b* are each positioned at a respective end of the lower transverse member. From the transverse lower member 33, the portions 35*a*, 35*b* of side members S1, S2 initially extend upward, outward, and forward, and above that they subsequently extend upward, inward, and reward to form portions 36*a*, 36*b*. The transition between the initial part and the subsequent part forms a region 37*a*, 37*b* of the side members that has a convex curvature when viewed from the front of the back portion, and a convex curvature when viewed from a respective side of the back frame.

In a region 39*a*, 39*b* approximately corresponding to the intermediate region 29, the curvature of the side frame members changes to a concave curvature when viewed from the front of the back portion, and a concave curvature when viewed from a respective side of the back frame. The side frame members extend upwardly into the upper portion 31 of the back frame to form portions 41*a*, 41*b*. Those portions maintain a gently convex curvature when viewed from the front of the back portion and a gently convex curvature when viewed from a respective side of the back portion, for most of their lengths.

The side members have a generally serpentine or sinuous shape in side view.

Figure 28:
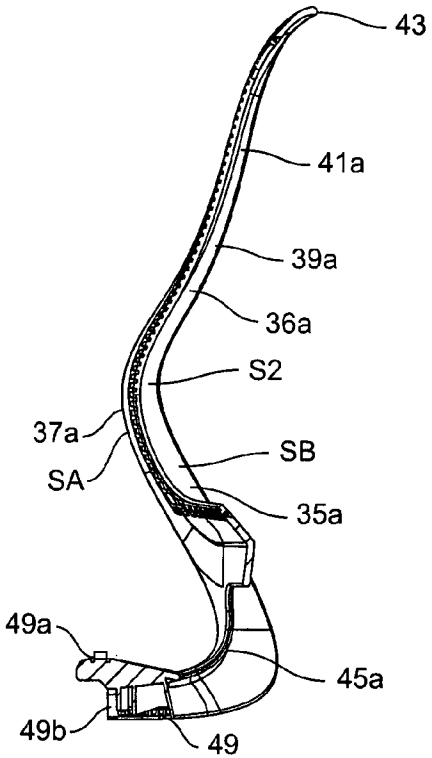
FIG. 28 is a vertical cross-sectional view along line 28-28 of FIG. 27.
Figure 27:
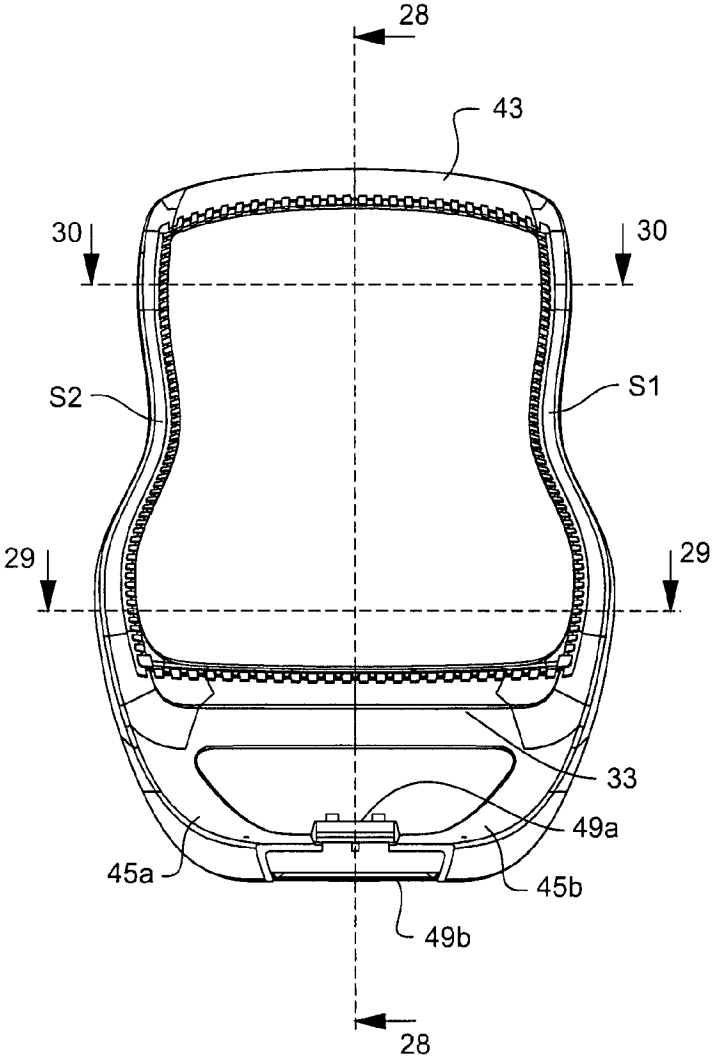
FIG. 27 is a front view of the preferred form back frame of the back portion of FIG. 22.
Figure 29:
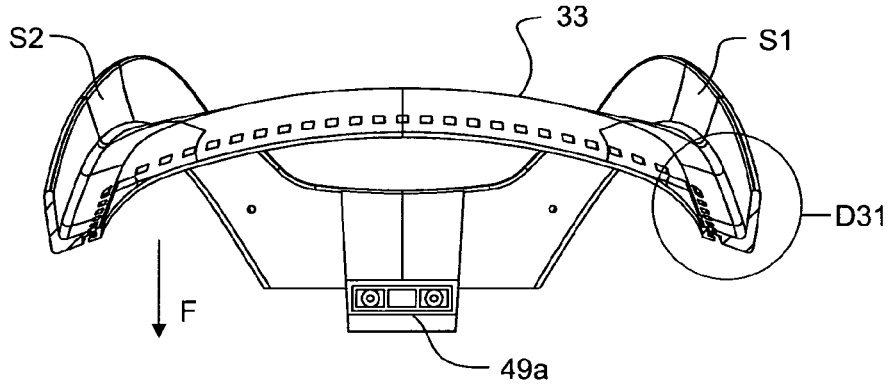
FIG. 29 is a horizontal cross-sectional view along line 29-29 of FIG. 27.
Figure 30:
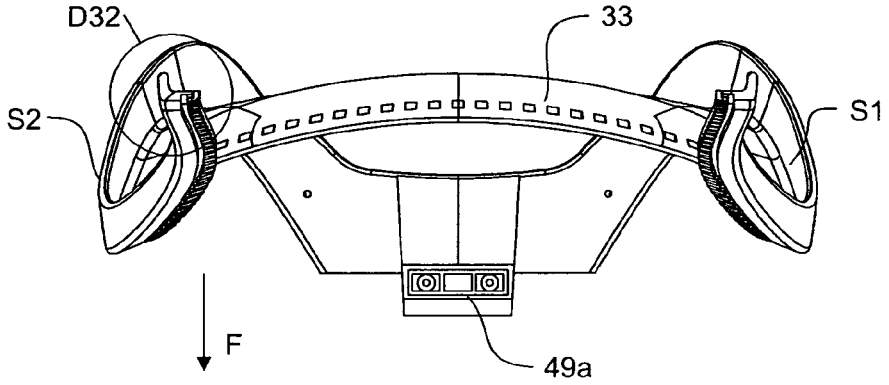
FIG. 30 is a horizontal cross-sectional view along line 30-30 of FIG. 27.
Figure 31:
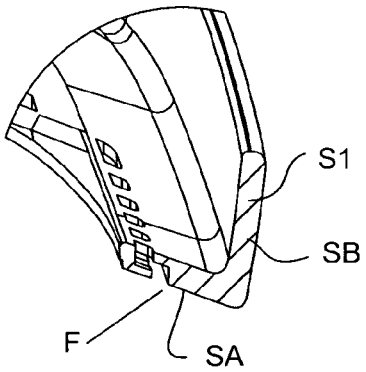
FIG. 31 is a detail view of area D31 of FIG. 29.
Figure 32:
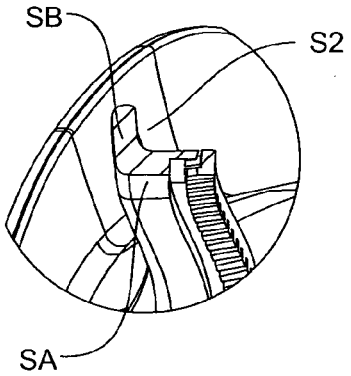
FIG. 32 is a detail view of area D32 of FIG. 30.

The upper end of the frame is defined by a transverse cross member 43, which may extend rearwardly as shown in FIG. 28. The upper end of the back frame may be provided with a surface that enables a user's arm to be supported, such as the type described in our above-referenced PCT application for example.

The lower portion of the back frame is relatively wide, to support a seated occupant when they are side- or angle-sitting.

Portions 37*a*, 37*b* of the side frame members are configured to be positioned generally in the region of a seated adult occupant's lumbar region.

The upper 43 and lower 33 members are generally concave when viewed from the front of the seat, with the concave curvature of the lower frame member being greater than that of the upper frame member. The lower portion of the back frame "cups" the lower back of the seated occupant.

The upper portion 31 may also "cup" the back of adult seated occupant, although to a lesser extent than the lower portion 27 as an adult's upper back region is typically flatter and wider than their lower back region.

Figure 3A:
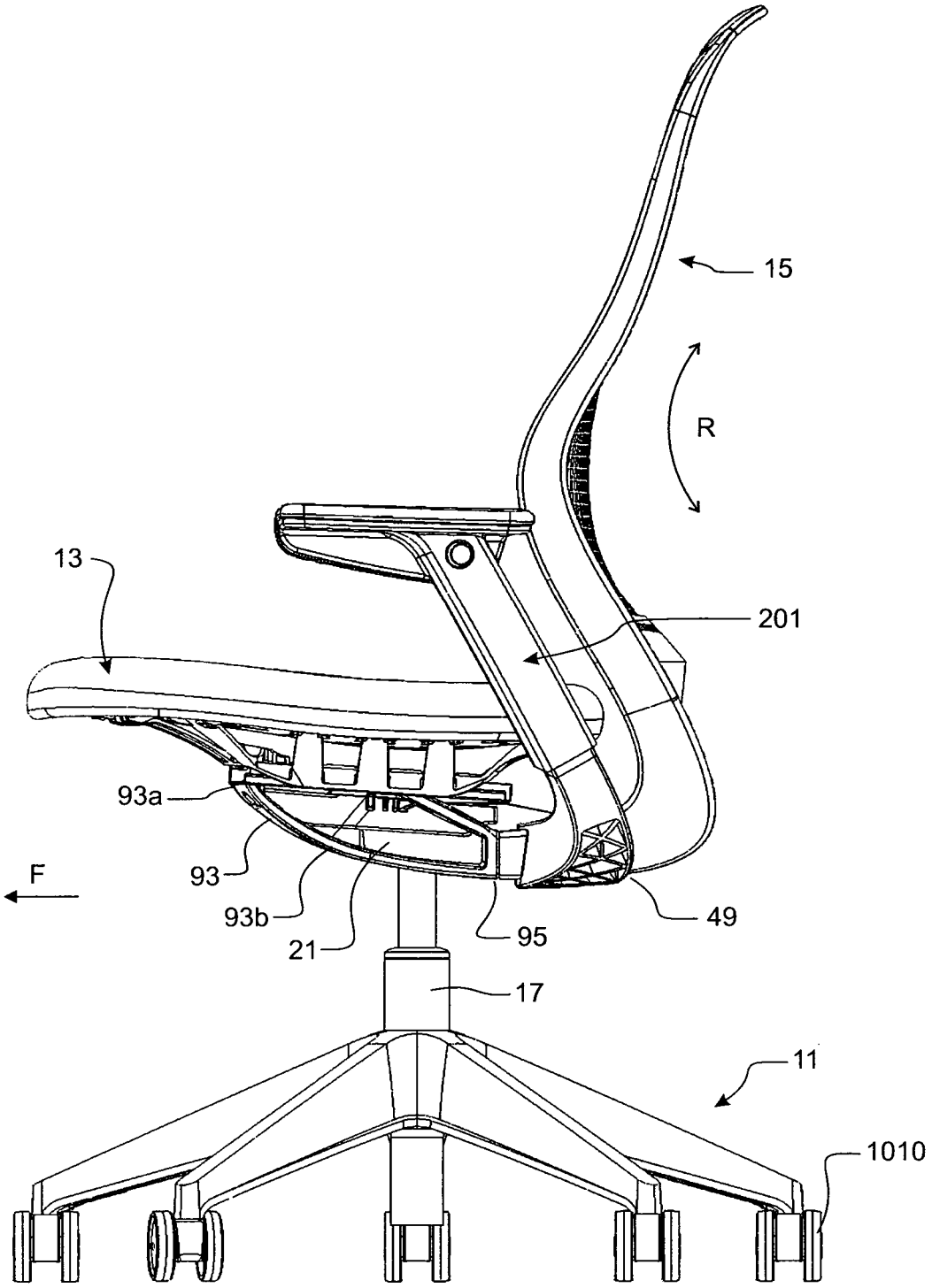
FIG. 3*a* is a left side view of the chair of FIG. 1 showing the back portion in a generally upright position.
Figure 3B:
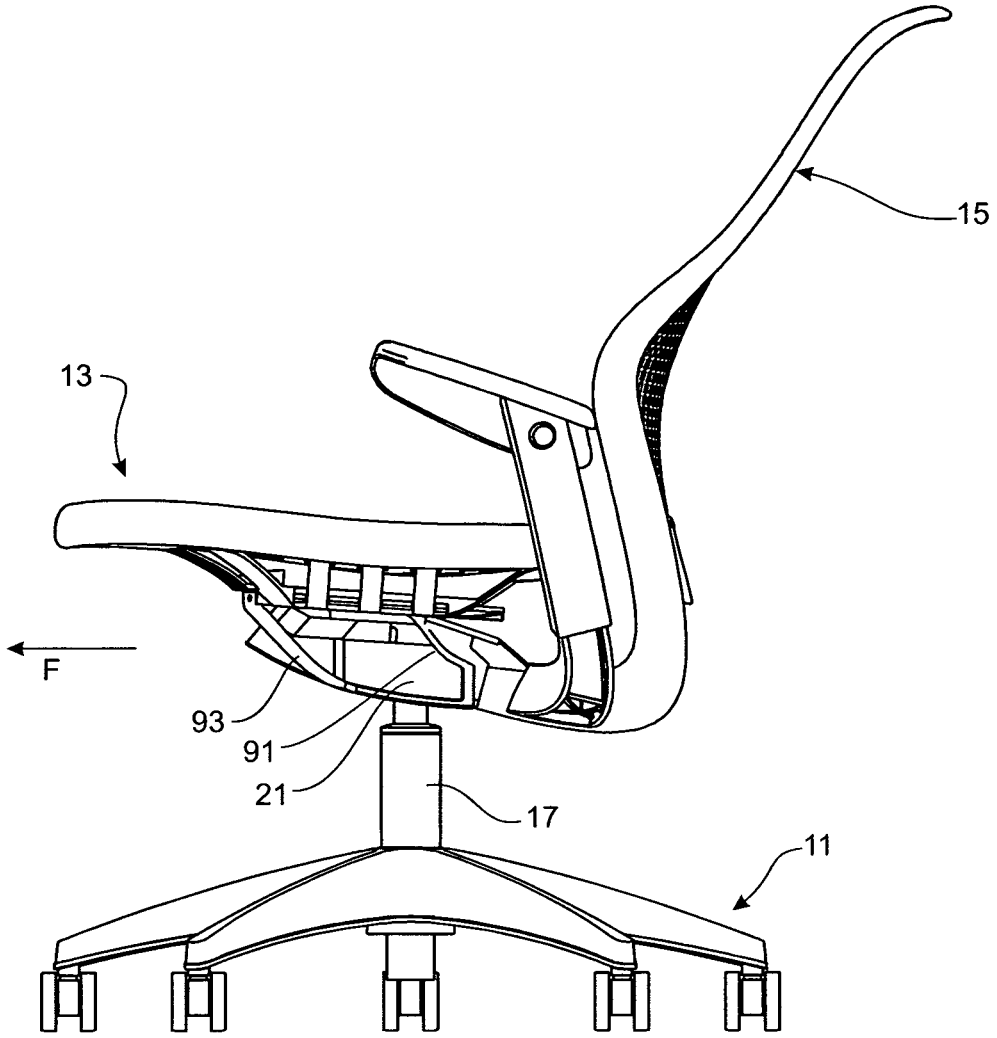
FIG. 3*b* is a left side view of the chair of FIG. 1 showing the back portion in a generally reclined position.

The intermediate region 29 is of a resiliently flexible construction, to provide a flexing movement in a rearward direction of the upper portion 31 relative to the lower portion 27, as indicated by arrow R in FIG. 3*a*.

The back portion comprises at least one support member extending from the lower portion 27, to provide a means of supporting the back portion from another part of the chair, such as the main transom 21 of the supporting frame, the seat portion 13, or from both the seat portion and supporting frame. In the form shown, two horizontally spaced support members 45*a*, 45*b* extend downward, inward, and forward from the ends of lower transverse member 33. The support members have a concave curvature when viewed from the front of the back frame, and a concave curvature when viewed from a position between the members.

The support members 45*a*, 45*b* are of a substantially rigid construction.

In the form shown, the horizontally spaced support members 45*a*, 45*b* are adjoined at lower ends thereof by an integral transverse connector member 49. The transverse connector member incorporates an upper mounting region 49*a* for mounting a puller member 97 of the recline mechanism, and a lower mounting region 49*b* for mounting a lower deformable member 95 of the recline mechanism (see FIGS. 3*d*, 3*e*). The puller and lower deformable member are preferably mounted to the mounting regions using screws that tap directly into the polymeric material of the frame. The recline mechanism will be described in more detail below.

The side frame members S1, S2 preferably have the cross-sectional configuration shown in FIGS. 29 to 32. In conventional chairs, side frame members are complex moulded articles that require internal cross-ribbing in the frame that adds to their moulding and visual complexity. In the preferred form shown, cross-ribbing is not required for the frame. Instead, the side frame members are substantially L-shaped in cross-section as shown. The L shape comprises a main frame portion SA that forms a front face and a rearwardly extending side flange SB that is positioned at the outer edge of the main frame portion. The side flanges resist the majority of the loading applied to the back frame. As the side frame members are L-shaped, the main frame portion SA and flange SB can have parallel walls, yet can still be moulded. As greater loading is taken at the lower portion of the frame, the length of the flange SB is longer for a lower portion of the frame than for the upper portion of the frame.

A similar design could be used for a seat frame that has a stretched cover in the manner described herein to form a seating surface for the occupant. In that case, the main frame portion SA would be a top portion of the frame that faces the seated occupant in use, and the flanges SB would extend downwardly therefrom. In the case of a seat frame, the front, rear, and side members may have the configuration shown in FIGS. 31, 32.

The back frame and support members are of a unitary construction, and may be moulded from a polymeric material for example, and preferably from a recyclable polymeric material. Preferably, the back frame is moulded from a polymeric material having a polyester base. Preferably, the recyclable polymeric material comprises one or more selected from the group comprising: polyethylene terephthalate, polybutylene terephthalate, polyester, recycled polyethylene terephthalate, recycled polybutylene terephthalate, recycled polyester, glass filled polyethylene terephthalate, and recycled glass filled polyethylene terephthalate. Preferably, the cover is also moulded from a polymeric material having a polyester base, such as one of the materials outlined above for example. Preferably, the cover is moulded from Hytrel.

Cover Attachment to Back Frame

Figure 22:
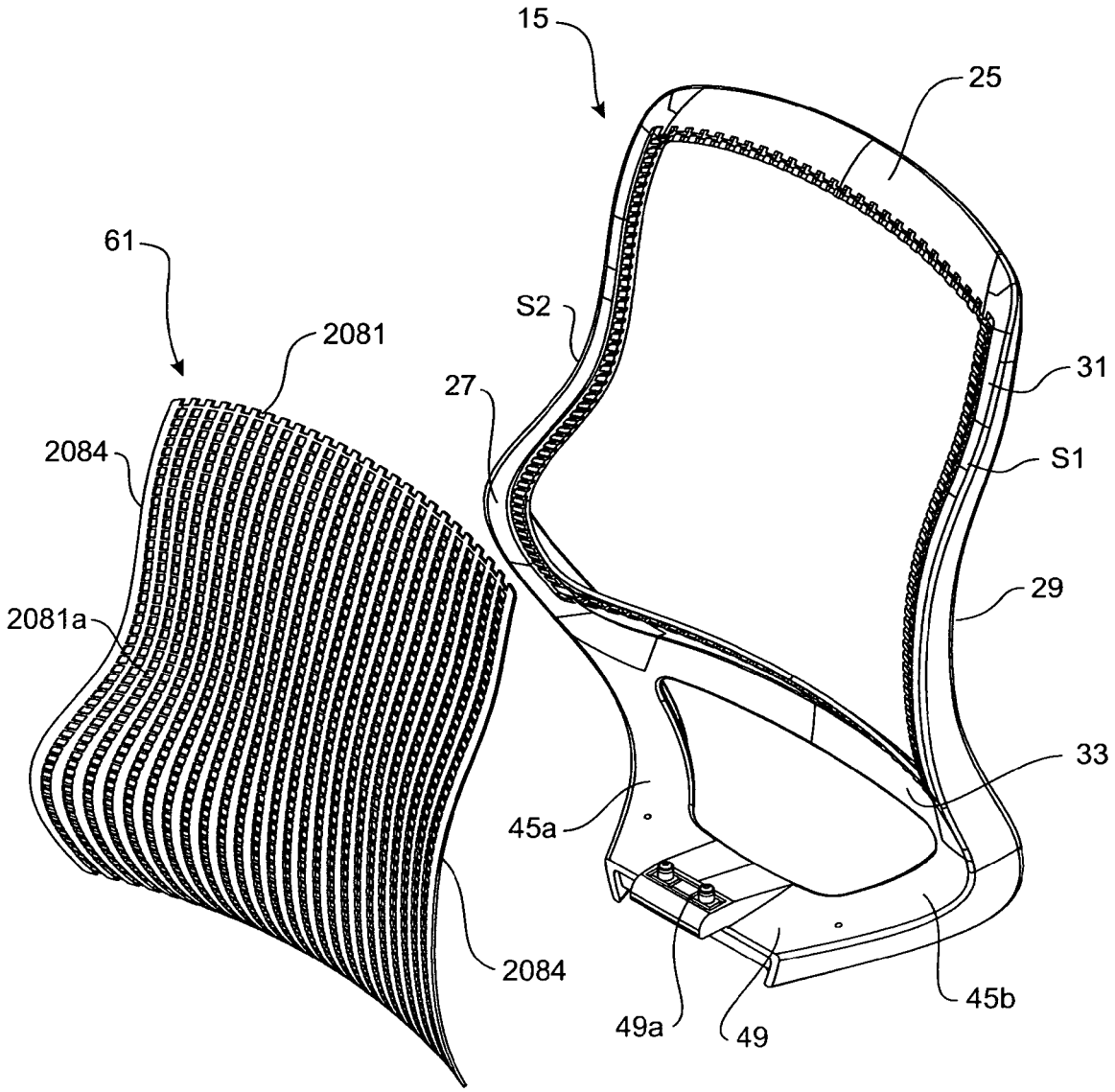
FIG. 22 is an exploded left front perspective view of the preferred form back portion comprising a back frame and cover, of the chair shown in FIG. 1.
Figure 23:
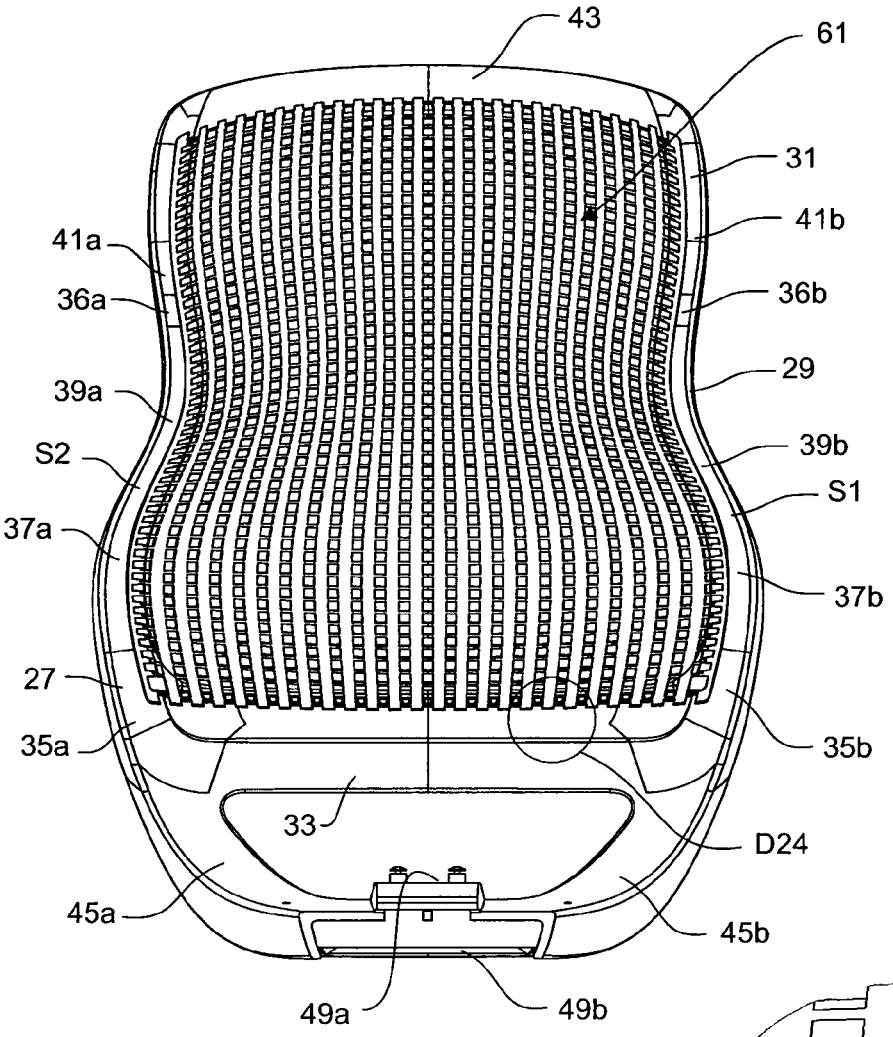
FIG. 23 is a front view of the preferred form back portion of FIG. 22.
Figure 24:
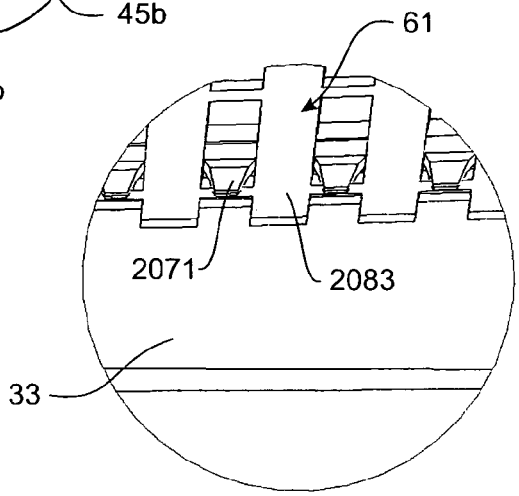
FIG. 24 is a view of detail D24 of FIG. 23.
Figure 25:
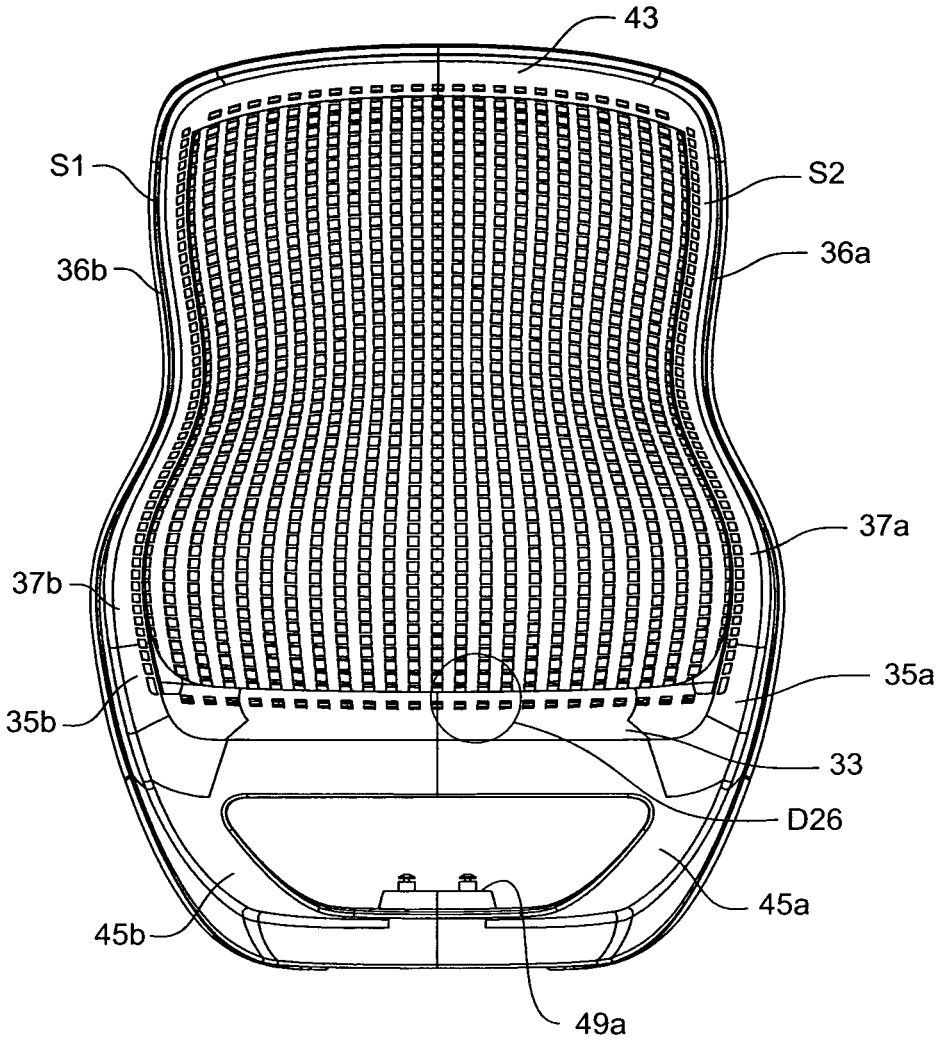
FIG. 25 is a rear view of the preferred form back portion of FIG. 22.
Figure 26:
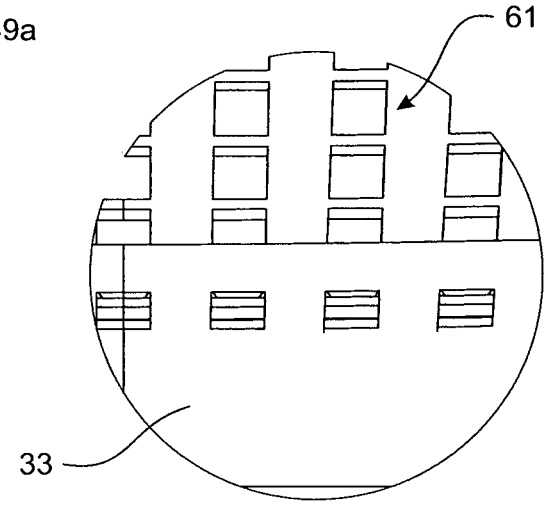
FIG. 26 is a view of detail D26 of FIG. 25.

The resiliently flexible compliant cover 61 shown in FIG. 22 is pulled taut and connected to the back frame to provide a supporting surface for the back of the seated occupant. The cover extends over opening O between the upper, lower, and side members of the back frame. The cover is held in tension between the upper and lower and side members, and is suspended between the members. The cover is a resilient membrane or skin and is preferably generally of the type described in our above-referenced PCT application, and is stretched so that strain orientation of at least part of the cover occurs. The cover is preferably in form of a mesh as shown, but alternatively could be substantially solid. The cover is preferably moulded using the method described in our patent application numbers U.S. 61/043,283 (filed 8 Apr. 2008) and 61/059,036 (filed 5 Jun. 2008) and PCT/NZ2009/000053 (published as WO 2009/126051), and the content of those specifications are incorporated herein in their entirety by way of reference.

Alternatively, the cover could be formed using another technique, such as by extruding and die cutting the cover for example. Again, this type of cover is preferably stretched so that strain orientation of at least part of the cover occurs.

To minimise material use, rather than surrounding the side members of the back frame, the cover extends over the opening O between the side, upper, and lower members of the back frame, and is connected to the front faces of the side, upper, and lower members of the back frame so that outer parts of those members are exposed and not covered by the cover. That is, the outer edges of the back frame are not covered by the cover. Additionally, cover material usage is minimised by having the lower member 33 positioned reasonably high in the back frame, and by having the upper portion 31 of the back frame generally narrower than the lower portion 27 of the back frame.

The cover is provided with attachment features that are integrally formed with the cover as part of the moulding process, and that are used to attach the cover to the frame. The frame has complementary attachment features to attach the cover to the frame.

FIGS. 33*a* to 33*e* show a preferred attachment of the lower portion of the cover to the lower member 33 of the back frame. It should be understood that the upper portion of the cover will be attached to the upper member 43 of the back frame in the same manner.

The lower frame member has a plurality of attachment features 2071 for attaching the cover 61 to the frame member. The attachment features extend into the frame member 33 from a front face FF thereof.

The cover has a plurality of elongate members 2081 extending in a first direction and a plurality of elongate members 2083 extending in a second transverse direction. As outlined above, the cover is preferably a mesh, with apertures provided between at least a majority of the members extending in the first direction and the members extending in the second direction. However, the cover could be a substantially solid cover, with the elongate members formed at the edges of the cover to interact with the attachment features on the frame described below.

In the form shown, the elongate members 2083 are the vertically extending members in the back cover, and the elongate members 2081 are the horizontally extending members in the back cover. The width dimension W1 of the horizontal members 2081 is less than the width dimension W2 of the vertical members. The thickness dimension T1 of the horizontal members 2081 is less than the thickness dimension T2 of the vertical members. That is a result of the horizontal members 2081 being strain oriented a greater amount than the vertical members 2083, when the cover is stretched in the direction corresponding to the lengths of the members 2081, as described in our above-referenced PCT publications.

Each attachment feature 2071 comprises a hook feature 2073 that has an upright 2073*a* and an overhang 2073*b*, with the hook extending in a direction away from a first edge 2074 of the frame member corresponding to the opening O between the upper and lower frame members 33, 43. That is, the hook feature 2073 is open in a direction away from the opening O between the frame members. Each attachment feature 2073 further comprises a recess 2075 adjacent the hook feature. The recess extends from the first edge 2074 of the frame member corresponding to the opening O, past the hook feature, to an end portion 2075*a* beyond the hook feature. In this embodiment, the frame comprises a shoulder 2078 on either side of the end portions 2075*a* of the recesses, and the shoulder separates the end portions 2075*a* of the recesses from one another. The spacing between the shoulders corresponds substantially to a width of the portion of the member 2083 that is received in the end portion of the recess.

Figure 33A:
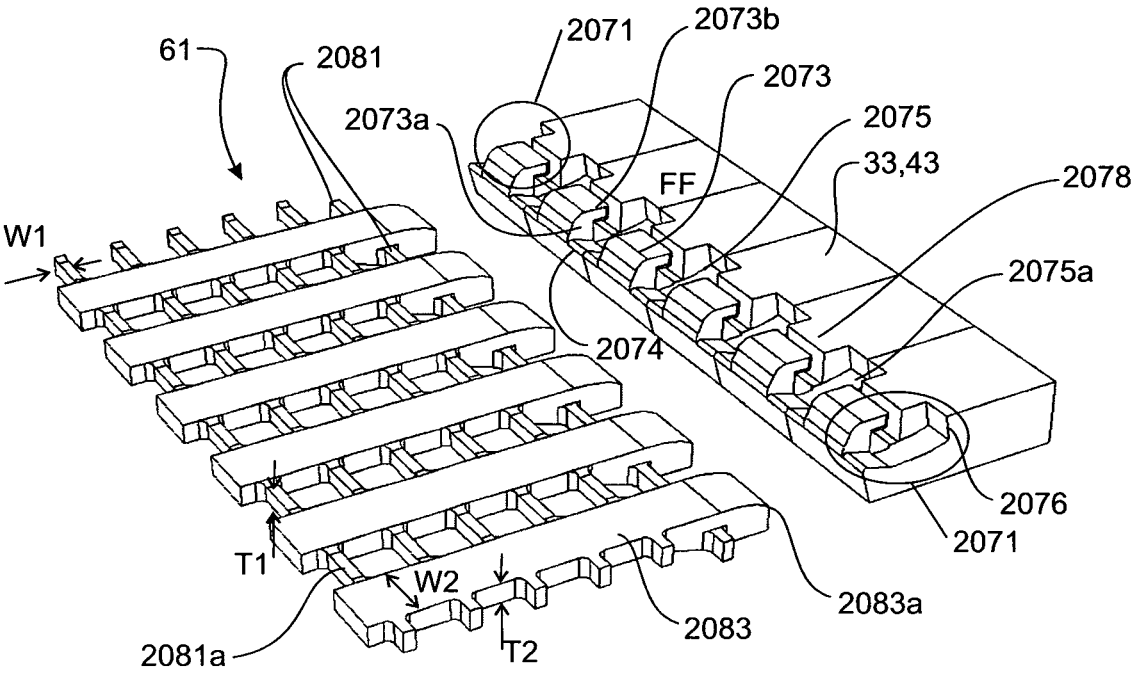
FIG. 33*a* is a front perspective view of part of an upper or lower frame member of the back frame, showing preferred form attachment features for mounting the back cover to the back frame, prior to the attachment of the back cover to the back frame.
Figure 33B:
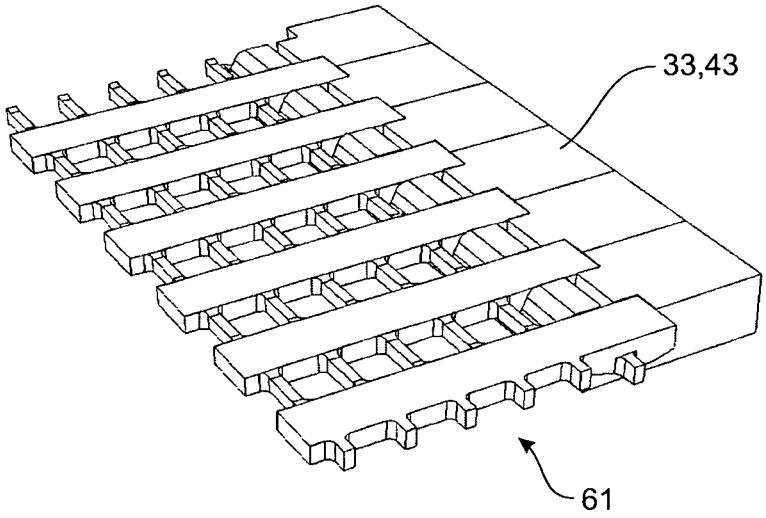
FIG. 33*b* is a front perspective view similar to FIG. 33*a*, after the back cover has been mounted to the back frame.
Figure 33C:
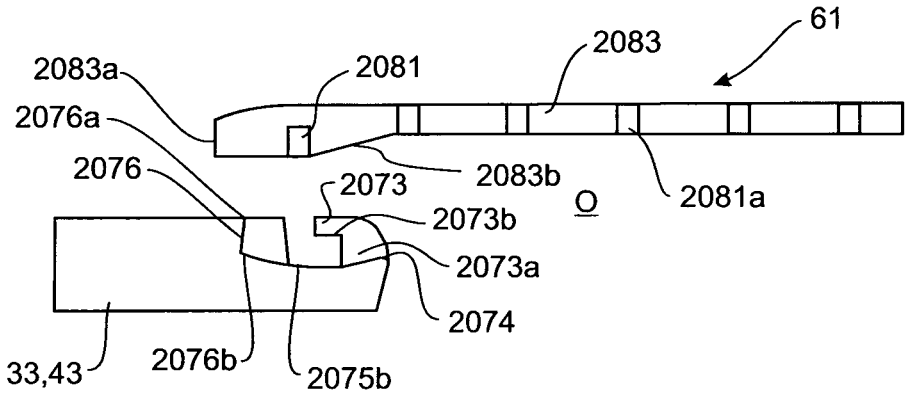
FIG. 33*c* is a sectional view of the region of the back frame and back cover shown in FIG. 33*a*, showing a first step in a preferred method of mounting that portion of the cover to the back frame.

The recess terminates in an end wall 2076 that is spaced from the hook feature. The end wall 2076 comprises an undercut, such that a portion 2076*a* of the end wall distal a base 2075*b* of the recess is positioned closer to the first edge 2074 of the frame member and therefore the opening O than a portion 2076*b* of the end wall proximal the base 2075*b* of the recess, as shown in FIG. 33*c*. The undercut could alternatively have a different configuration, such as an upright and an overhang for example.

Figure 33D:
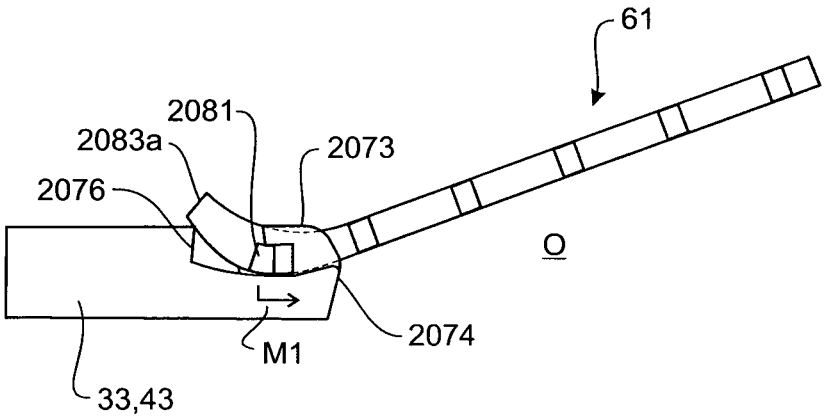
FIG. 33*d* is a sectional view similar to FIG. 33*c*, showing a second step in a preferred method of mounting that portion of the back cover to the back frame.
Figure 33E:
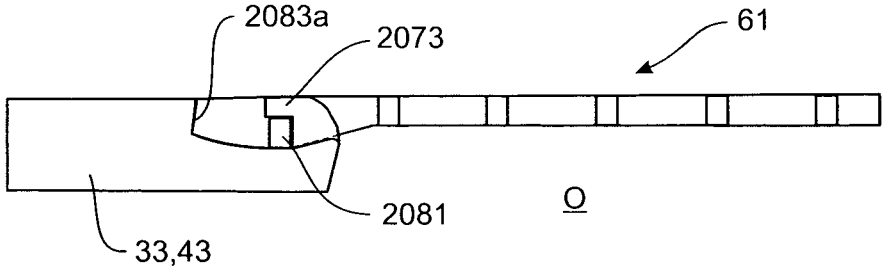
FIG. 33*e* is a sectional view similar to FIG. 33*c*, showing a final step in a preferred method of mounting that portion of the back cover to the back frame.

FIGS. 33*c*-33*e* show the method of assembling the support. Initially, at least a portion of, and preferably the entire, horizontal member 2081 of the compliant cover is inserted under the hook feature 2073. This is performed by stretching the end of the cover in a direction away from the frame opening, and opening O, in moving the member 2081 into position at least partly under the hook feature 2073. Due to tension in the cover, when the stretching force is released from the end of the cover, tension in the cover will cause the horizontal member 2081 to move fully into position under the hook feature 2073, as indicated by arrow M1 in FIG. 33*d*.

A portion of the cover is then inserted in the recess. In this embodiment, at least a portion of the vertical member 2083 is then inserted into the recess 2075 such that the end 2083*a* of the vertical member abuts the end wall 2076 of the recess 2075. As the members 2083 have some resilience, their ends may deform to match the undercut as shown in FIG. 33*e*. As an alternative, the ends of members 2083 could be pre-formed with angled faces corresponding to the undercuts. In an alternative form, the vertical members may not be continuous, and a vertical member separate from the remainder of the vertical member may be inserted in the recess.

As the frame member comprises a plurality of the attachment features, the method will comprise inserting horizontal members 2081 under a plurality of the hook features, and inserting a plurality of the vertical members 2083 of the compliant cover into respective recesses, so that their ends 2083*a* abut the end walls 2076 of the recesses. Generally, all of the horizontal members 2081 will be inserted under the hook features before the members 2083 are inserted into the recesses so their ends abut the end walls 2076 of the recesses; however, the members 2083 could be inserted one at a time.

The attachment to the upper frame member will follow the same steps. Again, the order of inserting the members 2081 and members 2083 could be varied as described above.

The order of attaching the cover to the attachment features on the upper and lower frame members can be varied. For example, the support surface could be assembled by inserting horizontal members 2081 of the compliant cover under a plurality of hook features on the either the upper or lower frame member, and then inserting horizontal members 2081 of the compliant cover under a plurality of hook features on the other frame member, and following that inserting the vertical members into the recesses on both frame members. However, the vertical members could be inserted into the recesses on the first frame member after inserting horizontal members of the compliant cover under a plurality of hook features on the first frame member, and prior to inserting horizontal members of the compliant cover under a plurality of hook features on the further frame member.

It will be appreciated that a suitable form of clamping arrangement can be used when stretching the cover, if necessary.

The attachment features 2071 are in an occupant body-contacting surface of the frame. As shown in FIGS. 33*b* and 33*e*, a forward surface FF of the frame members and the compliant cover 2061 are flush, to provide a smooth contact surface for the occupant.

The frame members 33, 43 and the compliant cover 61 are provided with additional features to assist with attaching the cover to the frame members. As shown in FIG. 33*c*, an underside 2083*b* of each vertical member 2083 is provided with a curved surface that is complementary to the curved shape of the base 2075*b* of the base of the recess. The front top/bottom edge of each vertical member 2083 is tapered with a curvature. As the member 2083 is inserted into the recess, the curved surface in the base of the member 2083 interacts with the curved surface in the base of the recess. This causes the end of the member 2083 to deform, and form an angle corresponding to the angle of the undercut. The deformation also causes the front top/bottom edge of member 2083 to align with the front face FF of the frame member, and with the adjacent portion of the member 2083 (as shown in FIG. 33*e*). The deformation also provides a biasing force of member 2081 against the underside of the hook portion.

Additionally, the end horizontal members 2081 that are positioned beneath the hook features are positioned further from a front surface of the cover than the remaining horizontal members 2081*a*

The configuration of the attachment features and the cover provide a secure attachment between the cover and the frame members. To remove the cover from the frame members, the cover would need to be stretched so the horizontal members 2081 clear the hook features 2073. However, the abutment between the ends 2083*a* of the horizontal members 2083 and the end walls 2076 of the recesses resists that movement. Additionally, the undercuts minimise the likelihood of the ends 2083*a* inadvertently being pulled out of the recesses.

FIGS. 34*a* to 34*e* show a preferred attachment of the side portions of the cover 61 to the side members S1, S2 of the back frame. Again, the attachment features are integrally moulded into the cover and frame.

The front FF of the side frame members are each provided with attachment features 2091. Again, each attachment feature comprises a hook feature 2093. Each hook feature 2093 has an upright 2093*a* and an overhang 2093*b*, with the hook extending in a direction away from a first edge 2094 of the frame member corresponding to the opening O between the side frame members. That is, the hook feature 2093 is open in a direction away from the opening O between the frame members. Each attachment feature further comprises a recess 2095 adjacent the hook feature 2093. The recess extends from the first edge 2094 of the frame member corresponding to the opening O, past the hook feature 2093, to a position 2095*a* beyond the hook feature. These recesses differ in that the end portions 2095*a* are not separated by shoulders as they for the end portions 95*a* of the recesses of the top and bottom frame members. Rather, adjacent end walls are aligned and interconnect, to form a single linear end wall 2096 for the recesses 2095.

The end vertical members 2084 on either side of the cover are formed in a suitable way to cooperate with the attachment features. In particular, the end vertical members 2084 have a first relatively thick outer side portion 2084*a* and a second relatively thin inner web 2084*b*. The relatively thin web portion 2084*b* fits beneath the hook features, and the relatively thick portion 2084*a* sits substantially flush with the front face FF of the side frame members to form a smooth contact surface for the occupant. The end horizontal members 2081*d* are partially tapered, as only the portions of the members 2081*d* that do not have a corresponding web portion 2084*b* will have been strain oriented.

Figure 34A:
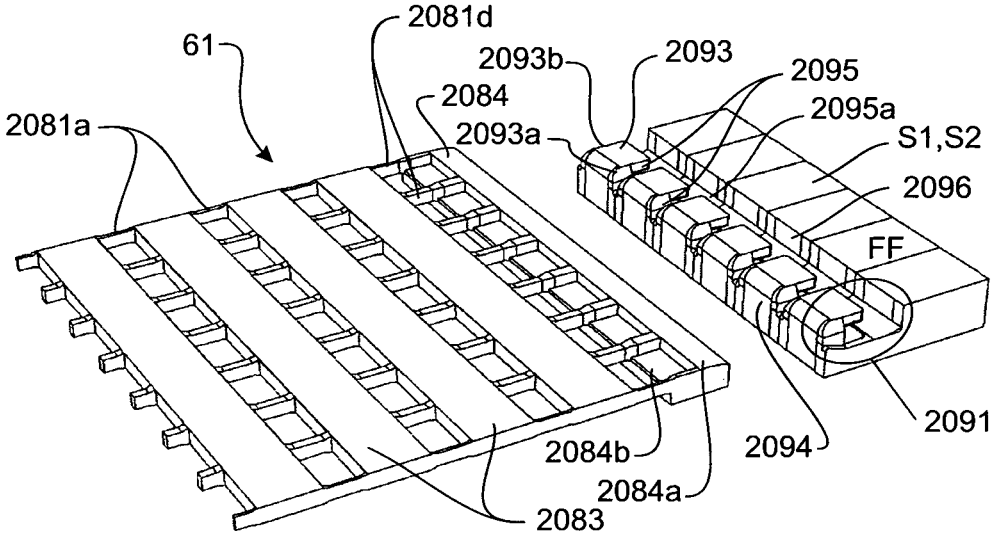
FIG. 34*a* is a front perspective view of part of a left or right side frame member of the back frame, showing a preferred form of attachment feature for mounting the back cover to the back frame, prior to the attachment of the back cover to the back frame.
Figure 34B:
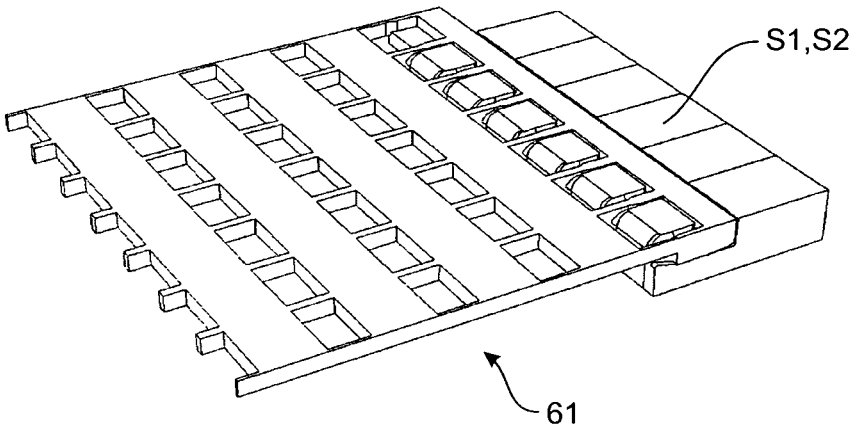
FIG. 34*b* is a front perspective view similar to FIG. 34*a*, after the back cover has been mounted to the back frame.
Figure 34C:
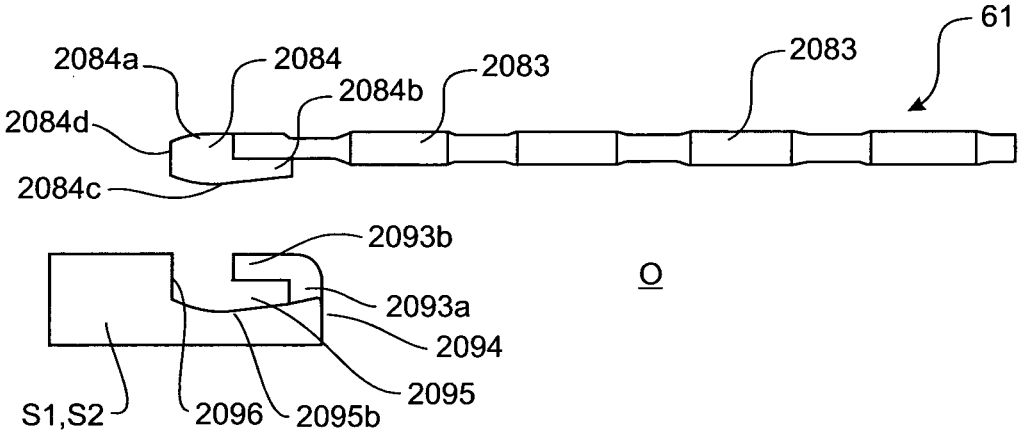
FIG. 34*c* is a sectional view of the region of the back frame and back cover shown in FIG. 34*a*, showing a first step in a preferred method of mounting that portion of the back cover to the back frame.
Figure 34D:
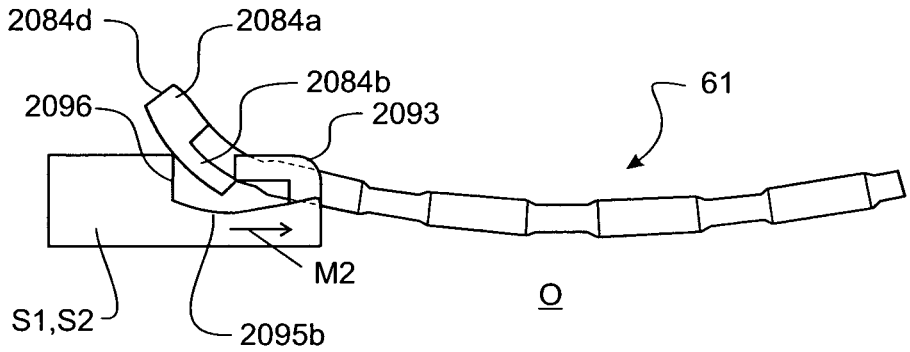
FIG. 34*d* is a sectional view similar to FIG. 34*c*, showing a second step in a preferred method of mounting that portion of the back cover to the back frame.
Figure 34E:
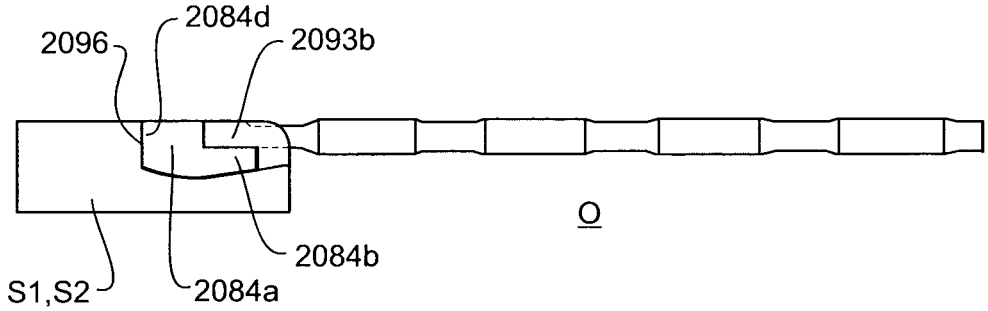
FIG. 34*e* is a sectional view similar to FIG. 34*c*, showing a final step in a preferred method of mounting that portion of the back cover to the back frame.
Figure 35:
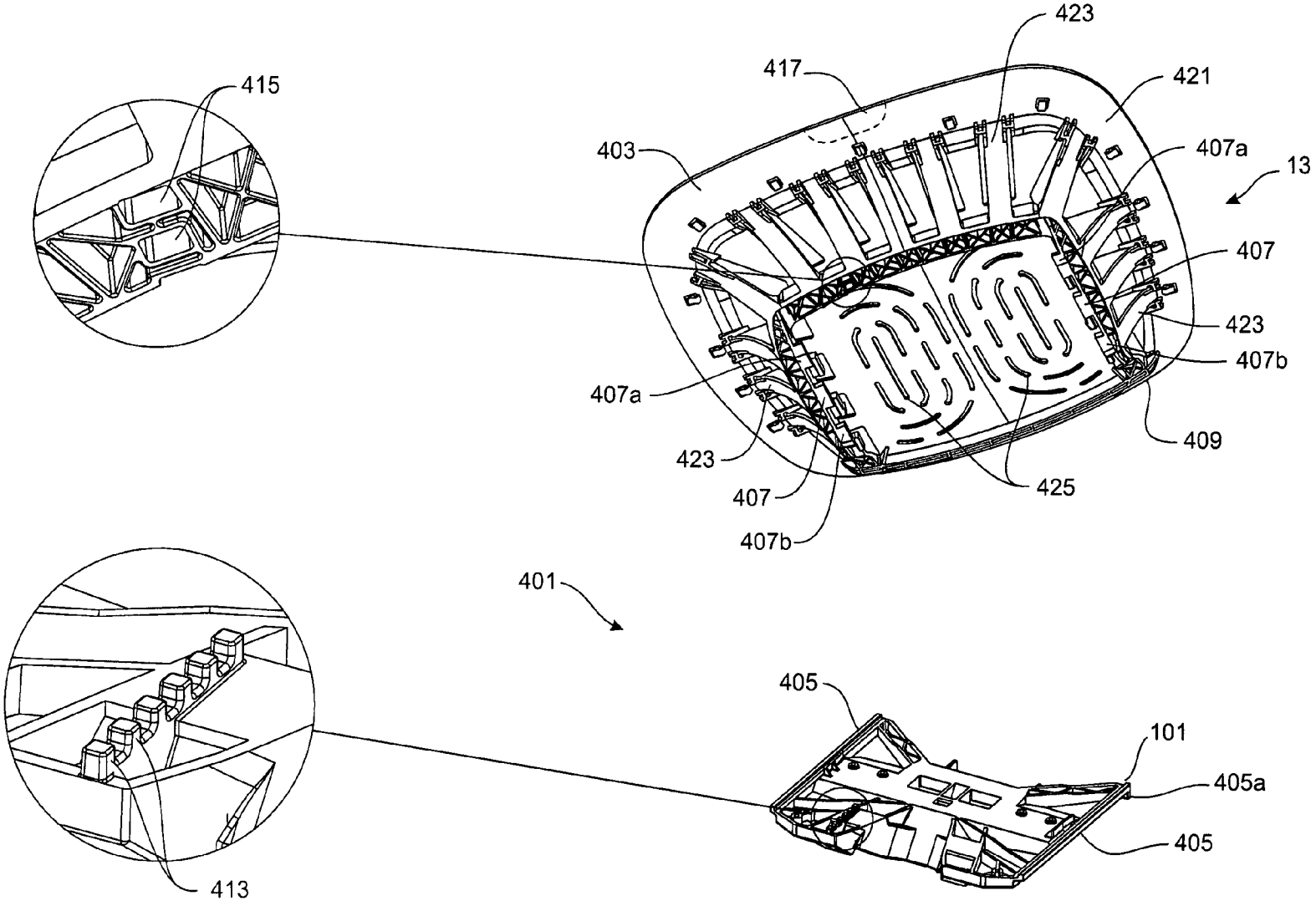
FIG. 35 is an exploded view of a preferred form seat depth adjustment mechanism of the chair of FIG. 1.
Figure 36:
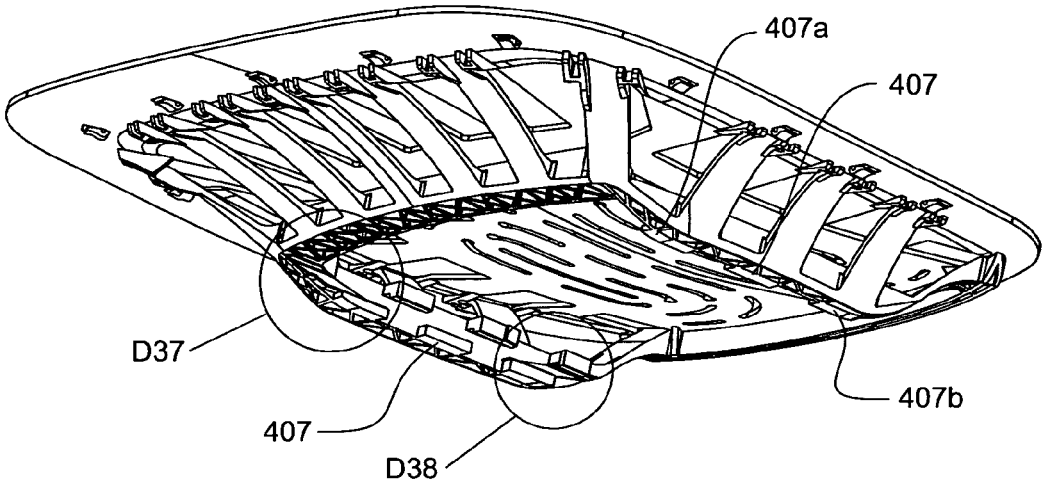
FIG. 36 is an underside perspective view of the seat portion, showing features of the seat depth adjustment.

FIGS. 34*c*-34*e* show the method of assembling the support to the side frame members. Initially, at least a portion of the side vertical member, and in this embodiment the web 2084*b*, is inserted under the hook feature 2093. This is performed by stretching the side of the cover in a direction away from the frame opening O, and moving the member 2084 into position at least partly under the hook feature 2093. Due to tension in the cover, when the stretching force is released from the side of the cover, tension in the cover will cause the vertical member 2084 to move fully into position under the hook feature 93, as indicated by arrow M2 in FIG. 34*d*.

Portion 2084*a* of the vertical member 2084 is then moved into the recess 2095 such that the outer edge 2084*d* of the vertical member 2084 abuts the end wall 2096 of the recess 2095. As the members 2084 have some resilience, their outer sides 2084*d* may deform to match the undercut as shown in FIG. 34*e*.

In the form shown, the end wall 2096 of the recesses does not have an undercut. In this embodiment, the length of the overhang 2093*b* of the hook feature, the width of the member 2084, and the abutment of the edge of the member 2084 against the wall are sufficient to maintain the cover in connection with the frame member.

However, again the front outer edge of each member 2084 is tapered with a curvature. As the member 2084 is inserted into the recess, the curved surface in the base of the member 2084 interacts with the curved surface in the base of the recess. This causes the member 2084 to deform, and form an angle corresponding to the angle of the undercut. The deformation also causes the front outer edge of member 2084 to align with the front face FF of the frame member (as shown in FIG. 34*e*). The deformation also provides a biasing force of member 2084*b* against the underside of the hook portion.

The attachment to the opposite side frame member can follow the same steps.

In the form shown, the frame is a back frame for a chair and the top and bottom frame members have one type of attachment feature and the side frame members have another type of attachment feature. Alternatively, the frame may be a seat frame for a chair. The front and rear seat frame members may have the attachment features described above for the upper and lower back frame members, and the side seat frame members may have the attachment features described above for the side back frame members.

Alternatively, the same attachment feature(s) could be used for attaching a cover to a frame in a different type of article that has a support. By way of example only, the same attachment feature(s) could be used to form supports of: baby products including car seats, bouncy beds, baby buggies, cots; trampolines; other furniture such as dental chairs, aeroplane seating, stadium seating, outdoor furniture; bedding; or automotive seating.

In the forms described above, the compliant cover is attached to a body contacting surface of the frame. Alternatively, the compliant cover may extend across the opening and around an exterior of the frame members. In that embodiment, the recess(es) of the attachment feature(s) preferably extend(s) into the frame member(s) from edge(s) of the frame member(s) opposite the opening. In that embodiment, the hook feature(s) will be oriented in a direction toward the opening, and the end walls of the recesses will be positioned closer to the opening than to the outer edges of the frame members.

Rather than using different attachment features for the upper and lower and side frame members, the cover could be attached to all frame members using the same type of attachment features.

Seat and Seat Depth Adjustment

A preferred form seat depth adjustment mechanism is shown in FIGS. 35 to 42 and is indicated generally by reference numeral 401.

The seat support 101 forms a seat slide that slidably supports the seat portion 13. The seat portion is preferably manufactured as a single injection moulded component, and preferably includes a seat panel 421, a plurality of resilient supports 423 that support the seat portion, and part of the seat depth engagement (which in the embodiment shown are channels 407 having left and right forward members 407*a* and left and right rear members 407*b*). Alternatively, the seat panel may be attached to the supports by suitable features such as clips for example.

The seat panel 421 preferably also comprises zones of increased flexibility 425 for receiving an occupant's ischial protruberosities. The seat panel is preferably tiltable on the resilient supports 423 when a user's weight is offset, and the sides and front portion of the seat are preferably resiliently flexible to flex downward under the weight of an occupant's legs. The reader is referred to our above-referenced PCT application for further detail on the panel tilting and flexibility.

The seat portion 13 is selectively moveable in a forward and rearward direction relative to the supporting frame. The seat portion has a locked configuration, shown in FIGS. 39*a* and 39*d*, and a released configuration, shown in FIGS. 39*b* and 39*c*. In the locked configuration, forward and rearward movement relative to the supporting frame is minimised, and is preferably prevented. In the released configuration, forward and rearward movement relative to the supporting frame is enabled.

In the preferred embodiment, the chair has a seat support 101 and the seat portion 13 is slidable relative to the seat support to provide the selective forward and rearward movement of the seat portion. The seat portion 13 is adjustable from the locked configuration to the released configuration by raising a forward portion 403 of the seat portion relative to the seat support. In the embodiment shown, the forward portion 403 of the seat portion is lifted relative to the seat support 101 to release the seat portion from the locked configuration. The seat support has a pair of rails 405 with one rail 405 extending outwardly from each side. The seat portion comprises members in the form of channels 407 that slidably receive the rails. The channels may comprise continuous walls or, as shown, may comprise multiple members making up the channels. The configuration could be reversed, with the rails provided on the seat portion and members or channels formed on the seat support.

The members 407*a*, 407*b* and rails 405 have a closer fit toward a rear portion 409 of the seat portion than toward a forward portion 403 of the seat portion. The closer fit may be provided by protrusions that extend into the channels or a narrowing of the channels towards the rear portion. The closer fit toward the rear portion allows sufficient movement between rails and channels at the forward portion of the seat portion and the seat support, to enable the seat portion to be adjusted to the released configuration by raising the forward portion of the seat portion 13 relative to the seat support 101.

Figure 39A:
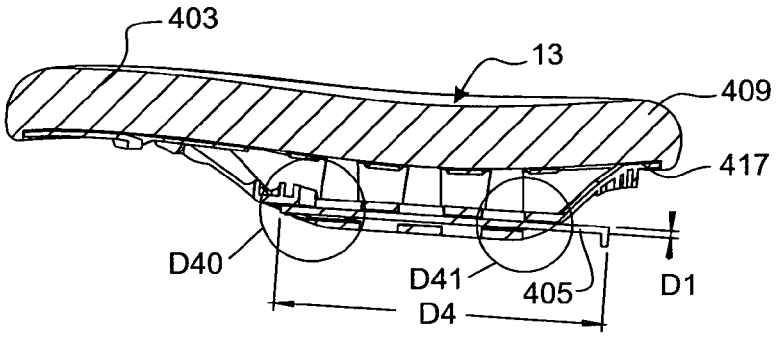
FIG. 39*a* shows features of the seat depth adjustment mechanism of FIG. 35, with the seat in a most forward locked position.

FIGS. 39*a* show the dimensions of a preferred embodiment configuration. D1 (the thickness of the rails 405)=4.5 mm, D2 (the spacing in the channel at a forward end of the mechanism)=7.0 mm, D3 (the spacing in the channel at a rear end of the mechanism)=5.5 min, D4 (the length of the rails)=210 mm, D5 (the length of the lower end of the channel)=132 mm, D6 (the length of the upper end of the channel)=193 mm. While these dimensions could be readily modified, they are provided by way of example.

Figure 37:
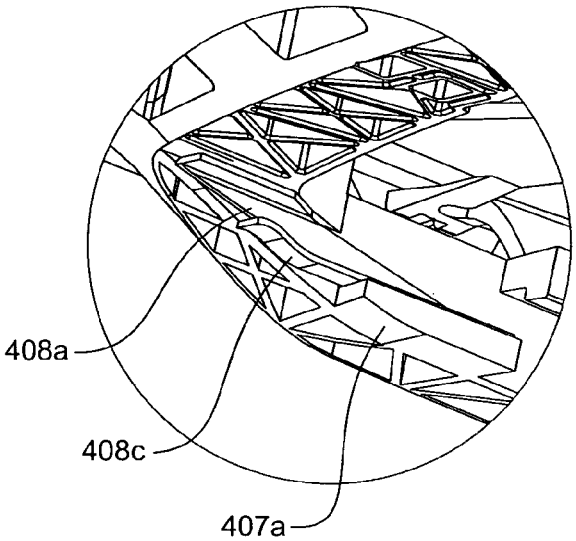
FIG. 37 is an underside perspective view of detail D37 of FIG. 36.
Figure 38:
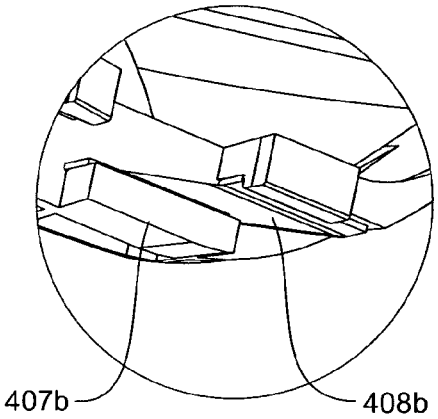
FIG. 38 is an underside perspective view of detail D38 of FIG. 36.

In the form shown, the chair comprises optional bearing members that provide a sliding interface between the members 407*a*, 407*b* and the rails 405. In the form shown, the bearing members 408*a*, 408*b* comprise liners made from a suitable material, such as nylon, Acetal, or polyester for example. As shown in FIGS. 37 and 38, the chair comprises two front bearing members 408*a* (which are preferably in the form of channels having side walls and upper and lower walls) and two rear bearing members 408*b* (which are preferably in the form of channels having side walls and upper and lower walls). The front bearing members 408*a* are mounted in the front members 407*a* and the rear bearing members 408*b* are mounted in the rear members 407*b*. The mounting can be of any suitable type, such as fasteners or adhesive for example. The front bearing members provide a sliding interface between the members and rails at a forward part of the seat portion and the rear bearing members provide a sliding interface between the members and rails at a rearward part of the seat portion.

Rather than being mounted to the members, the bearing members may be mounted to the rails. The bearing members slidably engage the other of the members and the rails.

At least one biasing device minimises play between the forward portion of the seat portion and the seat support. The biasing device may be a leaf or compression spring, which may be integrally formed with either the seat portion or the seat support, or may be a separately formed component. In the preferred form shown, each front bearing member 408*a* comprises an integrally formed leaf spring 408*c*. The leaf springs 408*c* act on the rails 405 to bias the forward portion of the seat portion downwardly relative to the seat support, to bias the seat portion into the locked configuration.

One of the seat portion and the seat support comprises at least one projection 413, and the other of the seat portion and the seat support comprises a plurality of engagement features 415 for the projection(s). In the preferred form shown, the seat portion comprises two engagement features 415 which, in the form shown, are recesses, and the seat support comprises a row of projections 413. The projections could instead be provided in the seat portion and the engagement features in the seat support. Two of the projections 413 engage in the recesses 415 when the seat portion is in the locked configuration, and do not engage with any of the recesses when the seat portion is in the released configuration.

The chair may comprise two groups of engagement features that are each selectively engageable with at least one respective projection when the seat portion is in the locked configuration. The projections and engagement features are offset toward respective sides of the chair from a centre of the chair, so that at least one projection remains in engagement with an engagement feature if the seat portion is in a locked configuration and side loading is applied to the seat portion.

The engagement features can comprise any suitable type, such as comprise a plurality of recesses or apertures 415 for example. The seat portion 13 is adjustable from the locked configuration to the released configuration by lifting the forward portion of the seat portion relative to the supporting frame, which releases the projections 413 from the apertures 415. The seat portion may then be moved forwardly or rearwardly to the new selected position. The seat portion is then lowered so that the projections 413 will engage the apertures corresponding to the new selected position.

The seat portion may also have an indicator 417 to indicate the portion of the seat portion that should be raised to move the seat portion to the released configuration. The indicator may be a visual indicator, a tactile indicator, or a combination thereof. In the preferred embodiment, the indicator comprises a tactile indicator. The tactile indicator is provided on the underside of the front of the seat portion, and comprises a recess to receive a plurality of a user's fingers. A visual indicator may be provided in a front or upper surface of the seat portion, such as in a cushion cover for example.

Figure 39B:
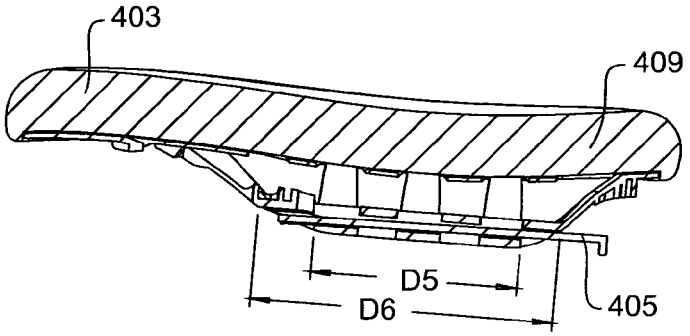
FIG. 39*b* is a view similar to FIG. 39*a*, but with the front portion of the seat raised so the seat is depth adjustable.
Figure 39C:
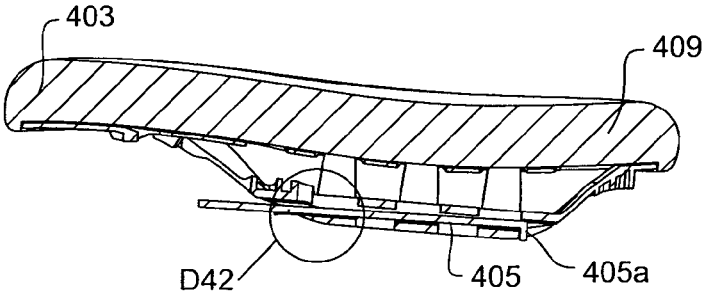
FIG. 39*c* is a view similar to FIG. 39*b*, but with the seat moved to a most rearward position.
Figure 39D:
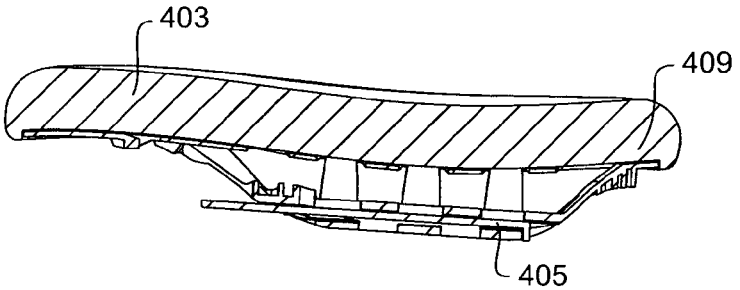
FIG. 39*d* is a view similar to FIG. 39*c*, but with the front portion of the seat lowered so the seat depth is locked.
Figure 40:
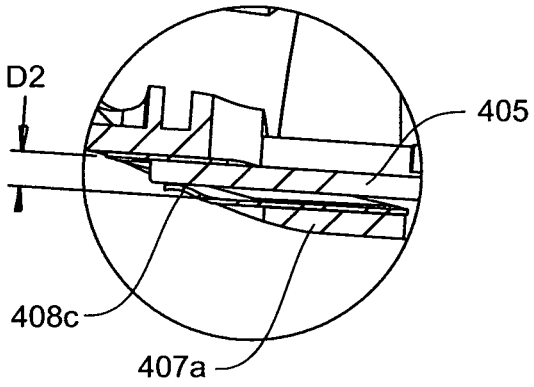
FIG. 40 is a view of detail D40 of FIG. 39*a;*
Figure 41:
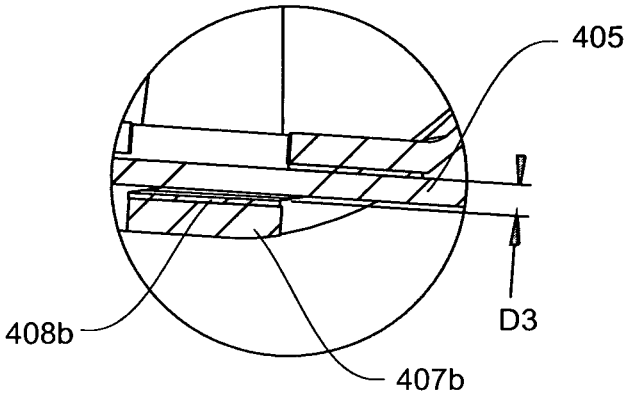
FIG. 41 is a view of detail D41 of FIG. 39*a;*
Figure 42:
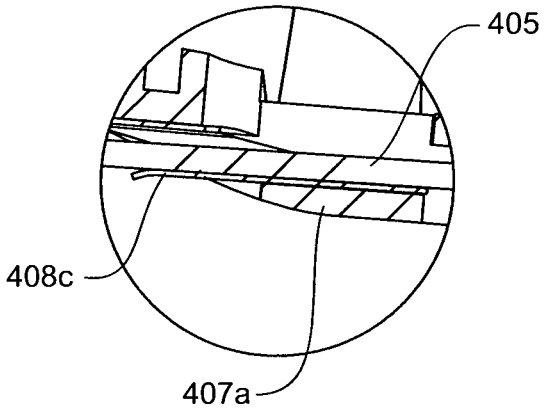
FIG. 42 is a view of detail D42 of FIG. 39*c;*
Figure 43:
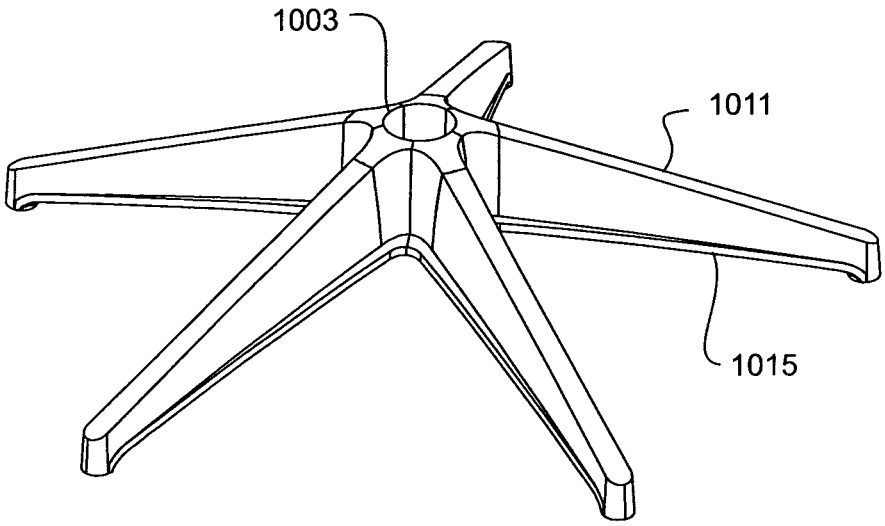
FIG. 43 is an overhead perspective view of a preferred form castored base for use in the chair of FIG. 1.
Figure 44:
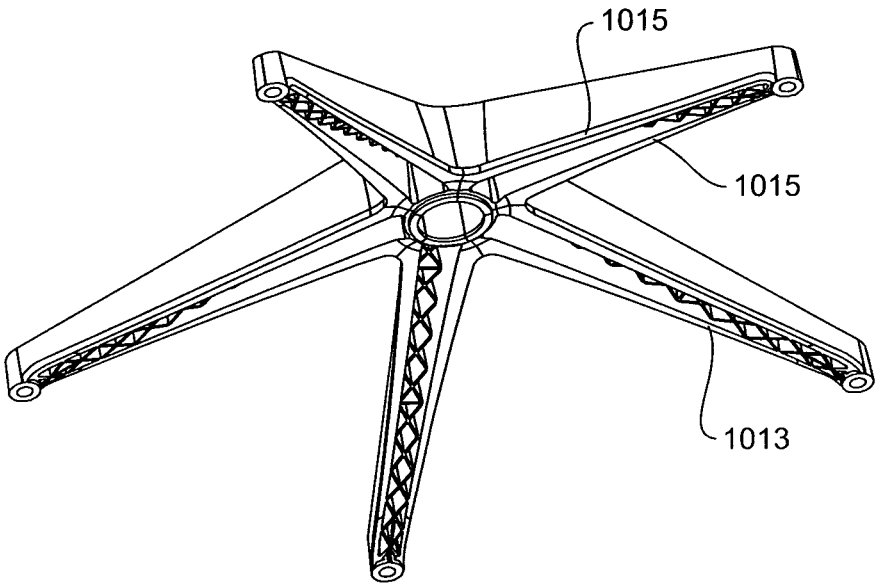
FIG. 44 is an underside perspective view of the base of FIG. 43.
Figure 45:
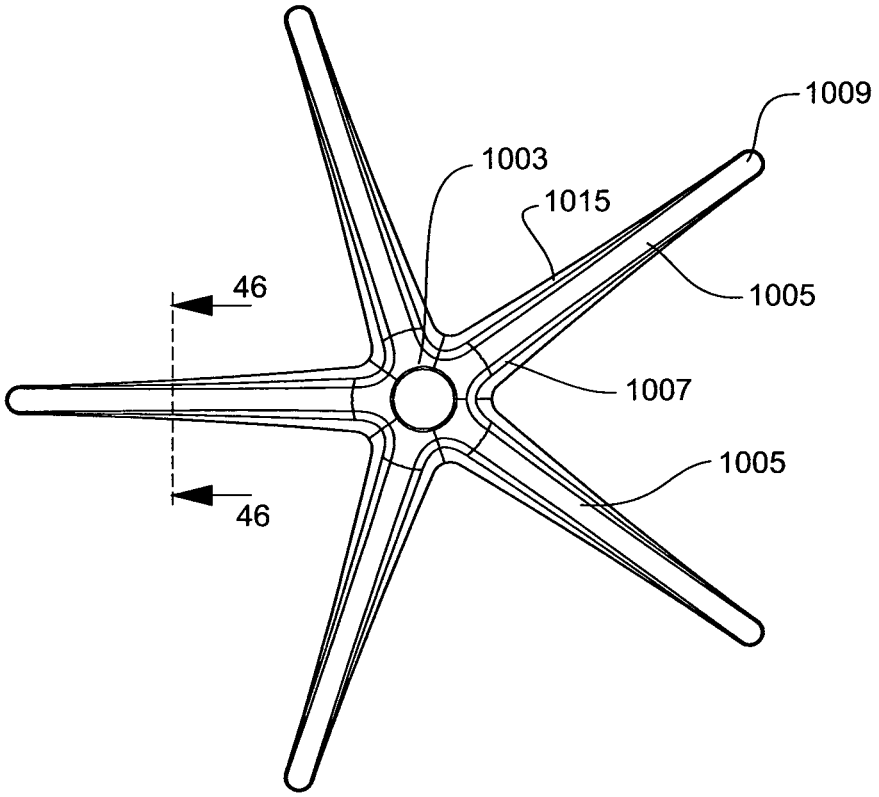
FIG. 45 is an overhead view of the base of FIG. 43.

A method of adjusting the seat depth will now be described with reference to FIGS. 39*a* to 42. FIG. 39*a* shows the seat portion in a most forward position. To adjust the seat depth, the forward portion of the seat lifted, as shown in FIG. 39*b*. In that position the projections 413 are clear of the recesses 415. The seat portion can then be moved to a rearward position. For example, FIG. 39*c* is a view similar to FIG. 39*b*, but with the seat portion moved to a most rearward position. It can be seen from FIG. 42 that the leaf springs 408*c* have been flattened (against the bias of the spring) by lifting the forward portion of the seat portion. FIG. 39*d* shows the forward portion of the seat portion lowered so the seat depth is locked. In that position, the projections 413 engage the recesses 415. Preferably, the seat portion has a forward position, a rearward position, and at least one intermediate position.

While the front of the seat portion is resiliently flexible downwardly under the weight of an occupant's legs as the chair is reclined, in an upward direction the front of the seat portion is sufficiently rigid that a user can lift the front edge to enable depth adjustment of the seat portion.

A cushion of any suitable type may be supported by the seat panel. A cushion cover may also be provided. The cushion and cushion cover are preferably recyclable polymeric material, such as the types described herein for example.

In this embodiment, the chair comprises a recline mechanism (described below) that is configured to move the seat support (and thereby the seat portion) upon recline of the back portion. Alternatively, seat depth adjustment could be incorporated into a different type of chair in which the seat support is a fixed part of the supporting frame. The seat support may, for example, be integrally moulded with a remainder of the supporting frame.

Arm Assemblies

In some embodiments, the chair may be provided with arm assemblies. Preferred form arm assemblies are shown in FIGS. 18*a* to 21*a*, and are indicated generally by reference numeral 201. The arm assemblies are preferably attachable to another part of the chair, so that the chair can readily be configured with or without arm rests as desired.

The arm assemblies 201 are height adjustable arm assemblies. The arm assemblies have a support 203, and an arm rest 205 that is slidably supported by the support to provide height adjustability of the arm rest on the support. The arm rest supports the arm of a chair occupant. The arm assemblies also have a locking mechanism for locking the arm rest in a selected height adjusted position relative to the support.

The arm rest 205 comprises an arm rest member in the form of a tubular member 221 that telescopically receives the support 203. The arm rest member 221 has a contoured support portion 222 at its upper end, and the contoured support portion 222 is positioned to support a substrate 207. A cushion 209 is supported by the substrate. The cushion may be a self-skinning article, or may have a separate cushion cover.

Preferably, at least a major part of the arm rest, comprising the tubular member 221, support portion 222 and substrate 207 are manufactured from one or more recyclable polymeric materials that can be recycled together. Preferably, the cushion and (optional) cushion cover are also manufactured from one or more recyclable polymeric materials that can be recycled together with the remainder of the arm rest. Alternatively, the cushion (and cover if applicable) may be manufactured from a material that cannot be recycled with the remainder of the arm rest. The cushion 209 may be attached to the substrate in any suitable way. For example, the cushion (and optionally the cushion cover) may be connected together by welding, clips, or a combination of welding and clips. The cushion may be over-moulded onto the substrate 207. The clips are formed of a recyclable polymeric material. The clips may be integrated into one of the components. In the embodiment having a cushion and cushion cover, preferably, as the substrate 207 is welded or clipped to support portion 222, a peripheral edge of a cushion cover is captured between components 207 and 222, to mount the cushion and cushion cover to the arm rest.

The cushion 209 preferably covers an inner surface of the arm rest to support a chair occupant who is side- or angle-sitting in the chair.

The support 203 is adapted to be supported from another part of the chair as part of a standalone arm assembly that may be attached to the supporting frame or seat for example. In a preferred form, the support is mounted to a part 49 of the back portion that supports the back portion from another part of chair. Alternatively, the support may be part of a back portion of a chair. The support may have a hook feature 203*b* to engage with a corresponding feature on said another part of the chair.

The locking mechanism 206 comprises a locking member 213 that engages with the support 203, and an actuator. In the preferred form, the actuator is in the form of a button 215 that projects from an aperture 221*a* in the arm rest. The actuator 215 and locking member are a single integrally moulded component.

The button 215 is positioned for use by a chair occupant. The button is positioned to be substantially aligned (in one dimension) with a longitudinal axis L of the support 203, so that a user can apply force in a location substantially aligned with the longitudinal axis of the support, to minimise binding of the arm rest to the support during height adjustment of the arm rest. With that configuration, the support/arm rest need not have additional bearing features to support the sliding movement, although such bearing features 203*c* could be incorporated if desired. In the form shown, the bearing features 203*c* are C-shaped members that clip to the support 203.

The button 215 is positioned on an outer side of part of the arm rest. The button is positioned so as to be actuable by a chair occupant with a hand on the top of the cushion of the arm rest. The actuator could be any suitable other type. For example, the actuator may comprise a lever that is adapted to be pulled upward to release the locking mechanism. That enables the height of the arm rest component to readily be increased, as the same upward pulling action against the lever will additionally lift the arm rest.

The support 203 comprises a tubular portion 204, with a plurality of engagement features 217 provided in the tubular portion for engagement by the locking member to lock the arm rest. Other configurations could be used, such as a channel instead of a tube for example. At least a major part of the locking mechanism 206 including the locking member 213 is received in the tubular support 203. In the preferred form, the locking mechanism is completely concealed by the support, other than the button 215. The engagement features 217 can be any suitable type, such as recesses, apertures, or detents for example.

A clip feature 203*b* at the upper end of the support 203 engages with the tubular arm rest member 221 to prevent that from being inadvertently separated from the support.

Figure 19A:
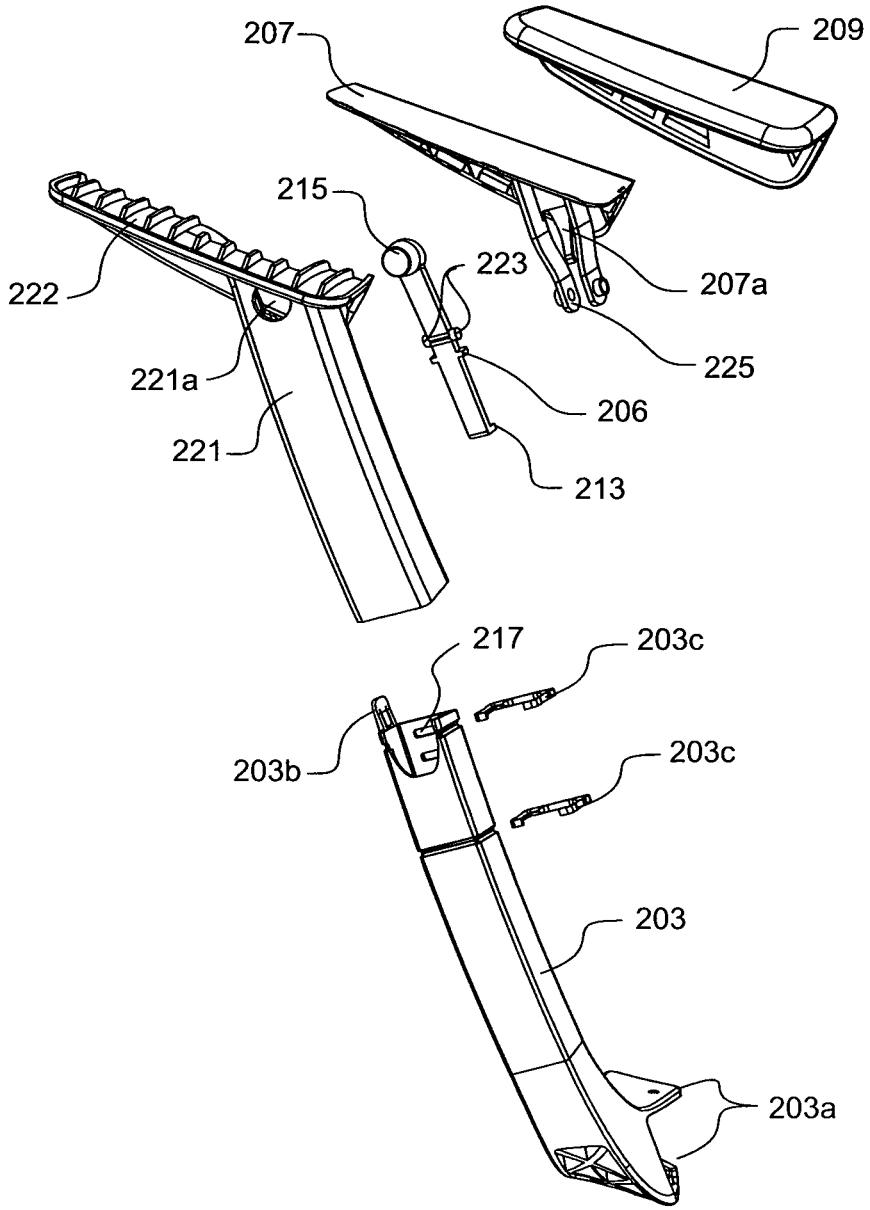
FIG. 19*a* is an exploded left rear perspective view of the arm assembly of FIG. 18*a;*
Figure 19B:
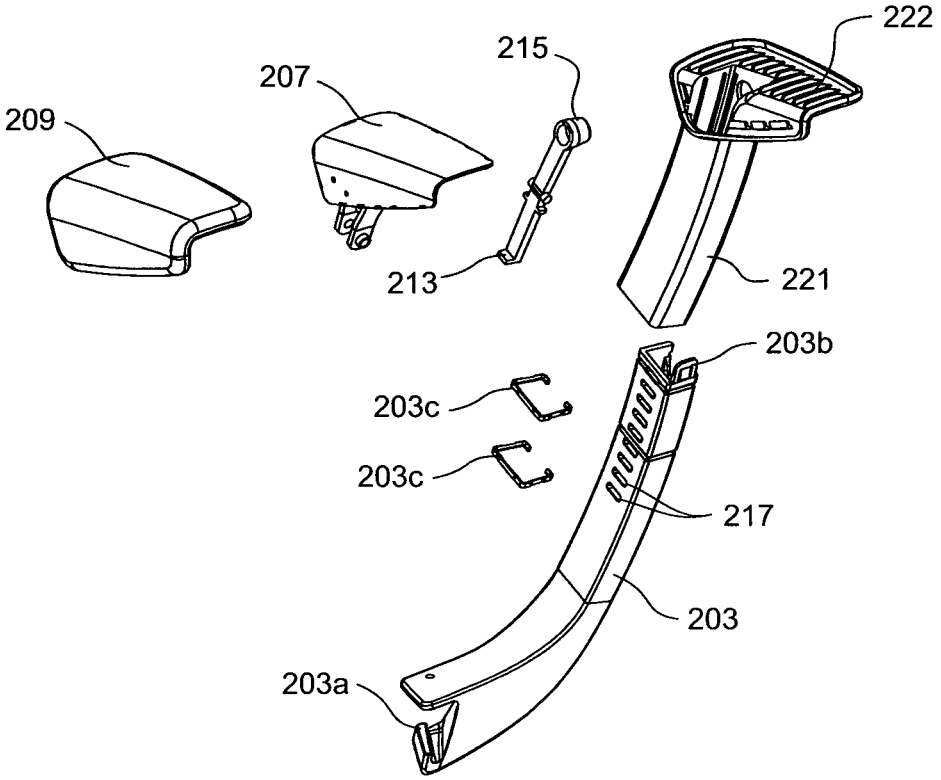
FIG. 19*b* is an exploded right front perspective view of the arm assembly of FIG. 18*a;*
Figure 20A:
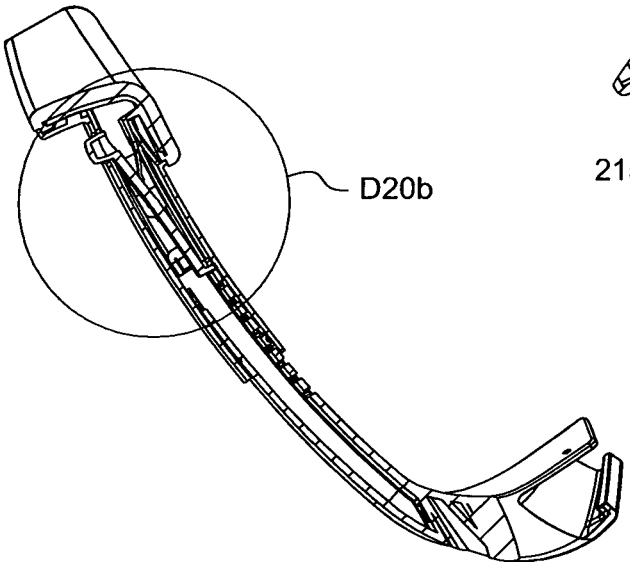
FIG. 20*a* is a rear sectional view of the arm assembly of FIG. 18*a*, showing the actuator in a released position.
Figure 20B:
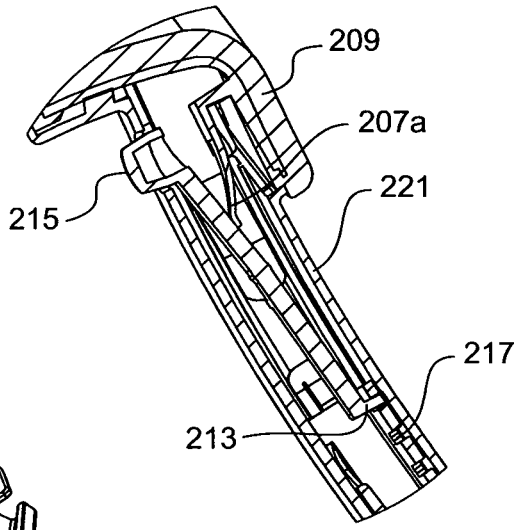
FIG. 20*b* is a rear sectional view of detail $D_2$Ob of FIG. 20*a;*
Figure 21A:
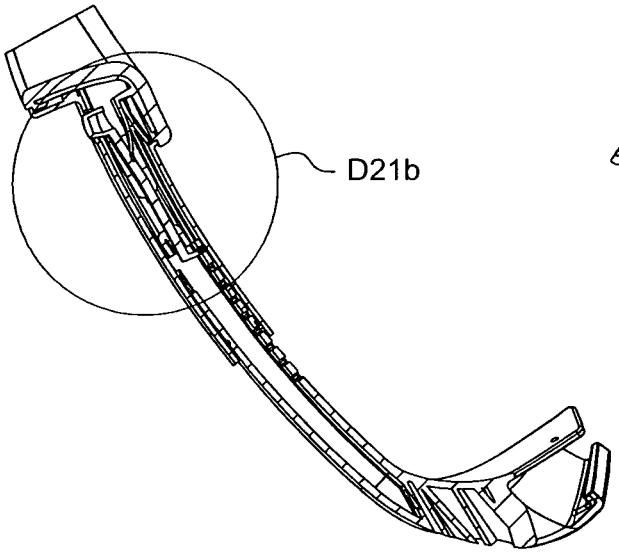
FIG. 21*a* is a rear sectional view of the arm assembly of FIG. 18*a*, showing the actuator in an actuated position.
Figure 21B:
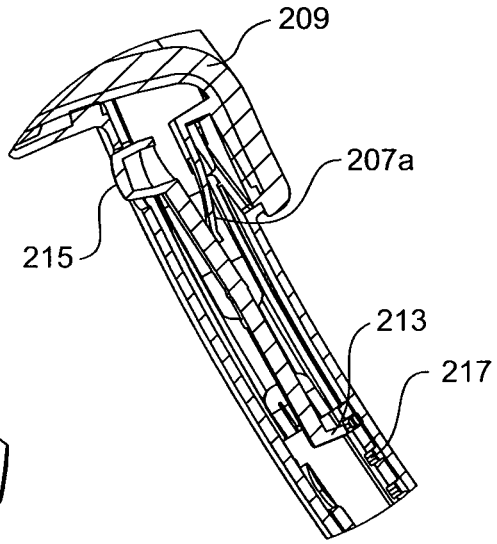
FIG. 21*b* is a rear sectional view of detail D21*b* of FIG. 21*a;*

Referring to FIG. 19*a*, the locking mechanism actuator 206 is pivotally mounted to the arm rest. The locking mechanism has projections 223 that are received by corresponding apertures 225 in substrate 207 of the arm rest. The substrate 207 can be attached to the support portion 222 in any suitable way, such as by welding, clipping, or fastening with fasteners such as screws for example.

The arm assembly further comprises a biasing device to bias the locking member 213 into engagement with the engagement features 217 of the support. The biasing device is manufactured from a recyclable polymeric material. The biasing device 207*a* is preferably integrally formed with the substrate 207. The integrally formed biasing device may be an integrally formed leaf spring, for example. Alternatively, the biasing device may be a separately formed component, such as a leaf or coil spring, that may be manufactured from a recyclable polymeric material or a recyclable metallic material, for example. The biasing device could be integrally formed with the locking member.

In a preferred embodiment, the entire arm assembly is recyclable, without separating parts of the arm assembly. At least a major part of the arm rest 205, support 203, and locking mechanism 207 are manufactured from one or more recyclable polymeric materials. In the preferred form, the entire support, arm rest, and locking mechanism are manufactured from one or more recyclable polymeric materials. The recyclable polymeric material(s) can be recycled together. The recyclable polymeric material(s) preferably comprise material(s) having a polyester base. The recyclable polymeric material(s) may comprise one or more suitable materials selected from the group comprising: polyethylene terephthalate, polybutylene terephthalate, polyester, recycled polyethylene terephthalate, recycled polybutylene terephthalate, recycled polyester, glass filled polyethylene terephthalate, and recycled glass filled polyethylene terephthalate.

The arm assembly is mountable to another part of the chair by one or more fasteners such as bolts or screws, for example. Preferably, the configuration is such that the fastener(s) can be removed to separate the arm assembly from the part of the chair, and the arm assembly can be recycled without separating parts of the arm assembly.

Alternatively, the arm rest cushion 209 may be manufactured from a material that cannot be recycled with the polymeric material(s) of the support, remainder of the arm rest, and locking mechanism. For example, the cushion could be made from any suitable material such as polyurethane, which is a self-skinning polymer. In this embodiment, the cushion would need to be removed from the remainder of the arm rest before recycling the remainder of the arm rest assembly. One suitable material for this embodiment is Hytrel foam.

By mounting the arm rest posts to the portion of the frame that supports the back from the remainder of the chair, any downward loading through the arm rest posts can be transferred directly to that portion of the back and doesn't need to be accommodated by the remainder of the back frame.

Recline Mechanism

The features of the recline mechanism are most clearly seen in FIGS. 3*a* to 3*e* and 8*a* to 8*f*. The recline mechanism is generally similar to the type described in our above-referenced PCT application, and comprises two rear deformable members 91 extending between a relatively rearward portion of a seat support 101 and a relatively rearward portion of the transom 21, thereby operatively connecting a rearward portion of the seat portion and the supporting frame. However, the recline mechanism has some features that differ from that described and shown in the above-referenced PCT application.

The mechanism further comprises two front deformable members 93 extending between a relatively forward portion of the seat support 101 and a relatively forward portion of the transom 21, thereby operatively connecting a more forward portion of the seat portion and the supporting frame. The mechanism further comprises a lower deformable member 95 connecting a lower part 49 of the back portion to the transom 21, and a puller member 97 above the lower deformable member, with the recline mechanism configured such that as the back portion of the chair is reclined, the lower deformable 95 member deforms and the puller member applies a rearward pulling action which causes the seat portion to move and the front 93 and rear 91 deformable members to deform.

The lower deformable member 95 extends rearwardly from the main transom 21 of the chair to portion 49 of the back support, thereby operatively connecting a lower part of the back portion and the supporting frame. The lower deformable member can be connected to the back support and transom by any suitable means, but is preferably connected by screws that self-tap into the polymeric material of the back frame. The lower deformable member is in the form of a panel which extends substantially the width of the main transom.

The puller member 97 extends from a rearward part of the seat support 101 to portion 49*a* of the back support, thereby operatively connecting the back portion to the seat portion. The puller member can be connected to the back support and seat support 101 by any suitable means, but is preferably connected by screws that self-tap into the polymeric materials of the back portion and seat portion.

The front 93 and rear 91 deformable members are connected to the transom 21 and seat support 101 by screws.

In the recline mechanism of the present invention, the front deformable members 93 are elongate members having a forward portion 93*a* connected to the seat support 101 and a rear portion 93*b* connected to the transom 21, and the two front deformable members extend predominantly in a forward-rearward direction of the chair but diverge from their rear portions 93*b* to their forward portions 93*a* such that their forward portions 93*a* are spaced further apart than their rear portions 93*b*. By having the front deformable members diverging as shown, they twist as the seat portion is lifted during recline of the back portion. That provides greater stiffness in the front deformable members than if they extended only in a forward-rearward direction.

Preferably, the angle between a forward/rearward centreline of the chair and each front deformable member (when looking down in plan view) is between about 10 degrees and about 30 degrees, more preferably between about 20 degrees and about 30 degrees, more preferably about 26 degrees. That is, the included angle between the front deformable members may be between about 20 degrees and about 60 degrees, more preferably between about 40 and about 60 degrees, more preferably about 52 degrees.

The rear flexing members 91 also diverge, but to a lesser extent than the front deformable members.

The pulling action caused by the puller 97 causes the seat portion 13 to lift and move rearwardly. The puller member is preferably also deformable, although that is not essential. Because at least a major part—namely at least the rearward part—of the seat portion lifts and moves rearwardly as the back portion is reclined, the occupant's weight compensates the reclining action of the back portion. Accordingly, as the rearward force is removed from the back portion, the occupant's weight will cause the back portion to return to the upright position.

The front and rear deformable members may increase in angle by between about 15 and about 16 degrees (measured between the mounting points at each end of the deformable members) as the back portion is reclined.

The features of the recline mechanism may otherwise be of the type described in our above-referenced PCT application.

The transom 21 is provided with two stops 103 to at least partly support the weight of the seated occupant on the seat portion 13 via the supporting frame when the back portion is not being reclined. In a similar manner to the front deformable members, the stops 103 are elongate members having a forward portion to support the seat portion and a rear portion operatively connected to the supporting frame (via the transom 21), and the stops extend predominantly in a forward-rearward direction of the chair but diverge from their rear portions to their forward portions. As can be seen from FIG. 8*e*, the stops are preferably integrally formed as part of the transom 21, and are suitably substantially rigid. Alternatively, the stops could be separate components connected to the transom.

The stops 103 have a convex curvature relative to a position beneath the stops.

The stops 103 are positioned adjacent the front deformable members, and in the form shown are positioned inwardly of the front deformable members 93. Alternatively, the stops could be provided outwardly of the front deformable members 93.

The configuration of the stops directs loading from a seated occupant toward the height adjustment pedestal 17, which is received in cavity 21*a* of the transom.

The transom 21 also includes two additional stops 104 that are formed by the upper surfaces of upright wall portions of the transom. The additional stops 104 support a more rearward part of the seat support 101, and thereby a more rearward part of the seat portion 13, when the back portion of the chair is not being reclined.

The stops could be formed in any other suitable configuration, such as a single continuous surface for example.

Upright wall portions 21*b* extend across the back of the transom, and are integrally formed therewith. The upright wall portions 21*b* support a rear part 96 of the Hytrel over-moulding that incorporates the rear deformable members 91, the forward deformable members 93, and the bottom deformable member 95. Within the over-moulding, forward deformable members 93 are connected to rear deformable members 91 by separator components 94, that comprise generally horizontal portion 94*a* and generally vertical portion 94*b*.

The upright wall portions 21*b* also cooperate with part of the back portion, to define maximum recline position of the back portion. In the form shown (FIG. 22), a forward portion of the back portion immediately below region 49*a* comprises an engagement face, that engages with the upright wall portions 21*b* to define the maximum recline position of the back portion.

Figure 3C:
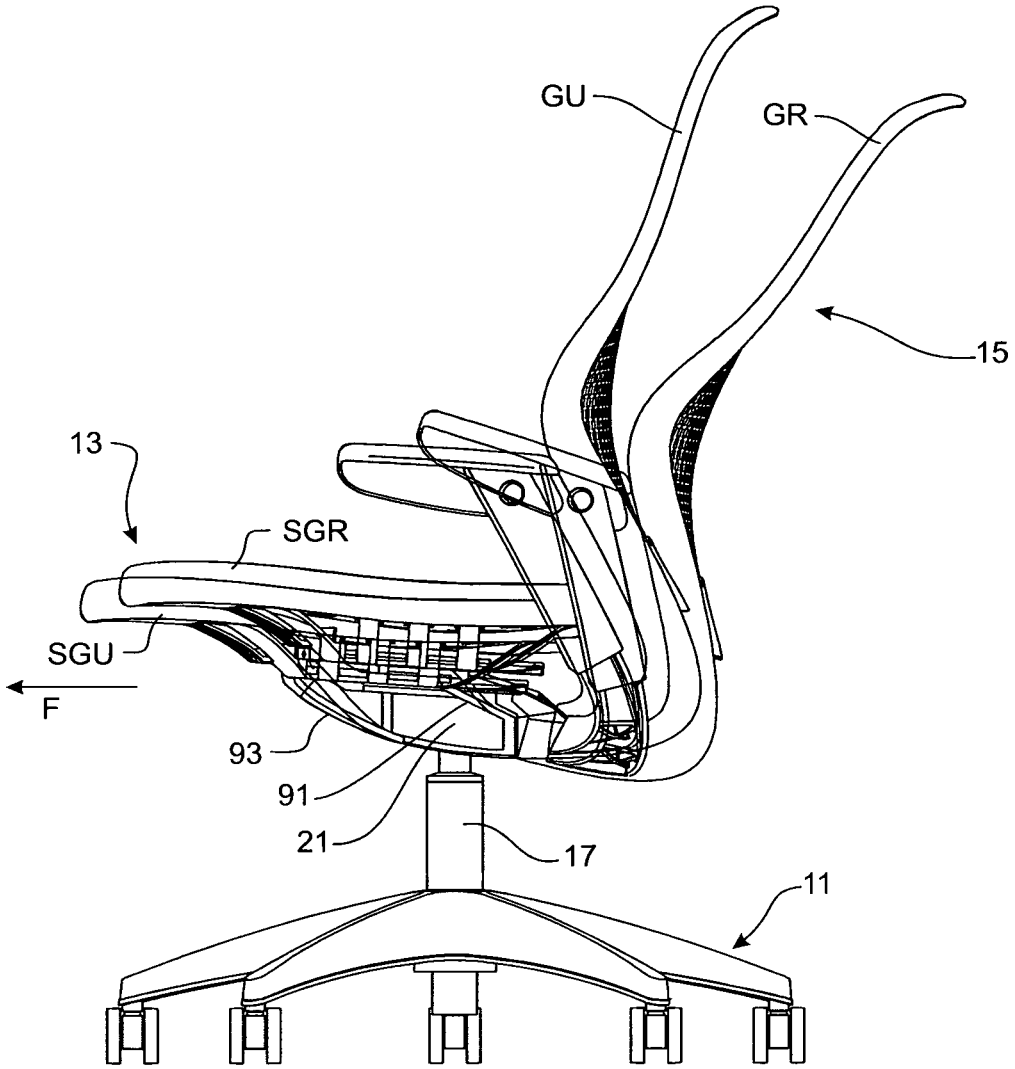
FIG. 3*c* is a left side view of the chair of FIG. 1 with the back portion positions of FIGS. 3*a* and 3*b* overlaid onto one another, to show the relative positions.
Figure 3D:
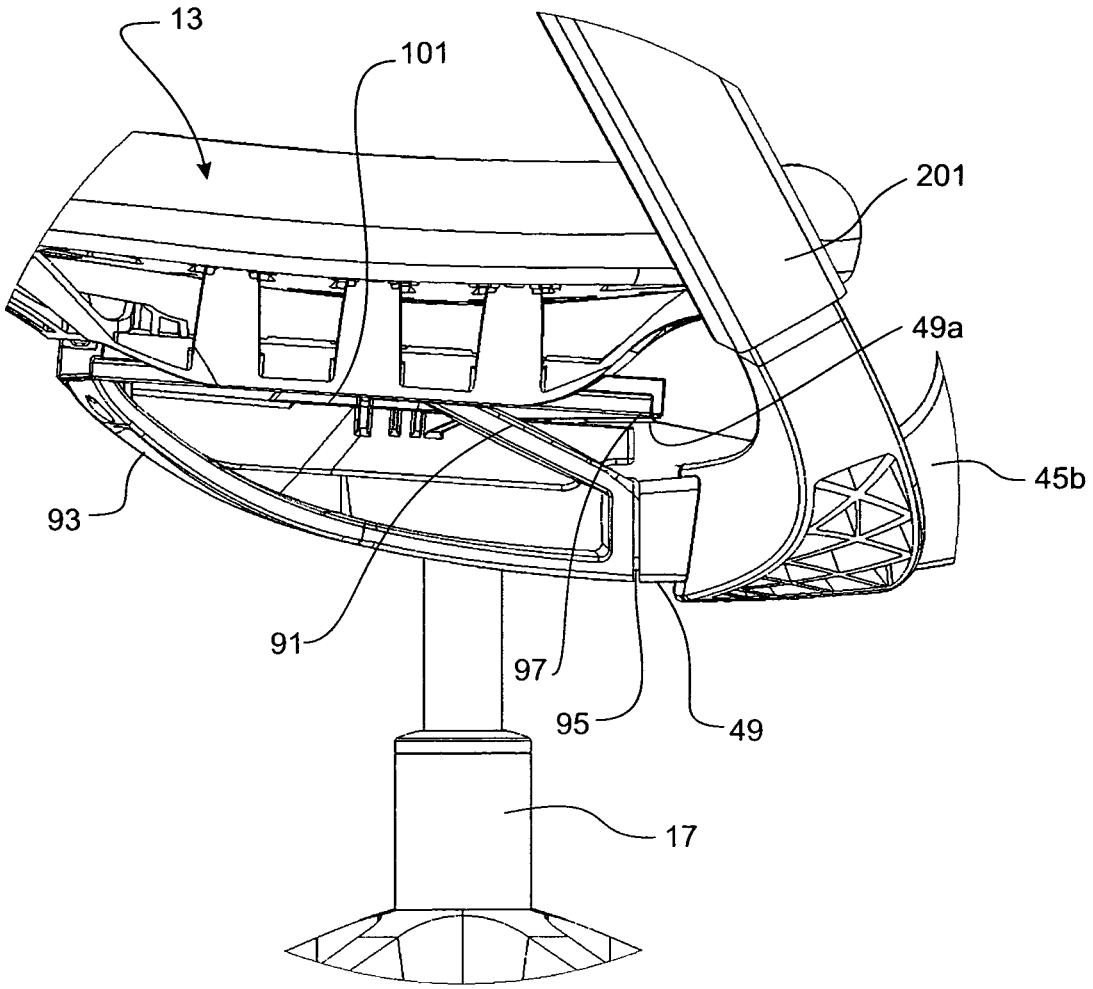
FIG. 3*d* is a detailed left side view showing part of the recline mechanism when the back portion is in the generally upright position.
Figure 3E:
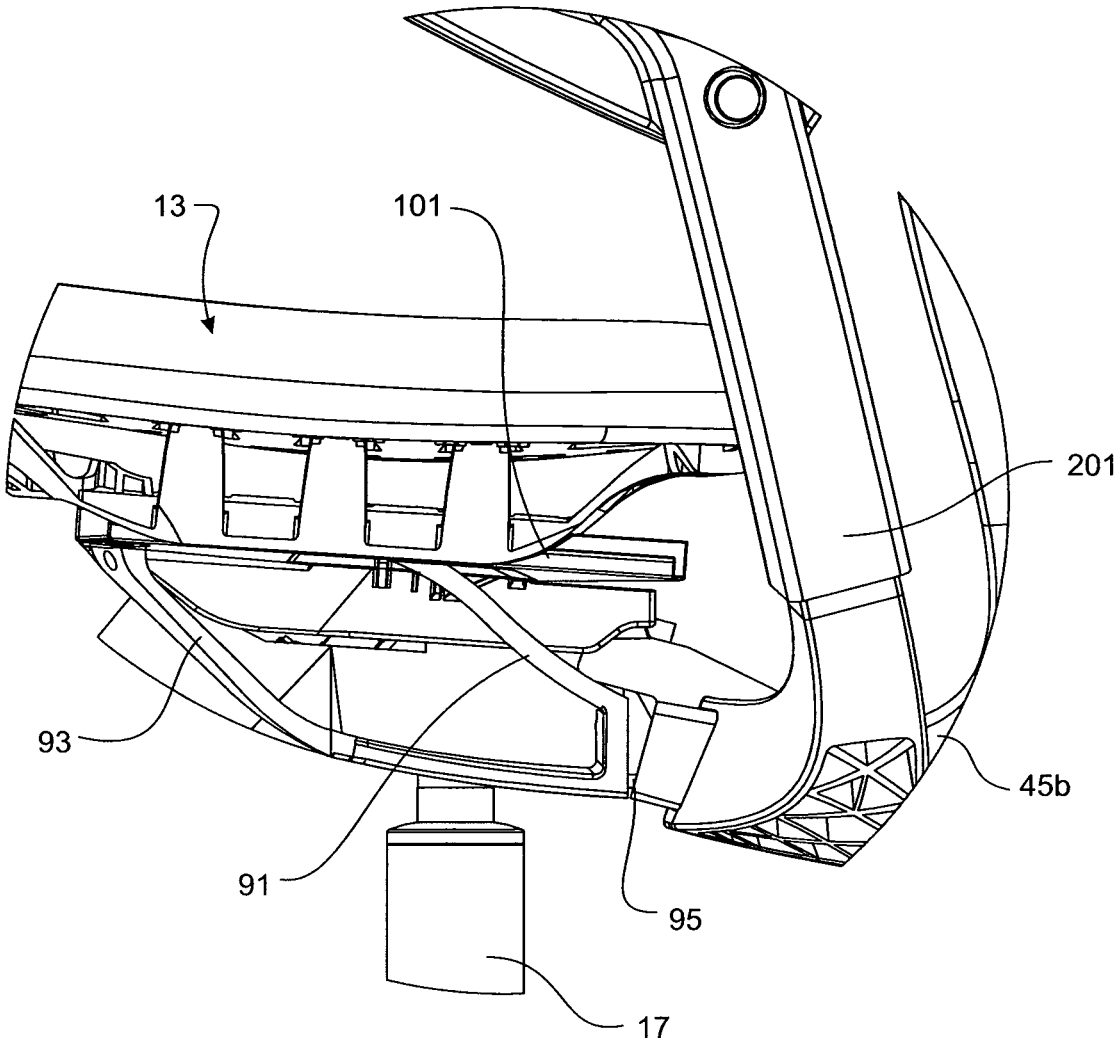
FIG. 3*e* is a detailed left side view showing part of the recline mechanism when the back portion is in the generally reclined position.
Figure 4:
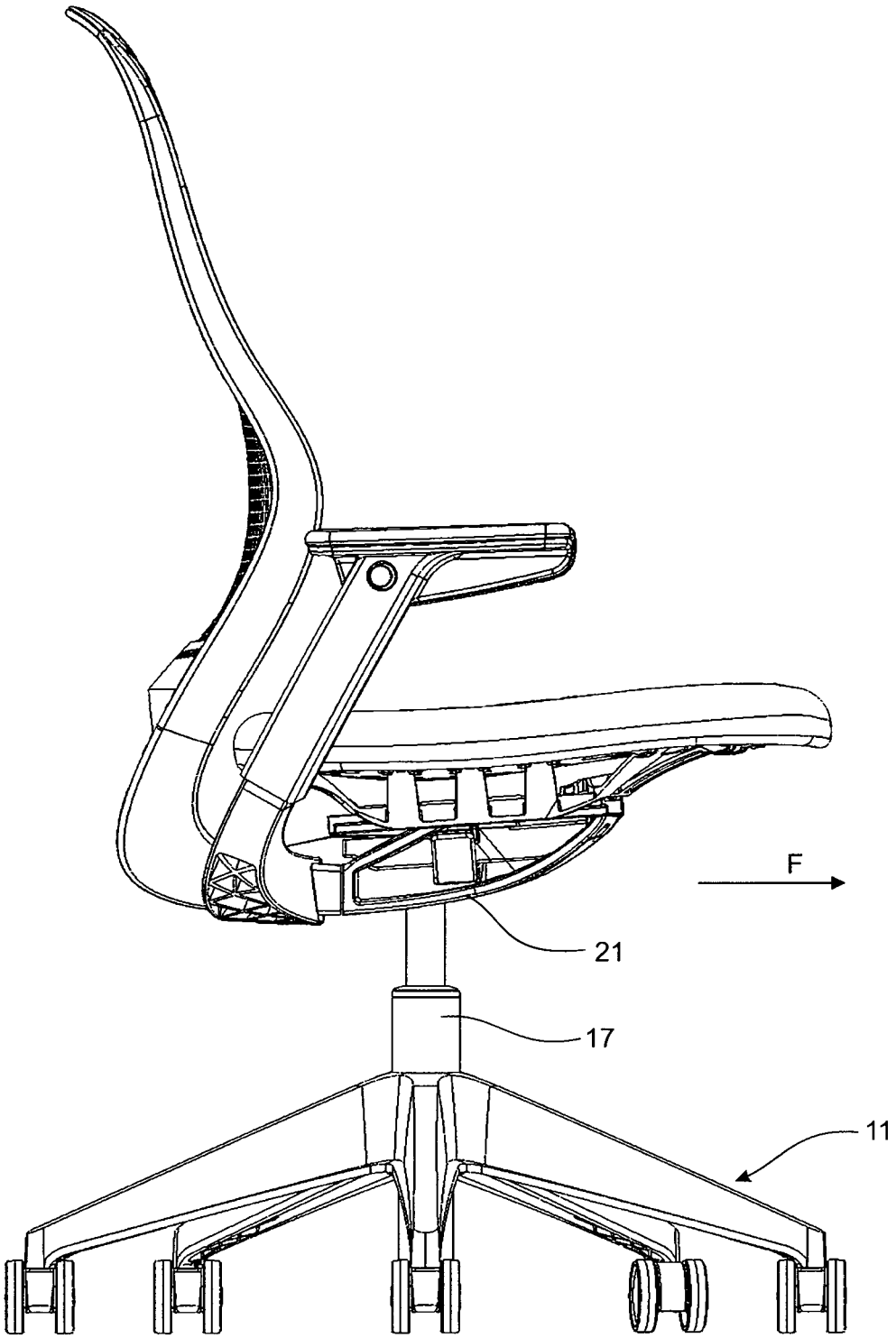
FIG. 4 is a right side view of the chair of FIG. 1.
Figure 5:
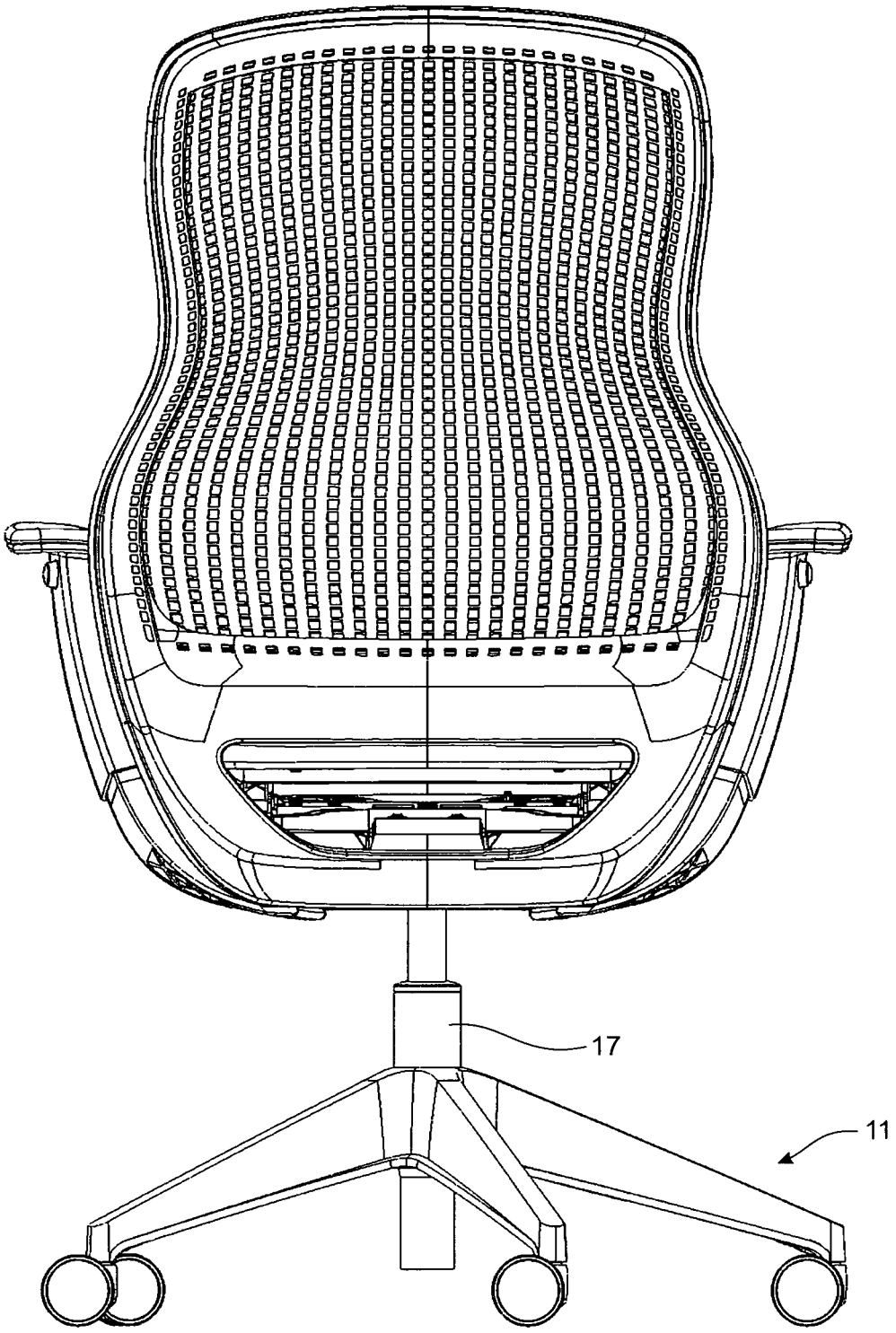
FIG. 5 is a rear view of the chair of FIG. 1.
Figure 6:
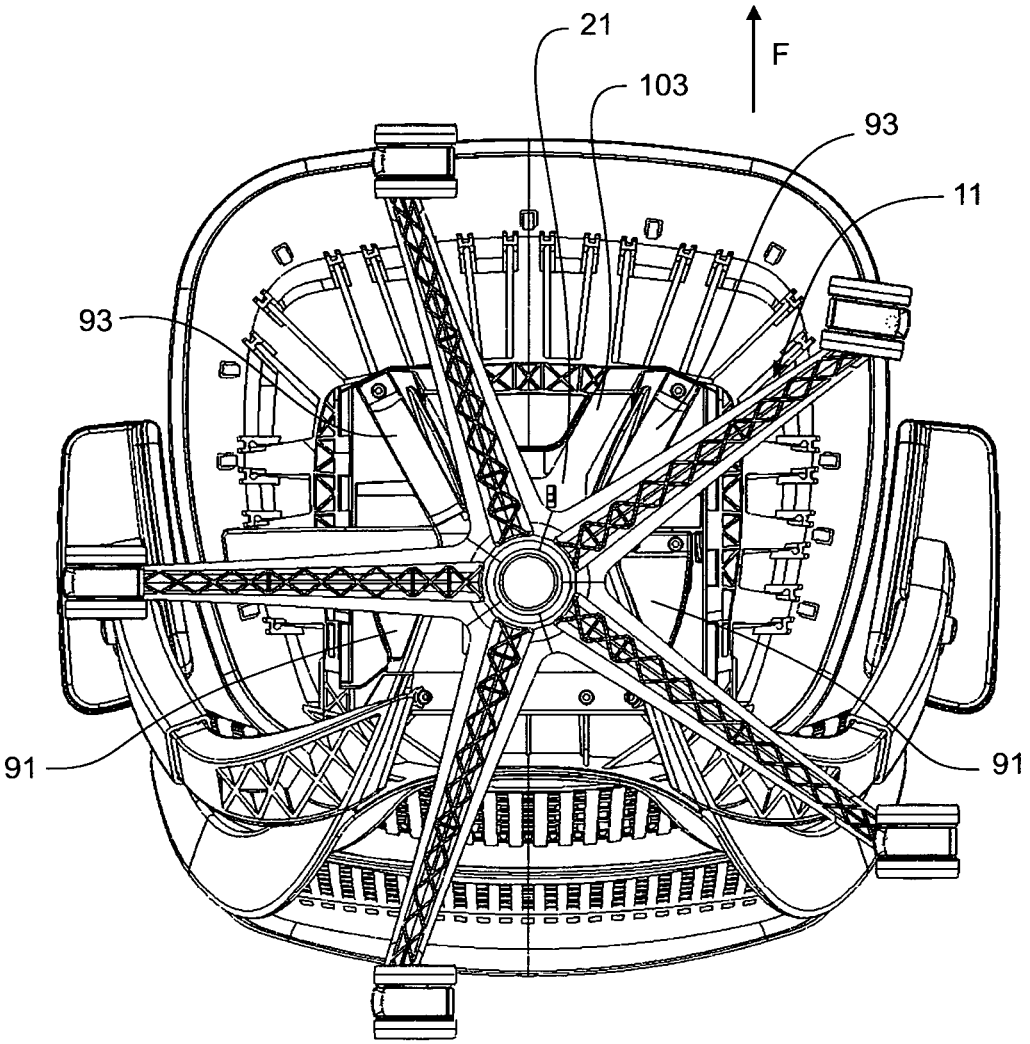
FIG. 6 is an underside view of the chair of FIG. 1.
Figure 7:
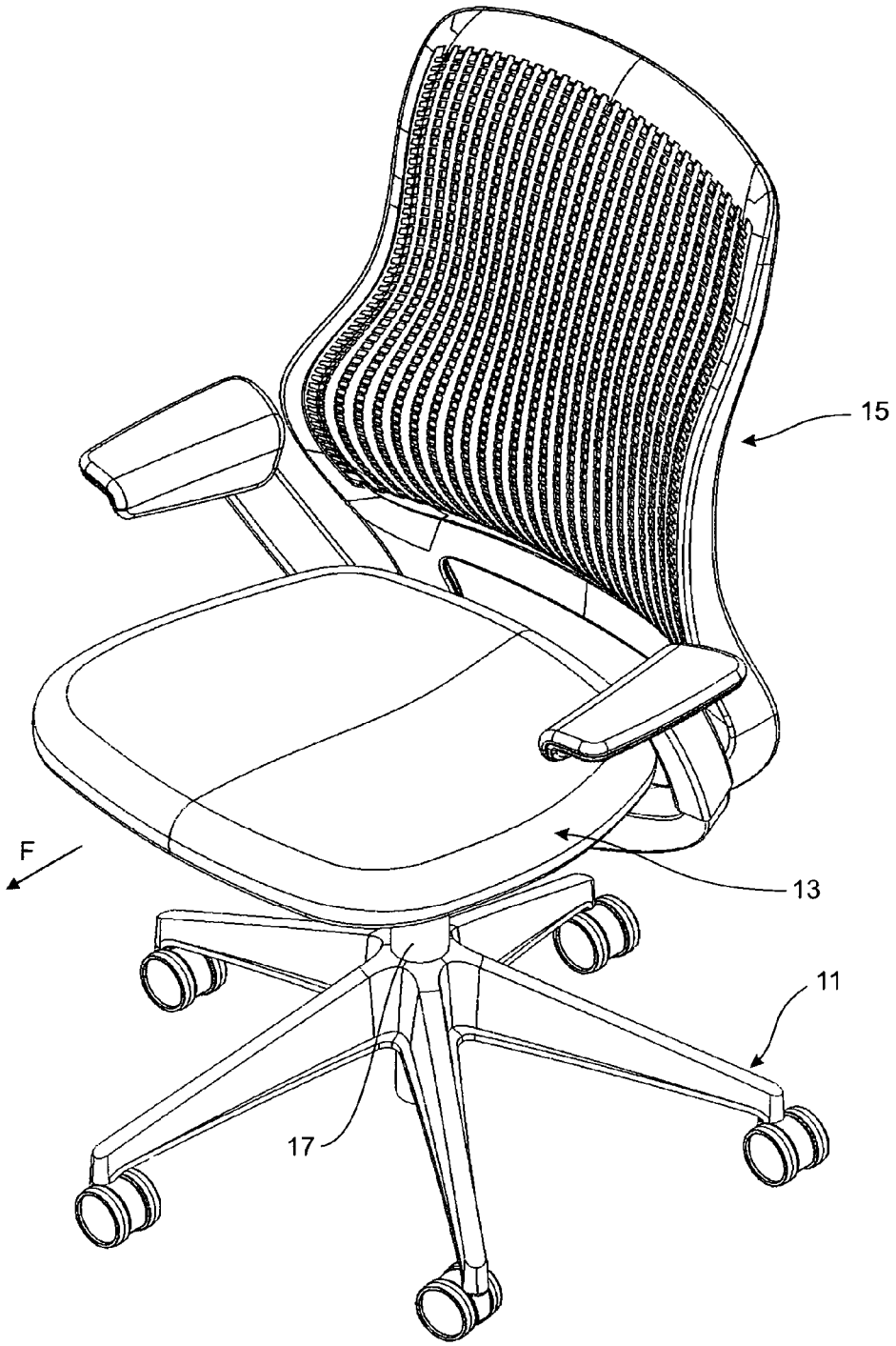
FIG. 7 is a perspective view of the chair of FIG. 1.

As can be seen in FIG. 3*e*, the front deformable members and the rear deformable member(s) are configured to deform into a generally sinuous shape as the back portion of the chair is reclined.

It will be appreciated that this recline mechanism can be incorporated into a chair that does not have a depth adjustable seat portion.

By using deformable members in the recline mechanism, the mechanism can be tuned to obtain a desirable reclining action. For example, the deformable members can be formed to provide variable resistance throughout the reclining action—such as greater resistance toward the reclined position for example. Further, the members can be formed to provide a seat movement with or without a change in seat angle, and with or without an arcuate movement, depending on the action required.

Recline Resistance Mechanism

The recline mechanism preferably incorporates a recline resistance mechanism 301. A preferred form is shown in FIGS. 8*a* to 17*b*. The recline resistance mechanism is indicated generally by reference numeral 301. As described above, the back portion is reclinable relative to the supporting frame between a generally upright position GU and a generally reclined GR position. FIG. 3*c* shows those positions. FIG. 3*c* also shows the position of the seat when the back portion is in the upright position (and is labelled as SGU), and the seat when the back portion is in the reclined position (and is labelled SGR).

The recline resistance mechanism 301 assists with maintaining the back portion in the generally upright position by providing a resistance force. In the embodiment shown, the recline-resistance mechanism is provided between the seat support 101 of the seat portion 13 and the transom 21 of the supporting frame.

Figure 10A:
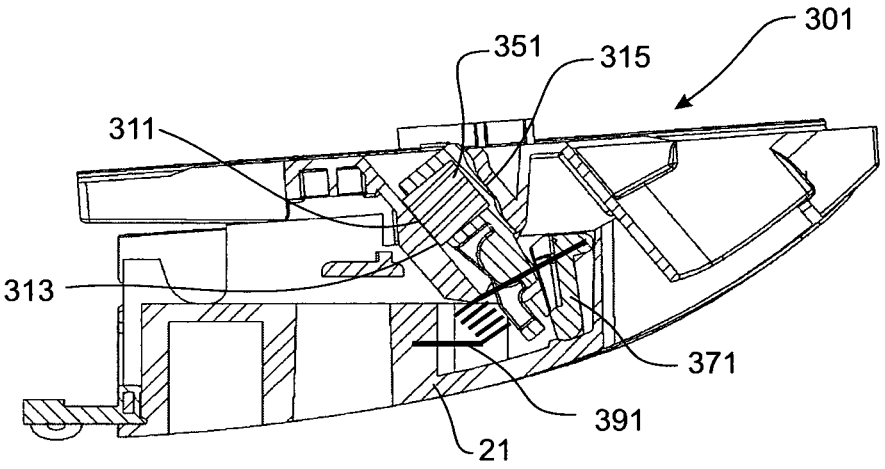
FIG. 10*a* is a right side sectional view showing the components of the recline resistance mechanism when the chair back portion is in the upright configuration and when the engagement member is disengaged from the shuttle.

As shown in FIG. 10*a*, the recline resistance mechanism comprises a recess 311 in a first chair component—in this case in the seat support 101.

Figure 10B:
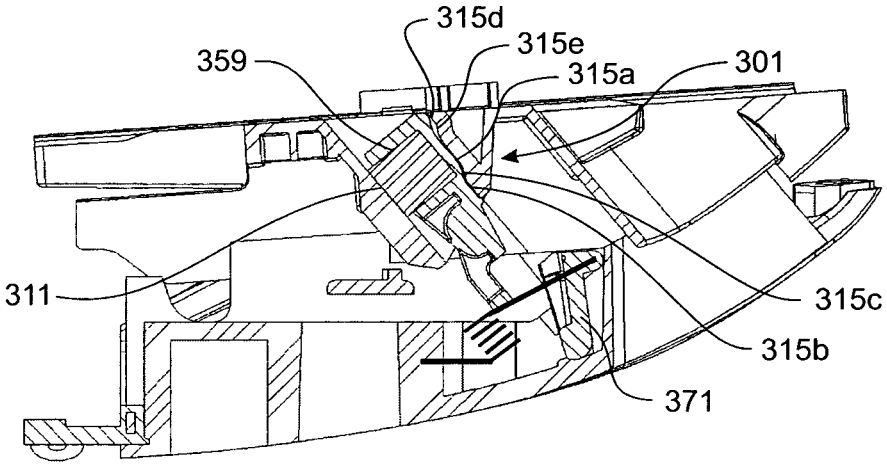
FIG. 10*b* is a right side sectional view similar to FIG. 10*a*, but showing the components of the recline resistance mechanism when the chair back portion is moved toward the generally reclined position.
Figure 10C:
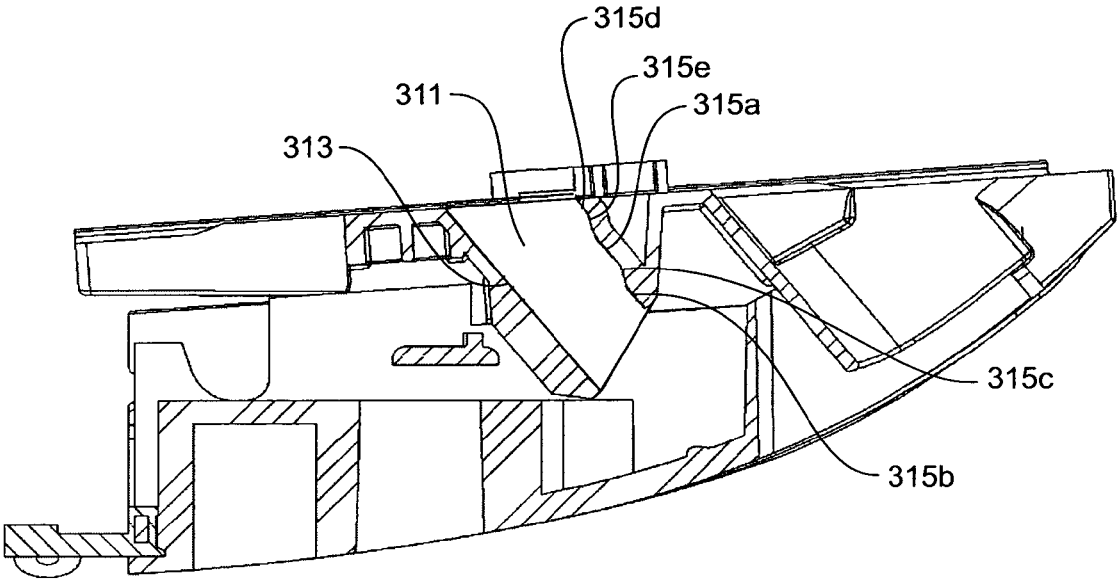
FIG. 10*c* is a view similar to FIG. 10*a*, but showing only the features of the recess for clarity.

As shown in FIG. 10*c*, the recess 311 has a first surface provided by a wall 313, and a second opposed surface provided by a wall 315. In the form shown, the first surface 313 is planar, and the opposed surface 315 is stepped.

The recess opposed surface has a first portion having a relatively large dimension between a first wall 315*a* and the first surface 313, a second portion having a relatively small dimension between a second wall 315*b* and the first surface 313, and a transition surface 315*c* between the first wall 315*a* and the second wall 315*b*. The first wall 315*a* and second wall 315*b* are preferably substantially parallel to the opposed first surface 313. The transition surface 315*c* form a first engagement surface of the recess, that engages with a corresponding first engagement surface on the shuttle, as will be described below.

The recess has a third portion of a relatively larger dimension than the first portion and second portion of the recess, the third portion being formed between a third wall 315*d* and the first surface 313. The first portion of the recess is positioned between the second portion and third portion of the recess. A transition surface 315*e* is positioned between the third wall 315*d* and the first wall 315*a*. The third wall 315*d* is preferably substantially parallel to the opposed first surface 313. The transition surface 315*e* forms a second engagement surface of the recess, that engages with a corresponding second engagement surface on the shuttle, as will be described below.

The first engagement surface 315*c* and second engagement surface 315*e* of the recess can be of any suitable shape and configuration. In a preferred form, the first and second engagement surfaces of the recess comprise arcuate surfaces. As an alternative, the first and second engagement surfaces of the recess could comprise relatively sharp steps.

The recess can be in any suitable form. For example, the sides of the recess could be closed or open, as could the upper end of the recess. The recess could be in the form of a channel having one open side, or could be substantially tubular having no open sides.

A shuttle 351 is slidably engaged with the recess 311 in the seat support 101. At least part of the shuttle is resilient and configured such that as the shuttle slides through at least part of the recess, said at least part of the shuttle is compressed. Friction between the shuttle and the recess resist movement of the shuttle in the recess.

In the form shown (FIG. 17*a*, 17*b*), the shuttle comprises a body 353 that may be injection moulded from a suitable relatively rigid polymeric material, such as Nylon for example. The shuttle body comprises a first engagement surface 355*a* and a second engagement surface 355*b*, which engage with the first engagement surface 315*c* and second engagement surface 315*e* respectively of the recess, when the shuttle slides in the recess.

The first engagement surface 355*a* and second engagement surface 355*b* of the shuttle can be of any suitable shape and configuration. Preferably, the first and second engagement surfaces of the shuttle comprise arcuate surfaces. As an alternative, the first and second engagement surfaces of the shuttle could comprise relatively sharp steps.

The shuttle comprises a resilient member 357 in the form of a block that is housed at least partly within a body portion the shuttle. As can be seen in FIG. 10*b* for example the resilient member is mounted in a recess 359 of the housing, and part of the resilient member 357 projects from the body portion of the shuttle to contact the first surface 313 of the recess. The resilient member 357 contacts the first surface 313 of the recess to provide frictional contact therebetween. In an alternative embodiment, a suitable frictional surface may be attached to the resilient member, with at least part of the frictional surface projecting from the body 353 of the shuttle and contacting the surface 313 of the recess to provide frictional contact therebetween.

The resilient member can be made from any suitable material, such as rubber or polyurethane for example. In an alternative, the resilient member could comprise a spring member, such as a compression spring or leaf spring for example, with a frictional pad attached to the spring. In that alternative, the spring could comprise a suitable polymeric material such as acetyl or nylon for example, or could comprise a metallic material. It is preferred that the part of the shuttle comprising the engagement surface(s) 355*a*, 355*b* is substantially rigid, to prevent or minimise deformation of the engagement surfaces.

However, in an alternative embodiment, substantially the entire shuttle could be resilient.

An engaging member 371 is operatively connected to a second chair component—in this case to the transom 21. The engaging member 371 is actuable to selectively operatively engage the shuttle 351 or to selectively release the shuttle 351. When the engaging member 371 is selectively operatively engaged with the shuttle as shown in FIG. 11*a* for example, movement between the shuttle 351 and the transom 21 is restrained, so that upon movement of the back portion of the chair toward the generally reclined position GR, the shuttle 351 is caused to slide S in the recess 311, with friction between the resilient member 357 of the shuttle and the surface 313 of the recess applying a resistance against movement of the back portion toward the generally reclined GR position.

When the engaging member 371 is released from the shuttle 351, the recline resistance mechanism applies no resistance against movement of the back portion toward the generally reclined GR position. When the engaging member 371 is disengaged from the shuttle 351, the shuttle does not slide in the recess as the back portion of the chair is reclined, as shown in FIG. 10*b*. The shuttle 351 is free to move with the seat support 101, and is not restrained by the engaging member.

Figure 16B:
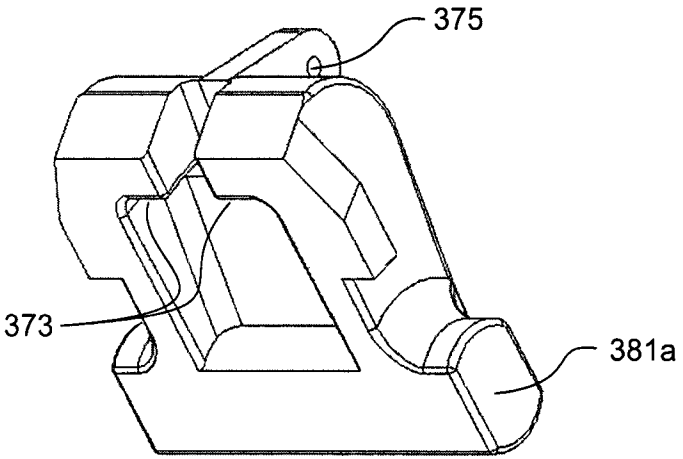
FIG. 16*b* is a rear overhead perspective view of the shuttle of the recline resistance mechanism.
Figure 16A:
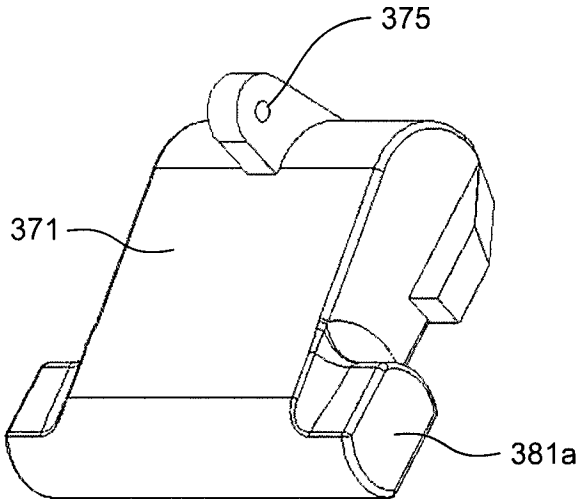
FIG. 16*a* is a front underside perspective view of the shuttle of the recline resistance mechanism.
Figure 16C:
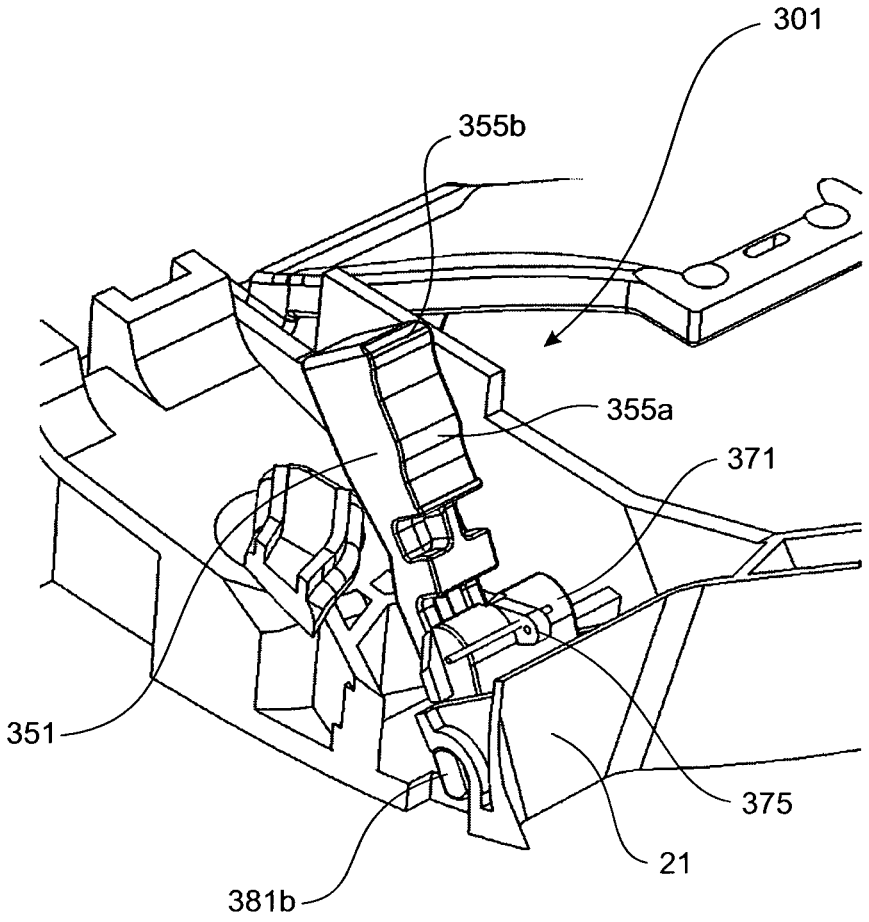
FIG. 16*c* is a front overhead perspective sectional view showing the articulated mounting of the shuttle to the transom.
Figure 17B:
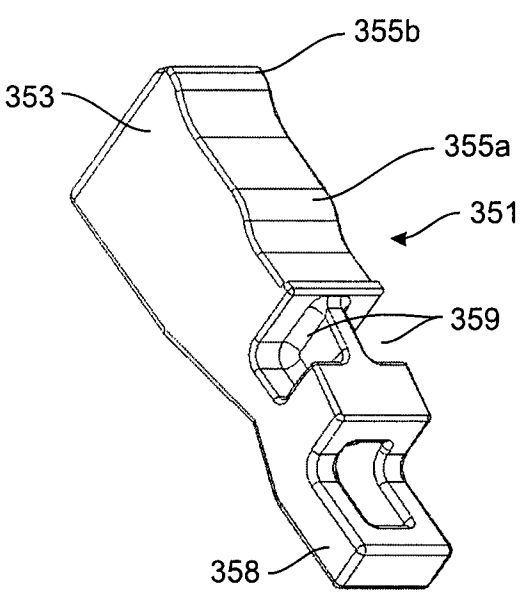
FIG. 17*b* is a front overhead right side perspective view of the shuttle of the recline resistance mechanism.
Figure 17A:
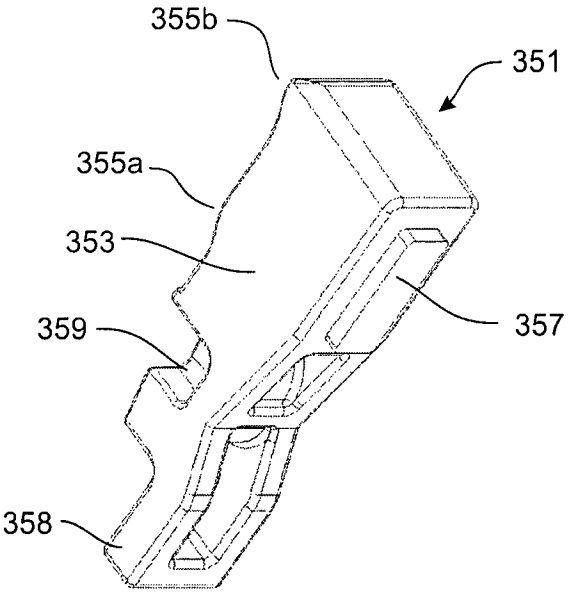
FIG. 17*a* is a rear overhead left side perspective view of the shuttle of the recline resistance mechanism.
Figure 18A:
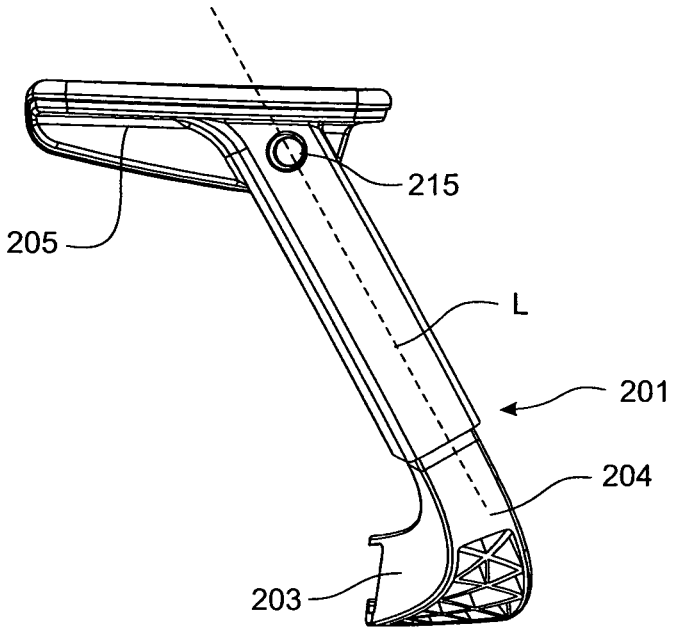
FIG. 18*a* is a side elevation view of a preferred form height adjustable arm assembly for use in the chair of FIG. 1, showing the arm rest in a lowered position.
Figure 18B:
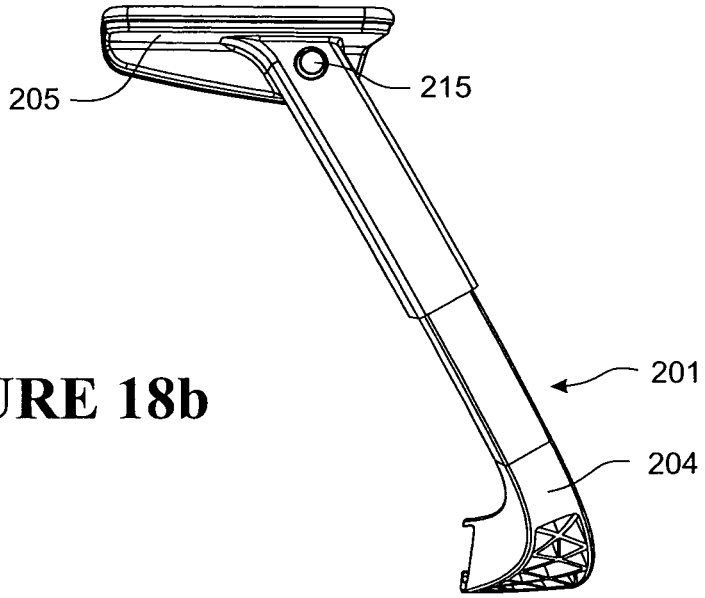
FIG. 18*b* is a side elevation view of the arm assembly of FIG. 18*a*, showing the arm rest in a raised position.

As shown in FIGS. 16*a* to 16*c*, the engaging member 371 is pivoted to the transom 21 via pivot features 381*a*, 381*b*.

The engaging member 371 and the shuttle 351 comprise complementary engagement features. In the form shown in FIGS. 16*b* and 17*b*, the engagement features comprise respective hook features 373, 359, but any other suitable configuration could be used.

The chair comprises an actuator 1201 that enables a user to engage or disengage the recline resistance mechanism. The actuator 1201 is operatively connected to the engaging member 371 by an overload protection device as will be described below. The actuator 1201 is movable between an engaging position corresponding to an engaged position of the engaging member and the shuttle (shown in FIG. 11*a*), and a disengaging position corresponding to the disengaged position of the engaging member and the shuttle (shown in FIG. 10*a*).

The chair comprises a single actuator 1201 for actuating the recline resistance mechanism 301 and a height adjust mechanism 17 of the chair. The single actuator comprises a lever positioned generally beneath a seating surface of the chair. The lever is pivotable about a first axis to control the height adjust mechanism and is pivotable about a second axis to control the recline resistance mechanism. As shown in FIG. 15*b*, movement of the lever 1201 in direction A will actuate the recline resistance mechanism.

Figure 15A:
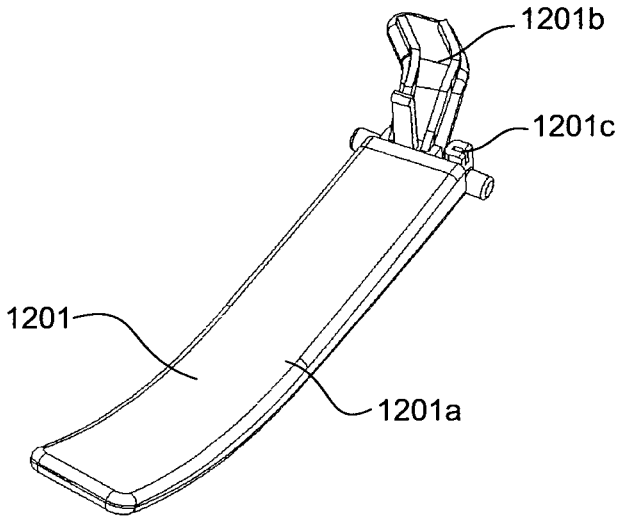
FIG. 15*a* is an overhead perspective view of an actuator lever for the height adjustment mechanism and the recline resistance mechanism.
Figure 15B:
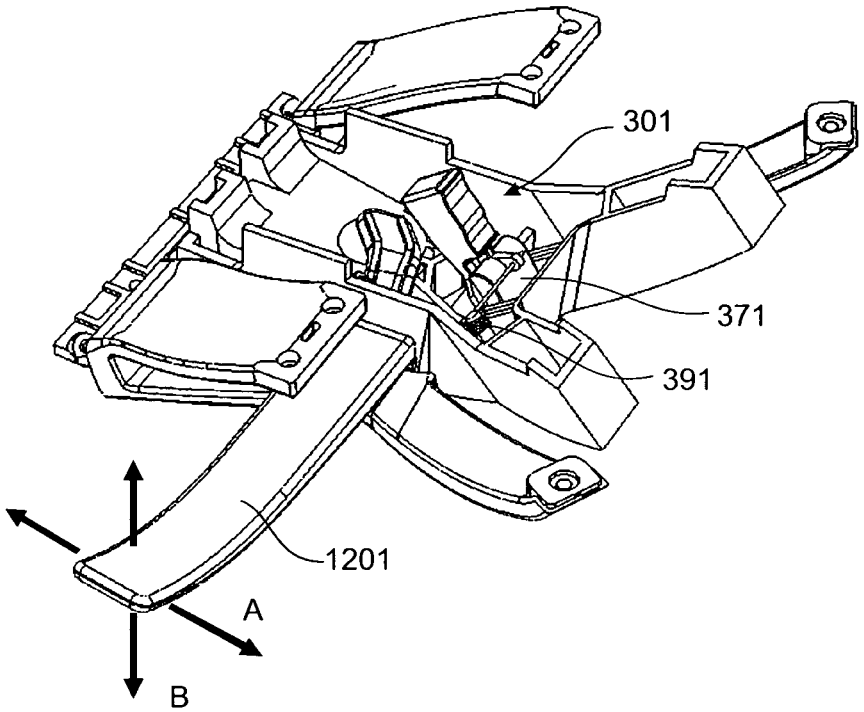
FIG. 15*b* is an overhead perspective view showing the possible movement directions of the actuator lever.

Referring to FIG. 15*a*, the lever 1201 has a paddle portion 1201*a* for receiving an occupant's fingers, and an actuating portion 1201*b* for actuating the height adjust mechanism. When the paddle portion is lifted (direction B in FIG. 15*b*), the lever moves about a generally horizontal axis and the actuating portion 1201*b* pushes down on a release member of the height adjust mechanism, to enable the height of the seat portion to be adjusted.

Figure 9A:
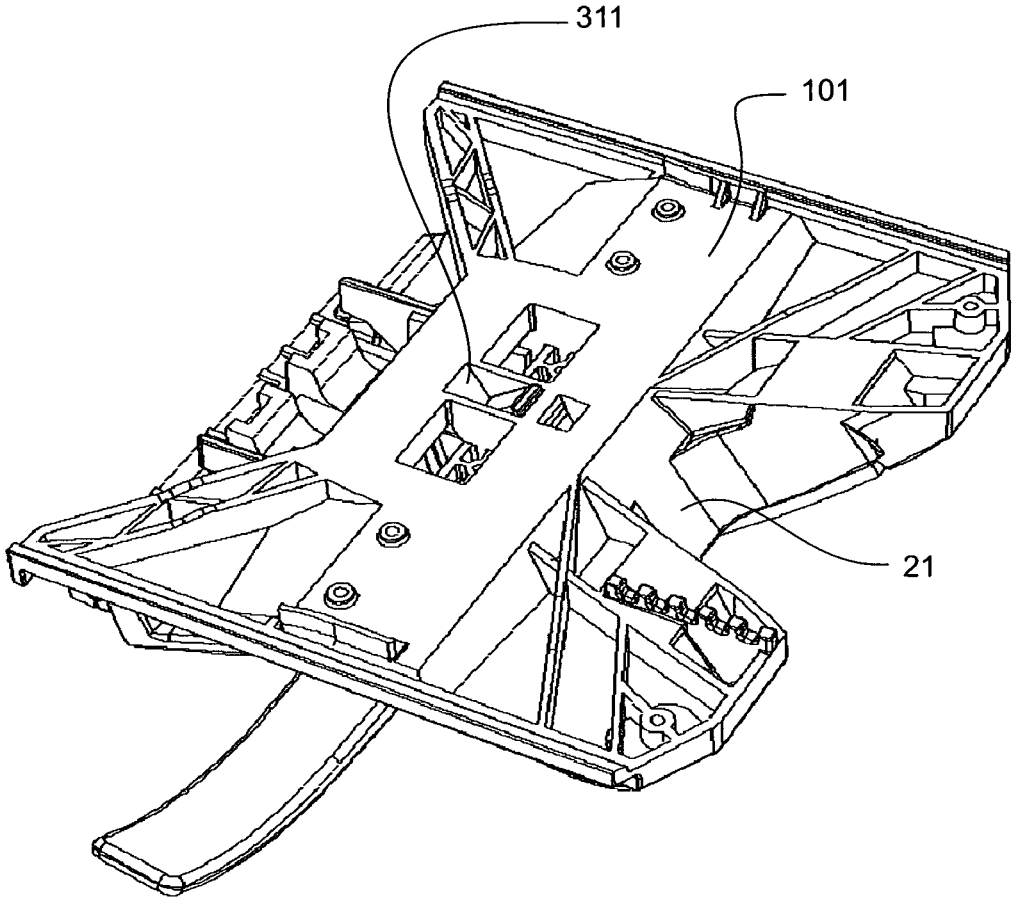
FIG. 9*a* is a perspective view of a seat support of the chair of FIG. 1.
Figure 9C:
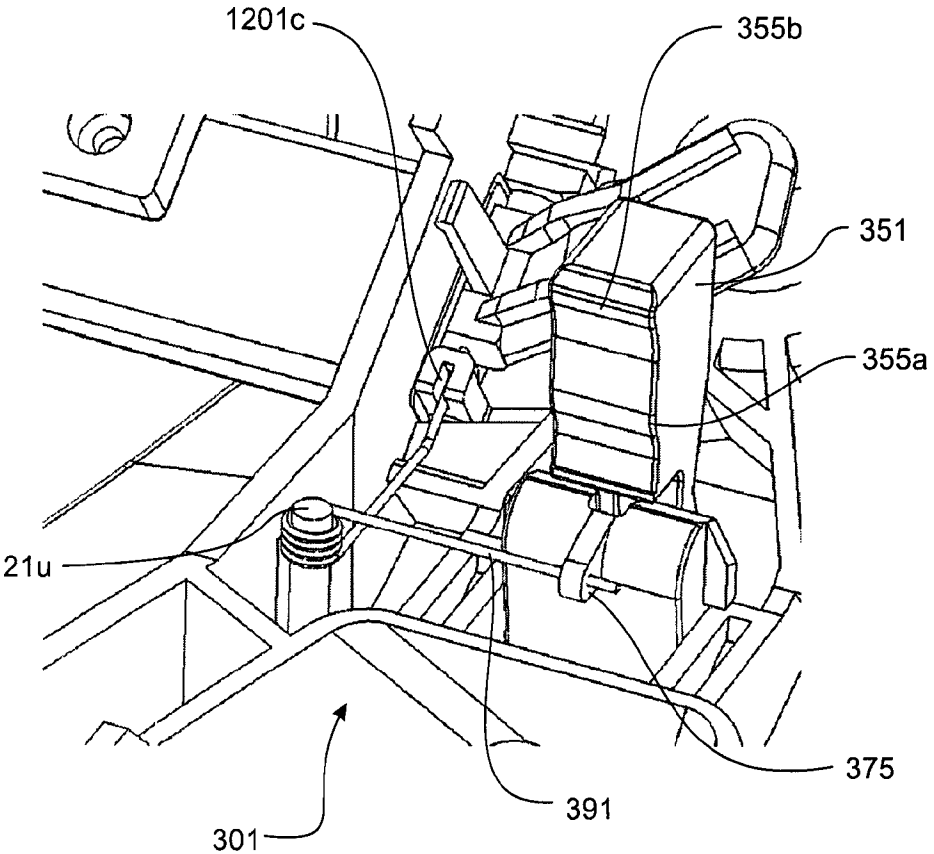
FIG. 9*c* is a front perspective view of part of the recline resistance mechanism of FIG. 9*b;*
Figure 9B:
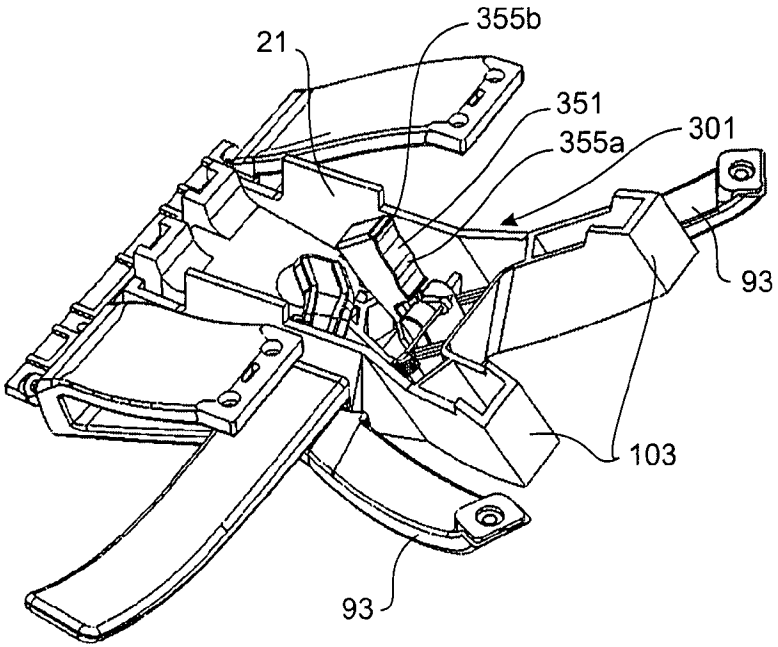
FIG. 9*b* is a perspective view showing a first preferred form of recline resistance mechanism that can be used in the chair of FIG. 1, when the chair back portion is in an upright configuration, and with the seat support not shown for clarity.

The lever 1201 further has a second actuating portion 1201*c* for receiving the end of a member that operatively connects the lever to the engaging member 371. In the form shown, that member comprises a torsion spring 391. One end of the torsion spring 391 is received in the actuating portion 1201*c* of the lever, and the other end of the torsion spring is received in an aperture 375 in the engaging member 371. A body of the torsion spring 391 is mounted on an upstand 21*u* in the transom, as shown in FIG. 9*c*.

When the lever 1201 is moved about a generally vertical axis and in direction A in FIG. 15*b*, the second actuating portion 1201*c* moves an end of the torsion spring 391. The movement in direction A is preferably indexed.

The lever is preferably provided as two separable components. To mount the lever 1201 to the transom 21*a*, the portion of the lever 1201*b* is positioned within the transom. That portion carries the two horizontally extending projections that can be seen in FIG. 15*a* between portion 1201*a* and 1201*b*. The transom comprises a cavity for receipt of the projections. The portion 1201*a* can then be inserted through an aperture in the transom and connected to portion 1201*b*. The two horizontal projections on the lever define a horizontal axis for the lever. One of the horizontal projections will be a relatively tight fit in the cavity in the transom. The other horizontal projection will be a relatively loose fit, which provides the movement about a vertical axis. Detents will be provided in the transom to index movement of the projection that is a relatively loose fit.

The upstand between the two portions of the lever that is visible in FIG. 15*a* acts against the transom to bias the lever into a released position in which it does not actuate the height adjust mechanism.

Any other suitable type of actuator could be used.

When the engaging member 371 is selectively operatively engaged with the shuttle 351, the recline resistance mechanism resists movement of the back portion of the chair from the generally upright position GU toward the generally reclined position GR, as well as from the reclined position GR toward the generally upright position GU, due to friction between the shuttle and recess.

FIG. 10*a* shows the engaging member 371 in a disengaged position. As the back portion of the chair is reclined, the shuttle 351 is not restrained by the engaging member 371 and therefore the shuttle 351 is not caused to slide in the recess 311 as the back portion of the chair is reclined to the generally reclined position represented by FIG. 10*b*.

Figure 11:
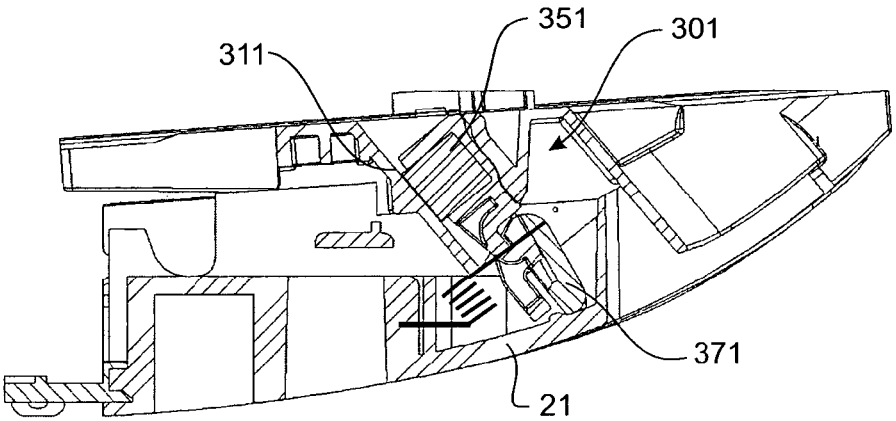
FIG. 11 is a right side sectional view showing the components of the recline resistance mechanism when the chair back portion is in an upright configuration and when the engagement member is engaged with the shuttle.

FIG. 11 shows the engagement member 371 is engaged with the shuttle 351. That figure represents the back portion being in the generally upright position GU. In that figure, the shuttle is positioned at an upper portion of the recess. FIG. 12*c* shows the recline resistance mechanism when the back portion of the chair is in the generally reclined position GR. It can be seen that the shuttle 351 has been pulled downwardly within the recess, as a result of the engaging member 371 restraining movement of the shuttle 351 away from the transom 21.

Figure 12A:
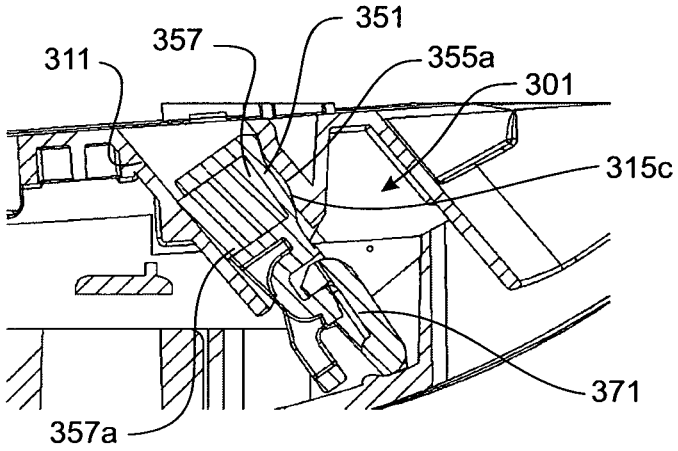
FIG. 12*a* is a right side sectional view showing the movement of the shuttle in the recess in the seat slide, upon initial recline of the back portion from the upright position.
Figure 12B:
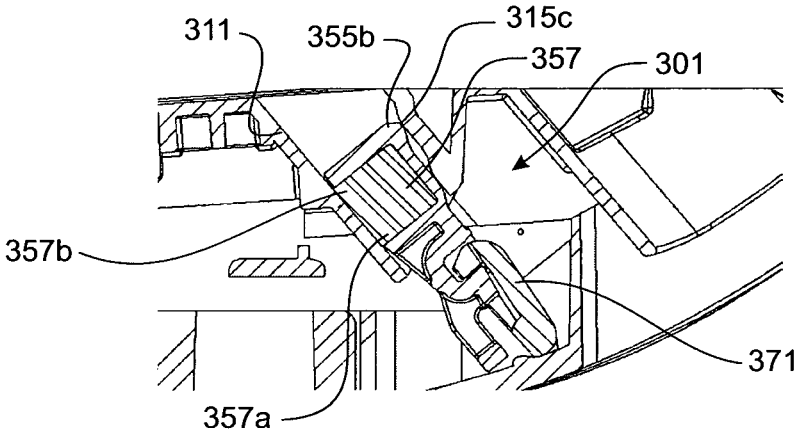
FIG. 12*b* is a right side sectional view similar to FIG. 12*a*, after the shuttle has moved further upon further recline of the back portion.
Figure 12C:
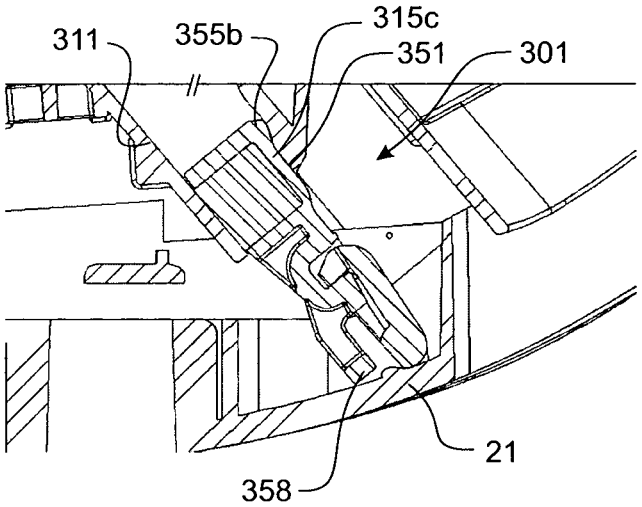
FIG. 12*c* is a right side sectional view similar to FIG. 12*b*, after the back portion has been reclined to the reclined position.

FIGS. 12*a*-12*c* show the staged movement of the shuttle 351 in the recess 311. FIG. 12*a* shows the recline resistance mechanism upon initial recline of the back portion from the generally upright position GU toward the generally reclined position GR. As the first engagement surface of the shuttle 355*a* engages with the first engagement surface 315*c* of the recess upon initial recline of the back portion toward the generally reclined position GR, the first engagement surfaces 315*c*, 355*a* cause a first portion 357*a* of the resilient member 357 to be compressed. The frictional force between the member 357 of the shuttle 351 and the first surface 313 of the recess 311 increases due to compression of that first part 357*a* of the member.

As the second engagement surface 355*b* of the shuttle engages with the second engagement surface 315*e* of the recess upon further recline of the back portion toward the generally reclined position GR, the second engagement surfaces 335*b*, 315*e* cause a second portion 357*b* of the resilient member 357 to be compressed, as shown in FIG. 12*b*. The frictional force between the shuttle and the recess increases further due to that further compression of the resilient member 351.

As shown in FIGS. 12*b* and 12*c*, the first portion 357*a* of the resilient member remains compressed when the second portion 357*b* is compressed. Therefore, the total amount of compression of the resilient member is greater, and thereby the frictional force between the shuttle 351 and the recess 311 is greater, when the second portion 357*b* of said at least part of the shuttle is also compressed than when only the first portion 357*a* of said at least part of the shuttle is compressed. In the preferred configuration, the frictional force that must be overcome to move the shuttle 351 in the recess 311 is between about 1177 Newtons (about 120 kg) and about 1471 Newtons (about 150 kg), when the first 357*a* and second portions 357*b* of said at least part of the shuttle is compressed. In the preferred configuration, the force applied by said at least part of the shuttle 353, in a direction perpendicular to the direction of travel of the shuttle in the recess, is between about 3922 Newtons (about 400 kg) and about 4413 Newtons (about 450 kg), when the first 357*a* and second portions 357*b* of said at least part of the shuttle is compressed.

As shown in FIG. 12*c*, upon further movement of the back portion toward the generally reclined position GR, the second engagement surface 355*b* of the shuttle slides along the first wall 315*a* of the recess. Throughout that movement, the resilient member 357 remains fully compressed, with the maximum frictional force being applied between the shuttle 351 and the recess 311. The second engagement surface 355*b* of the shuttle is in contact with the first wall 315*a* of the recess, throughout the majority of the movement of the back portion of the chair toward the generally relined position. The engagement of the first engagement surface of the shuttle with the first engagement surface of the recess, and of the second engagement surface of the shuttle with the second engagement surface of the recess, occurs during only the initial movement of the back portion from the generally upright position GU toward the generally reclined position GR.

The generally reclined position GR of the chair is determined by stop(s) in the chair, rather than by movement of the shuttle in the recess. Therefore, the chair stop(s) will prevent further recline of the back portion before the second engagement surface 355*b* of the shuttle contacts the first engagement surface 315*c* of the recess.

As shown in FIG. 12*c*, a projection 358 at the base of the shuttle engages on the transom 21, to cause the shuttle to slide upwardly in the recess as the back portion is moved from the generally reclined position GR back to the generally upright position GU. Again, there will be frictional restraint caused by the resilient member 357 sliding on the first surface 313 of the recess, as the recline resistance mechanism returns to the position shown in FIG. 10*a*.

Rather than having two engagement surfaces in the recess and on the shuttle, single engagement surfaces could be provided. However, two engagement surfaces are preferred, as they provide a smoother action of the recline resistance mechanism.

The shuttle and recess may be configured as shown, such that the first engagement surfaces cause a leading portion of the resilient member to be compressed, in the direction of sliding movement of the shuttle in the recess upon recline of the back portion. However, in an alternative embodiment, a trailing portion of the resilient member could be compressed before the leading portion.

The torsion spring 391 acts as an overload protection device.

Figure 14A:
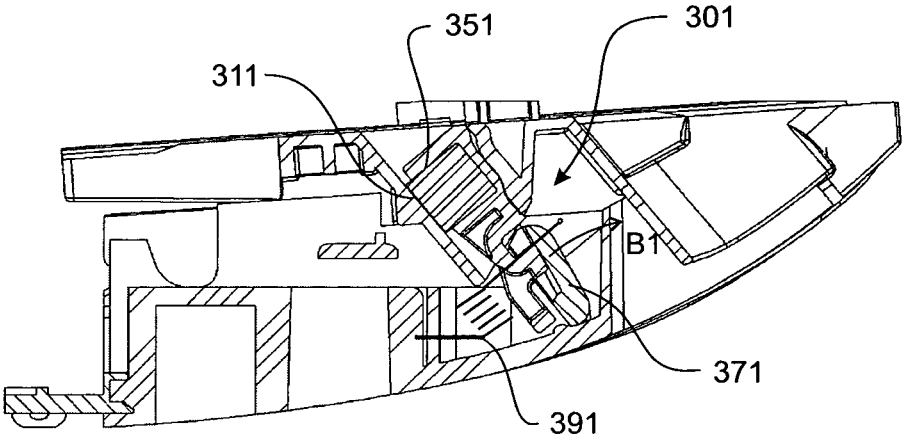
FIG. 14*a* is a right side sectional view similar to FIG. 13*a*, but showing the engagement member biased into a disengaging position when the back portion of the chair is reclined.
Figure 14B:
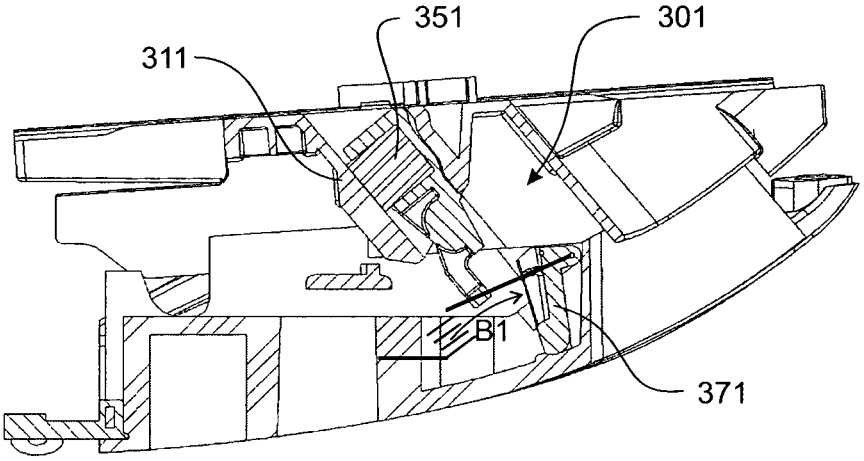
FIG. 14*b* is a right side sectional view similar to FIG. 14*a*, but showing the engagement member having disengaged from the shuttle when the back portion of the chair has been returned to the upright position.

Due to interference between the hook features 373, 359 on the engaging member 371 and the shuttle 351, the engaging member 371 can only be disengaged from the shuttle 351 when the back portion of the chair is in the generally upright GU configuration and is substantially unloaded. As shown in FIG. 14*a*, the overload protection device 391 is configured to bias the engaging member toward a disengaged position from the shuttle when the actuator is in the disengaging position. That biasing is represented by arrow B1 in FIG. 14*a*. However, it is not until the back portion returns to the generally upright configuration GU and is substantially unloaded, that the biasing B1 will disengage the engaging member 371 from the shuttle 351.

Figure 13A:
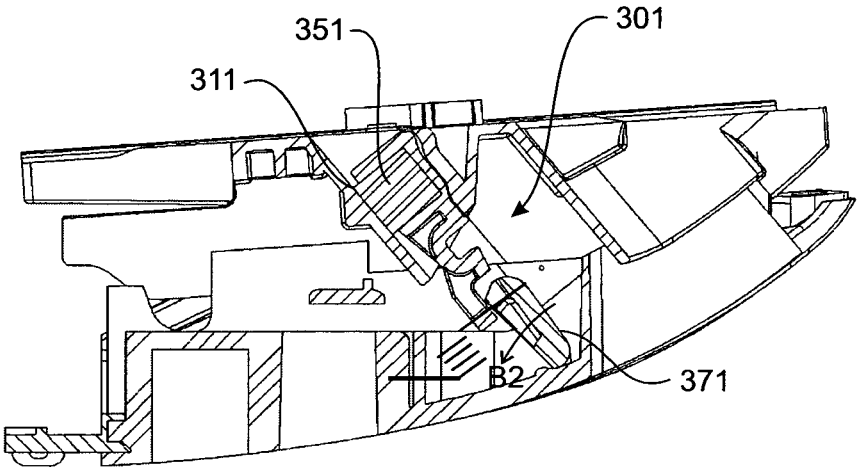
FIG. 13*a* is a right side sectional view similar to FIG. 12*a*, but showing the engagement member biased into an engaging position when the back portion of the chair is reclined.
Figure 13B:
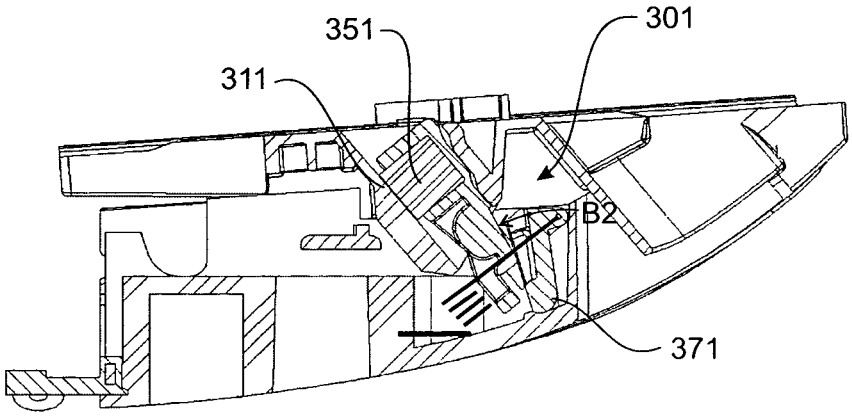
FIG. 13*b* is a right side sectional view similar to FIG. 13*a*, but showing the engagement member biased into an engaging position when the back portion of the chair is further reclined.

The engaging member 371 can only be engaged with the shuttle 351 when the back portion is in the generally upright configuration GU and is substantially unloaded. As shown in FIGS. 13*a* and 13*b*, the overload protection device 391 is configured to bias the engaging member 371 toward an engaged position with the shuttle 351 when the actuator is in the engaging position. That biasing is represented by arrow B2 in FIG. 13*a*. However, it is not until the back portion returns to the generally upright configuration GU and is substantially unloaded, that the biasing B2 will engage the engaging member 371 with the shuttle 351. When the back portion returns to the generally upright position GU and is substantially unloaded, the engaging member will engage with the shuttle (as shown in FIG. 11*a*).

The overload protection device could be any other suitable form, such as a different type of biasing device, or a different type. Rather than direct connection between the torsion spring and the actuator and engaging member, one or more flexible elongate members, such as cables, could connect the torsion spring to the actuator and the engaging member.

In the form shown, the recess and shuttle are provided in the seat support 101, and the engaging member 371 is mounted to the transom. The seat support represents a first chair component, and the transom represents a second chair component.

The first and second chair components can be any suitable components, provided the first and second chair components move relative to each other upon reclining of the back portion. For example, one of the components may be a supporting frame of the chair, and the other component may be any component that is adapted to move upon recline of the back portion toward the generally reclined position, such as a seat portion, seat support, or the back portion for example.

The configuration shown in this preferred embodiment could be reversed, with the recess and shuttle being provided in the transom and the engaging member mounted to the seat support.

In an embodiment of chair having a reclinable back portion but which does not move the seat portion upon recline of the back portion, said first chair component may be one of the supporting frame and the back portion, and said second chair component may be the other of the supporting frame and the back portion.

The recline resistance mechanism could be used in a chair having a different type of recline mechanism to that described herein.

Castored Base

Referring to FIGS. 43 to 48, the chair includes a castored base 11. The castored base has a body with a central portion 1003 and a plurality of legs 1005 extending radially outwardly therefrom. The castored base comprises five legs extending from the central portion. The central portion provides support for a height adjustment spring 17. Each leg has an end 1007 proximal the central portion 1003, an end 1009 distal the central portion 1003. A castor 1010 (FIG. 3*a*) is operatively supported for rotation at or adjacent the distal end of each leg. Each leg has an upper surface 1011 and a lower surface 1013.

Each leg additionally has a flange 1015 positioned near a lower portion 1006 of the leg. In the preferred embodiment shown, each leg 1005 has two flanges 1015 that form part of the lower surface 1013 of the castored base, and that extend transversely outwardly from a base of a respective side wall of the leg. The flanges extend outwardly from the leg and extend substantially the entire length of the distance of the leg between the proximal end and the distal end.

Figure 46:
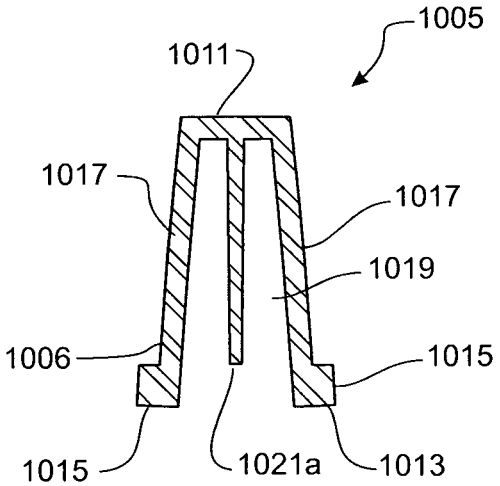
FIG. 46 is a section view along line 46-46 of FIG. 45.
Figure 47:
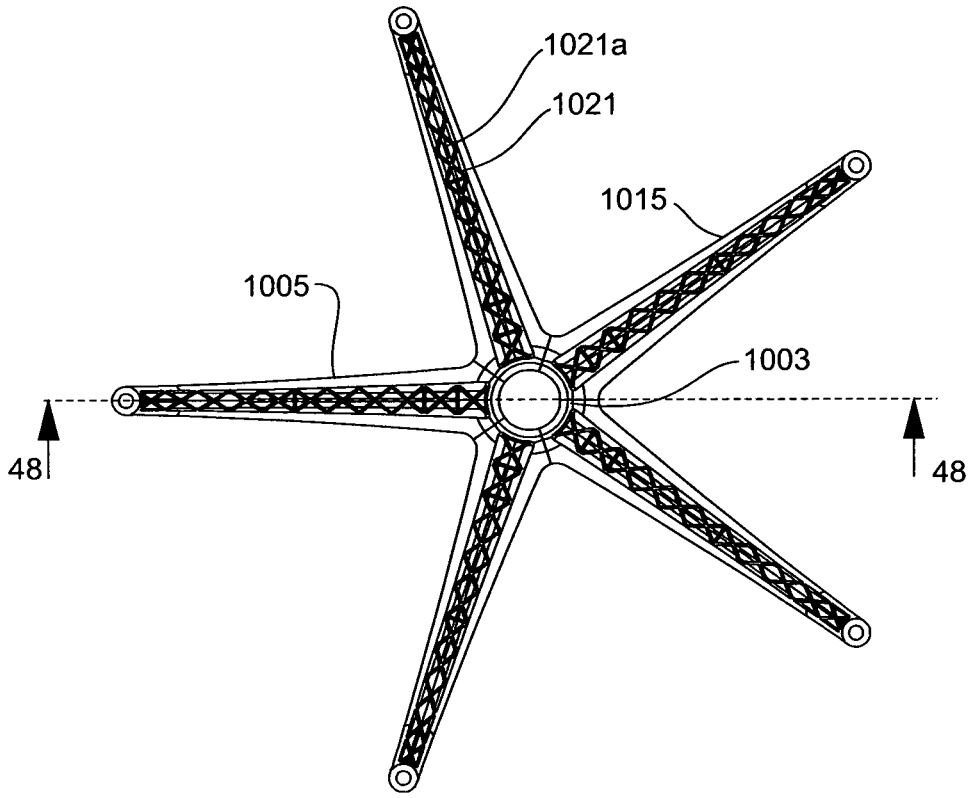
FIG. 47 is an underside view of the base of FIG. 43.
Figure 48:
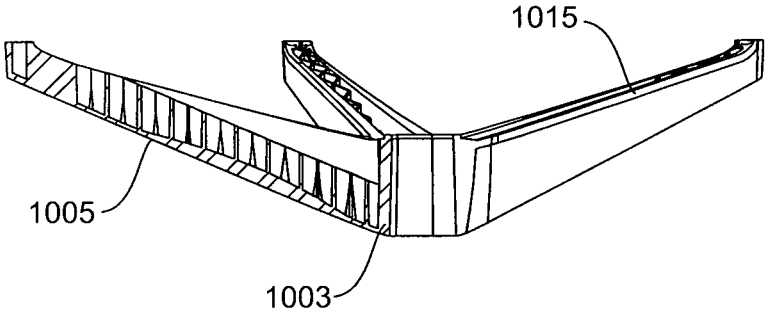
FIG. 48 is a section view along line 48-48 of FIG. 47.

Each leg has side walls 1017 extending between the proximal end and the distal end. Each leg has a cavity 1019 between the side walls 1017. The side walls 1017 diverge from their upper ends to their lower ends. Referring to FIG. 46, the side walls and flanges form an inverted U shape. The flange has a wall thickness that is equal to or greater than a wall thickness of the side walls.

When an occupant is sitting on the chair, a bending load is applied to the legs 1005 of the base. The maximum compressive stress is found at the uppermost surface 1011 of the legs and the maximum tensile stress is located at the lowermost surface 1013 of the beam. The stresses have a variation between the uppermost surface and the lowermost surface. There is no bending load between the uppermost portion and the lowermost portion at a neutral axis.

By providing flanges 1015 at the lowermost portion of the leg, the neutral axis is moved closer to the lower portion of the leg. This allows the base to have less material than a comparable conventional base while maintaining the same ability to withstand load. It also provides for a low profile section.

The side walls may be generally concave when viewed from the side of the leg. Alternatively, the side walls may be generally convex or flat. The base may include ribs 1021 extending between the side walls of the leg 1005, and may include elongate ribs 1021*a* extending substantially the length of the legs.

In an alternative embodiment, the flanges 1015 may extend along a major portion of a distance between the proximal end and the distal end. In other alternative embodiments, the flanges may extend inwardly towards the cavity or be positioned toward a lower portion of the leg so that part of the side walls extend below the flanges.

In the preferred embodiment, the body comprising the central portion 1003 and plurality of legs 1005 comprises an integrally formed component. The body is preferably formed from a polymeric material, and is preferably injection moulded. The polymeric material may be a recyclable material, such as those described below. Alternatively, the base may be cast from a metallic component.

Figure 49:
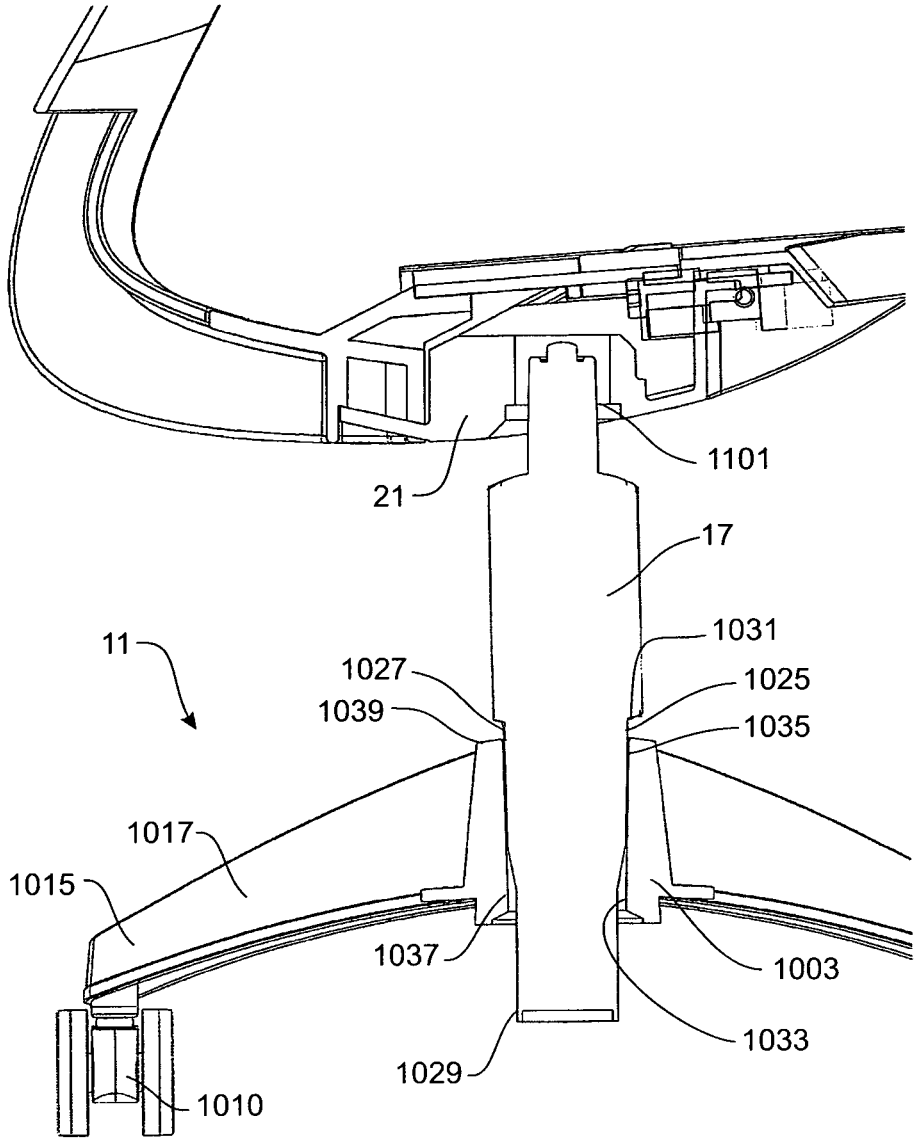
FIG. 49 is a section view of a preferred form connection between the base of FIG. 43 and a height adjustment mechanism.

Referring to FIG. 49, the castored base 11 supports a height adjustment mechanism 17. The height adjustment mechanism has a member 1025 with an external taper that converges from an upper end 1027 of the taper to a lower end 1029 of the taper. The member further has a first stop in the form of a shoulder 1031 near the upper end of the taper.

The central portion 1003 of the castored base 11 defines an internal tapered cavity 1033 for receiving the external taper of member 1025 of the height adjustment mechanism 1023. The internal taper 1033 converges from an upper end 1035 of the taper to a lower end 1037 of the taper. The castored base has a second stop in the form of a shoulder 1039 near the upper end of the internal tapered cavity.

When the height adjustment mechanism 17 and the castored base 1001 are initially assembled, the shoulder 1031 of the member of the height adjustment mechanism is spaced apart from the shoulder 1039 of the castored base. The spacing is about 5 to about 20 mm when initially assembled. Over an extended period of time, the tapered member may move towards the castored base because of creep of the polymeric material of the base. The shoulder of the castored base is configured to engage and support the shoulder of the height adjustment mechanism if the member of the height adjustment mechanism moves downwardly relative to the castored base over time. The shoulder prevents the height adjustment mechanism from striking the floor.

The internal taper of the cavity 1033 substantially corresponds to the external taper of the tapered member 1025. The tapers of the member and the tapered cavity have a substantially circular cross section. Alternatively, the tapers of the member and cavity may have any other suitable cross section, such as square, rectangular or oval, for example.

In the preferred embodiment shown, the shoulder 1039 is integrally formed with the central portion 1003 of the castored base 11. Alternatively, the shoulder may be a separately formed component, such as a ring or tubular component.

The first and second stops could be in any suitable form. For example, rather than being shoulders, the first stop could be a bottom surface of the member, and the second stop may be a base member in the internal tapered cavity of the castored base. Upon initial assembly of the member to the castored base, there will be a gap between the first and second stops.

The upper end of the height adjustment mechanism is mounted to the transom 21 via a metallic insert 1101 that is received in the transom. The insert will typically be a metallic material such as zinc for example. The transom is preferably one of the recyclable polymeric materials described below. The insert is preferably moulded into the transom. The insert has external key detail, to enable the insert to be removed from the transom for recycling. In an alternative embodiment, the insert may be mounted to the transom by fasteners such as screws, and may be readily removable from the transom 21 by removing fasteners such as screws so the transom and attached components can be recycled after use.

In alternative configurations, the stops may not be provided. Instead, a metallic ring may surround the exterior of the tapered cavity of the castored base, and may be easily removable using standard hand tool(s) to enable recycling of the base.

The height adjustment mechanism may be any suitable type, such as a pneumatic spring, hydraulic spring, or mechanical spring, for example.

Knock Down/Kit

Figure 50A:
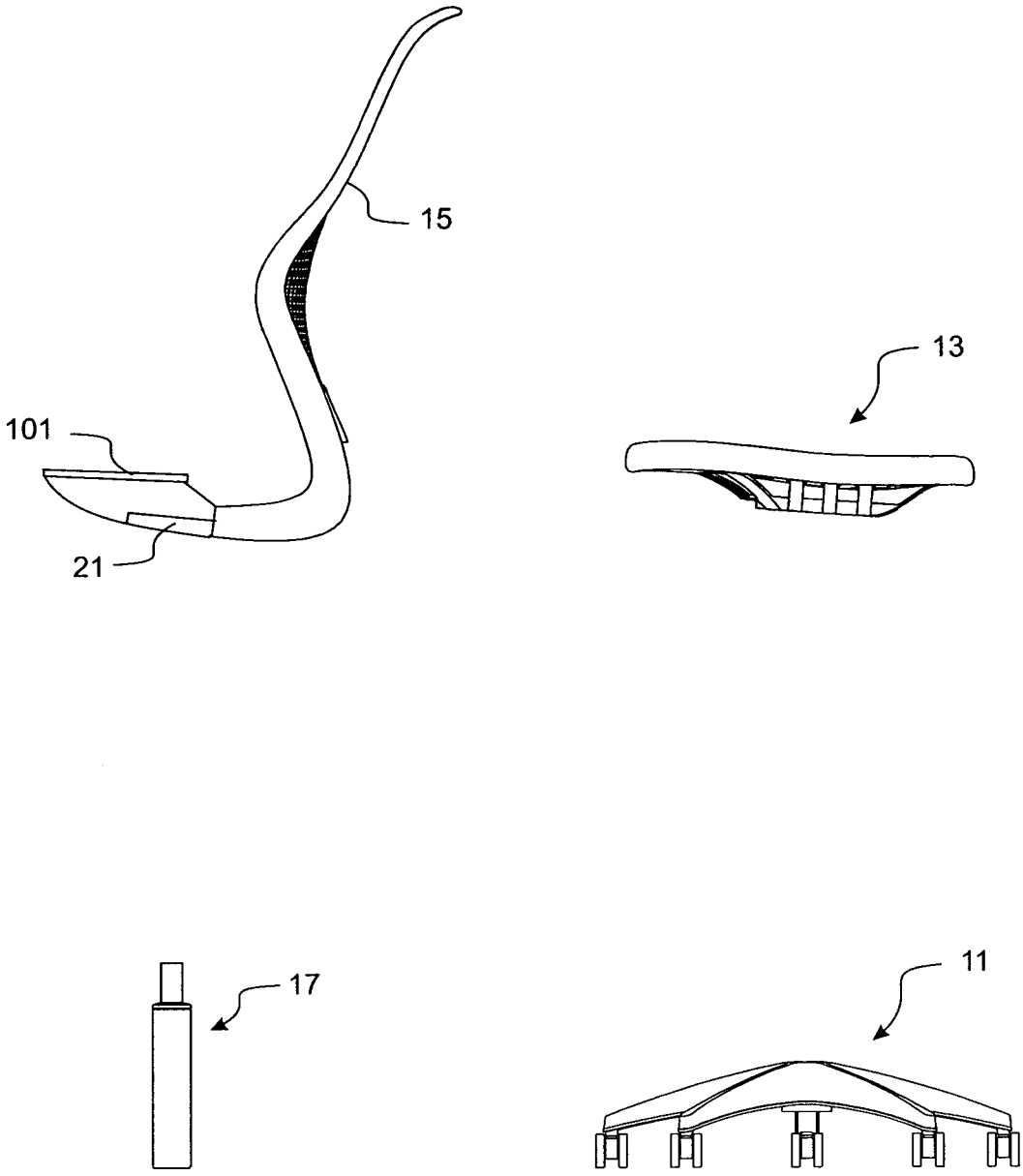
FIG. 50*a* schematically represents the components of a preferred form kit of parts for assembling the chair.

The preferred embodiment chair is provided as a kit of parts that can be assembled into a chair by an end user. The kit comprises a number of separate components, as represented schematically in FIG. 50*a*.

The first component comprises the transom 21, recline mechanism, seat support 101, and back portion 15. The second component comprises the seat portion 13. The third component comprises the castored base 11. The fourth component comprises the height adjustment mechanism 17.

The first, second, third, and fourth components can be assembled into a chair by an end user by mounting the fourth component to the third component, mounting the first component to the fourth component, and mounting the second component to the first component.

The first, second, third, and fourth components will preferably each be pre-assembled or pre-formed components, with the four components being provided separately in the kit. By providing the seat portion 13 as a separate component in the kit, the packing size can be significantly reduced over the size that would be required if the seat was preassembled with the seat support, recline mechanism, transom, and back. The kit may be provided in one or more packages.

Figure 8A:
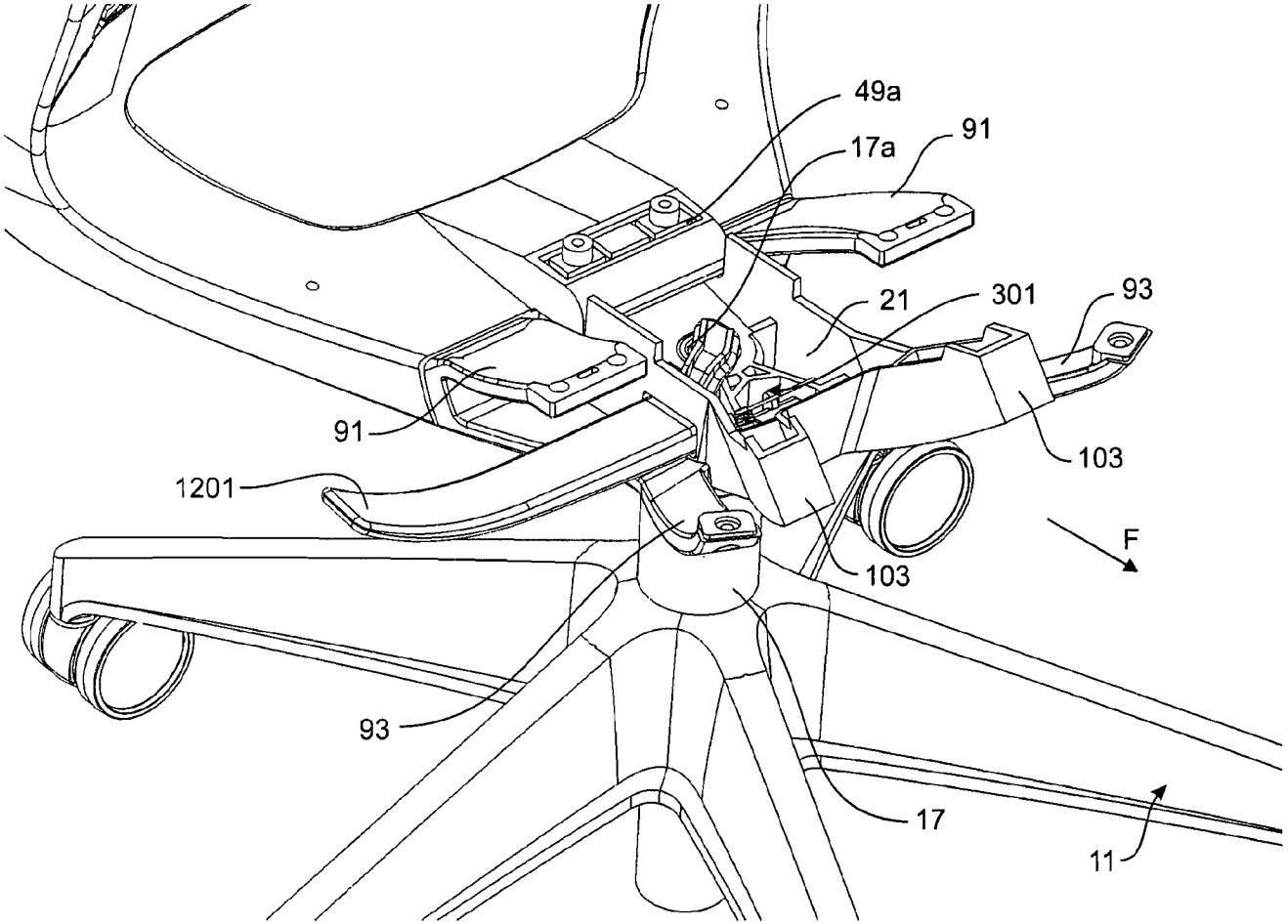
FIG. 8*a* is an overhead perspective view showing features of the recline mechanism and recline resistance mechanism of the chair of FIG. 1.
Figure 8B:
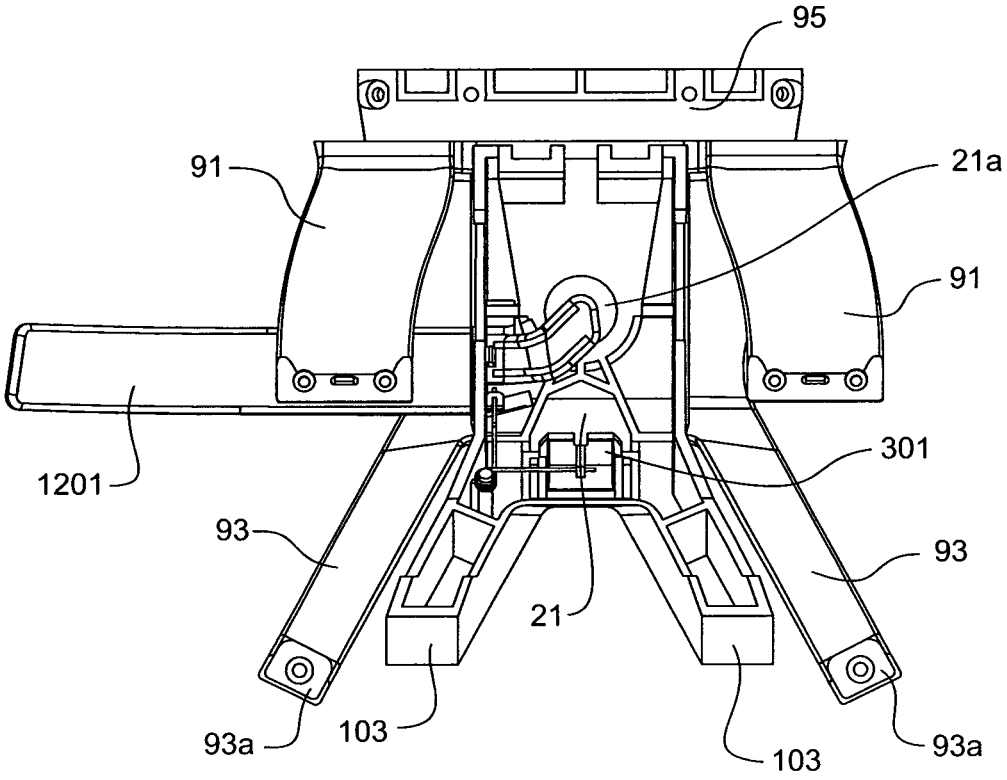
FIG. 8*b* is an overhead view of part of the recline mechanism and recline resistance mechanism of FIG. 8*a;*
Figure 8C:
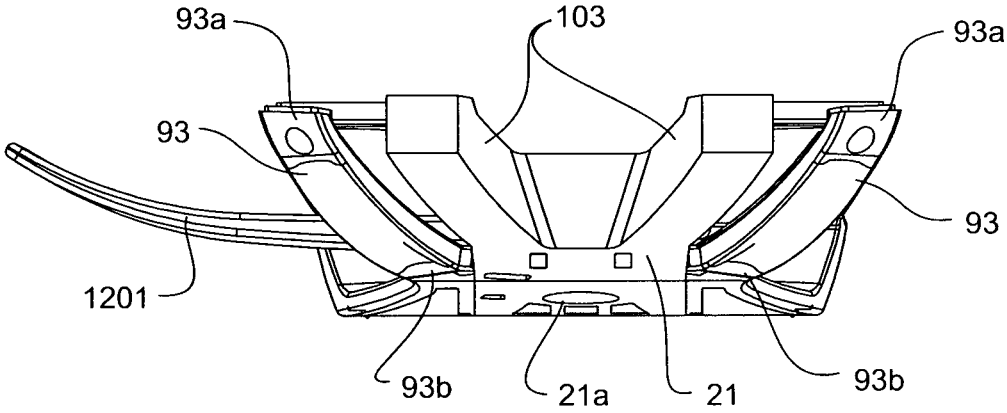
FIG. 8*c* is a front view of part of the recline mechanism of FIG. 8*a;*
Figure 8D:
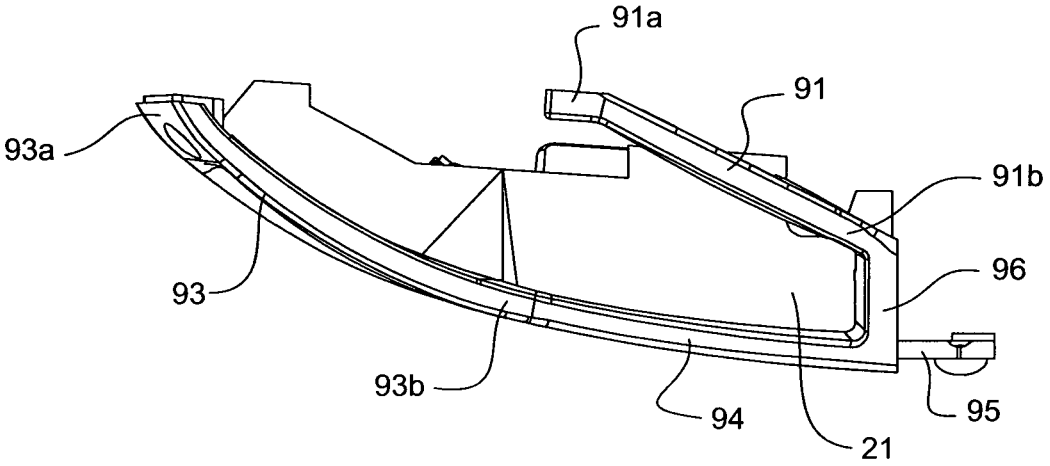
FIG. 8*d* is a left side view of part of the recline mechanism of FIG. 8*a;*
Figure 8E:
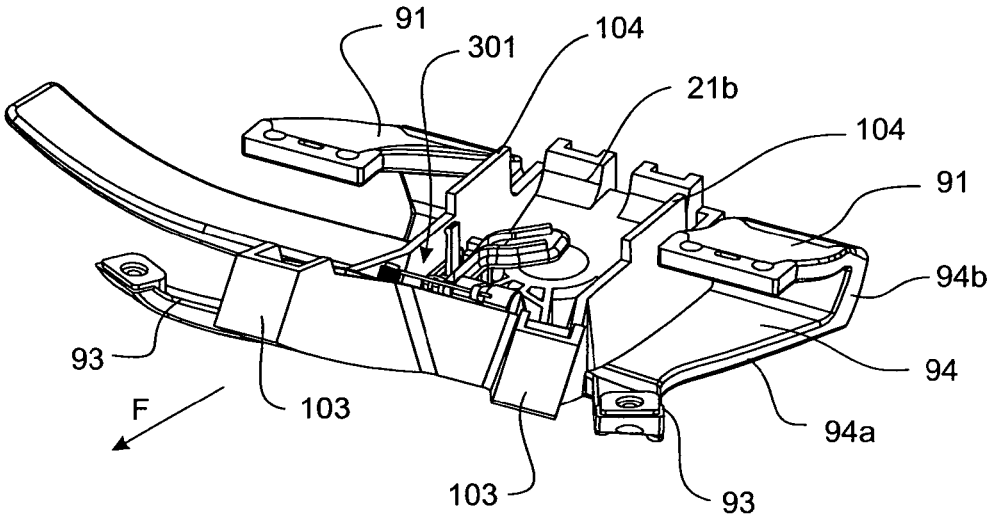
FIG. 8*e* is a front overhead perspective view of part of the recline mechanism and recline resistance mechanism of FIG. 8*a;*
Figure 8F:
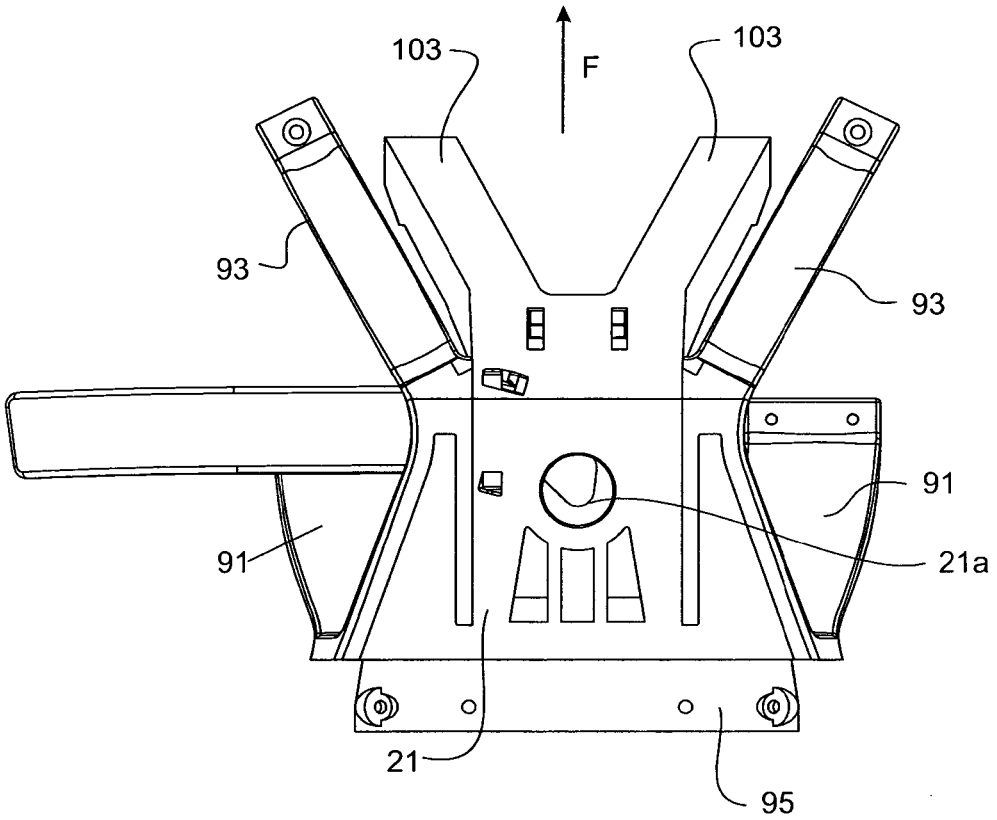
FIG. 8*f* is an underside view of part of the recline mechanism of FIG. 8*a;*

The first component also comprises an actuator 1201 for use by a seated occupant to adjust the height of the height adjustment mechanism. In the form shown, the actuator 1201 is a lever. As shown in FIG. 8*a*, the actuator is preferably in the form of an elongate polymeric material lever 1201 that is pivotally mounted to the transom 21. The actuator self-adjusts to a desired position relative to the height adjustment mechanism 17 when the first component is mounted to the fourth component. When the height adjustment mechanism is mounted to the transom, the inner end of the actuator 1201 will move to sit against the top of the height adjustment mechanism release member 17*a*. To adjust the height of the chair once assembled, the user will pull upwardly on the outer end of the lever, which will cause the inner end to push on the member 17*a* to actuate the height adjustment mechanism. The lever will be biased to the released position by the member 17*a*.

As described above, in some embodiments the chair may be provided with arm assemblies 201. For those embodiments, the kit will include a pair of arm assemblies. The arm assemblies will be pre-attached to the back portion and form part of the first component. The chair can be assembled from the kit parts in any suitable order. In the preferred embodiment, the second component is mountable to the first component, the fourth component is mountable to the third component, and the first component is mountable to the fourth component, without the use of tools.

In the preferred embodiment, substantially the entire first component, substantially the entire second component, and substantially the entire fourth component, comprise recyclable polymeric materials as described below.

Figure 50B:
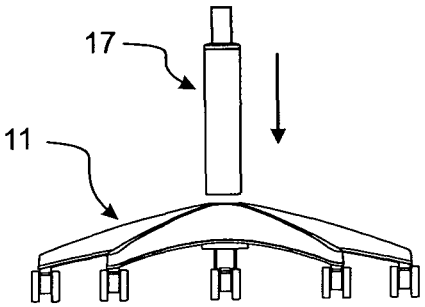
FIG. 50*b* schematically represents a first step in assembling the chair from the kit of parts.
Figure 50C:
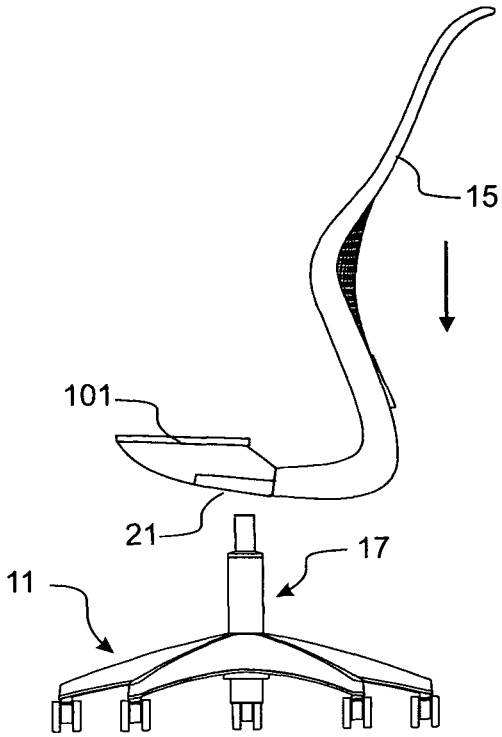
FIG. 50*c* schematically represents a second step in assembling the chair from the kit of parts.
Figure 50D:
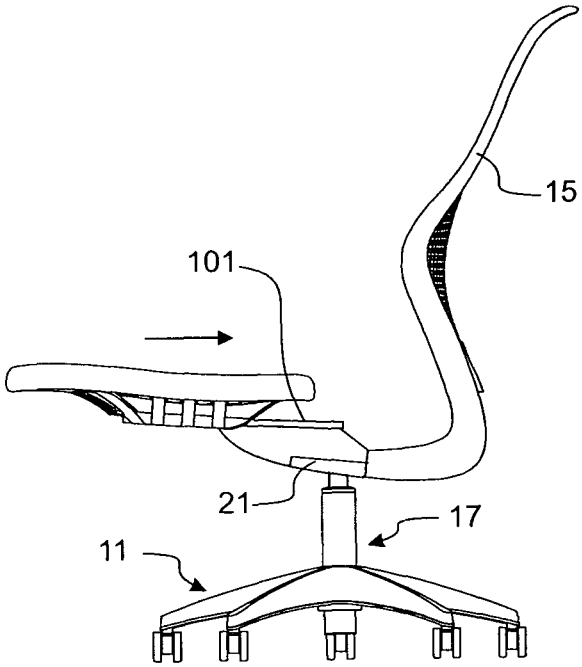
FIG. 50*d* schematically represents a third step in assembling the chair from the kit of parts.

To assemble the chair from the kit of parts, the fourth component is mounted to the third component (FIG. 50*b*), the first component is mounted to the fourth component (FIG. 50*c*), and the second component is mounted to the first component (FIG. 50*d*).

The components can be assembled in any desired order. For example, the second component may be mounted to the first component prior to mounting the first component to the fourth component, and the first component may be mounted to the fourth component prior to mounting the fourth component to the third component. However, it is preferred that the steps are carried out in the order outlined in the paragraph above.

The chair may be disassembled so that such that substantially the entire chair can be recycled. To disassemble the chair, the second component is separated from the first component, the first component is separated from the fourth component, and the fourth component is separated from the third component. The step of disassembling the chair is preferably carried out without the use of tools or using standard hand tool(s).

To recycle the chair, the components will be separated as outlined in the paragraph above. The screws that attach the front 93 and rear 95 deformable members of the recline mechanism to the seat support 101 will be removed, and the back portion 15 will be unscrewed from the lower deformable member 95 and the puller member 97. The screws that attach the puller member 97 to the seat support 101 will be removed. The metallic insert 1101 will be removed from the transom 21, and the castors and pins will be removed from the castored base. If necessary the back cover 61 will be removed from the back frame. Parts of the recline resistance mechanism will be removed. The arm rests 201 will be disconnected from the back portion by removing the fasteners. All of these steps can be carried out without tools or using standard hand tool(s) such as a screwdriver and hammer.

The majority of the polymeric components (in the preferred embodiment, all that have a polyester base) can be recycled together, and the metallic components can be recycled together.

Recycled and Renewably Sourced Materials

At least a major part of the chair is manufactured from one or more materials that contain(s) recycled or renewably sourced content. "Renewably sourced content" is content that is sourced from a renewable resource, such as a renewable crop for example. Renewably sourced content differs from petrochemical-sourced content that is generally not renewable. One example of renewably sourced content is corn starch.

Preferably, at least a major part of the chair is manufactured from one or more materials that contain(s) content from a rapidly renewable resource. A rapidly renewable resource is a resource that can be harvested in less than 5 years from planting.

It will be understood that the materials having recycled or renewably sourced content may also contain some virgin or non-recycled, non-renewably sourced content. The virgin or non-recycled, non-renewably sourced content may be petrochemical-sourced content.

It is preferred that a major part of the chair uses compatible recyclable polymeric material(s) having a common base, so that significant parts of the chair can be recycled together without requiring excessive disassembly.

In the preferred embodiment, the supporting frame, the recline mechanism, the seat portion, and the back portion are each substantially manufactured from one or more compatible recyclable polymeric materials.

As described above, the supporting frame has a castored base. In the preferred embodiment, at least a major part of the castored base is manufactured from one or more recyclable polymeric materials. The central portion and integrally formed legs and flanges are manufactured from a recyclable polymeric material having a polyester base or from nylon for example. The castors or wheels of the base may necessarily have metal pins or shafts, and may need to be separated prior to recycling of the base. Alternatively, those components may be manufactured from one or more recyclable polymeric materials.

As described above, the supporting frame further comprises a height adjustment mechanism. The height adjustment mechanism will generally not be recyclable with the remainder of the chair; although the metallic components of the height adjustment mechanism can be recycled with the metallic screws that are used to hold together other parts of the chair, as well as castor axles and any other metallic components.

As described above, the supporting frame comprises a transom 21 having a cavity. The upper end of the height adjustment mechanism is received in a metallic insert in the cavity in the transom. The insert is removable from the transom by removing fasteners such as screws or by unscrewing the insert from the transom, to enable the transom and components connected to the transom to be recycled. The insert may be formed from a suitable metallic material, such as zinc, aluminium, or steel.

As described above, the chair may be provided with height adjustable arm assemblies. In the preferred embodiment, at least a major part of the arm assemblies are formed from one or more recyclable polymeric materials. The arm assemblies are separable from the remainder of the chair, for example, by removing fasteners. The arm assemblies are made from one or more recyclable polymeric materials so that once the arm assemblies have been separated from the remainder of the chair, each arm assembly, other than the arm rest cushion, can be recycled as one unit without further disassembly. In an alternative embodiment, the arm rest cushion can be recycled with the remainder of the arm assembly.

The recyclable polymeric material(s) used for at least a major part of the chair can be recycled together. In the preferred embodiment, the recyclable polymeric material(s) comprise material(s) having a polyester base. The recyclable polymeric material(s) comprise one or more selected from the group comprising: polyethylene terephthalate (PET), polybutylene terephthalate (PBT), polyester (PE), recycled polyethylene terephthalate, recycled polybutylene terephthalate, recycled polyester, glass filled polyethylene terephthalate, and recycled glass filled polyethylene terephthalate.

Preferably, at least about 60% of the chair, by weight, comprises one or more polymeric materials that contain(s) recycled or renewably sourced content. Preferably, at least about 70% of the chair, by weight, comprises one or more polymeric materials that contain(s) recycled or renewably sourced content. Preferably, at least about 80% of the chair, by weight, comprises one or more polymeric materials that contain(s) recycled or renewably sourced content.

Preferably, the amount of recycled or renewably sourced content in the chair is at least about 40%, by weight. Preferably, the amount of recycled or renewably sourced content in the chair is at least about 50%, by weight. Preferably the chair comprises about 46% recycled content by weight and about 6% of renewably sourced content by weight.

The following two tables outline two examples of preferred materials for use in various components of the chair.

TABLE 1

| PARTS DESCRIPTION | Reference | Qty | Material | Weight (kg) | Recycled content proportion (Post Industrial) | Recycled content proportion (Post Consumer) | Recycled Content Total (kg) | Renewably sourced material proportion | Renewably sourced weight (kg) |
|---|---|---|---|---|---|---|---|---|---|
| Back | | | | | | | | | |
| back skin | 61 | 1 | Hytrel 4069 | 0.349 | | | 0.000 | 0.660 | 0.230 |
| back frame | 25 | 1 | 30% glass filled (GF) PET | 2.088 | | 0.580 | 1.211 | | 0.000 |
| Seat Assy | | | | | | | | | |
| foam cushion | | 1 | PU/soy | 0.750 | | | 0.000 | 0.160 | 0.120 |
| knitted seat topper/ cushion cover | | 1 | Polyester | 0.080 | 1.000 | | 0.080 | | 0.000 |
| seat structure | 13 | 1 | 30% GF Nylon | 0.869 | | | 0.000 | | 0.000 |
| Mechanism & Actuators | | | | | | | | | |
| transom | 21 | 1 | 30% GF PBT | 0.397 | | | 0.000 | 0.259 | 0.103 |
| insert, transom | 1101 | 1 | Zinc | 0.091 | | | 0.000 | | 0.000 |
| Hytrel overmold | 93, 95, 91, 94, 96 | 1 | Hytrel 6356 | 0.235 | | | 0.000 | | 0.000 |
| puller | 97 | 1 | Hytrel 6356 | 0.059 | | | 0.000 | | 0.000 |
| Screws K50 | | 18 | Steel | 0.027 | 0.8 | | 0.022 | | 0.000 |
| seat support | 101 | 1 | 30% GF PET | 0.462 | | 0.580 | 0.268 | 0.259 | 0.120 |
| actuator, seat height | 1201 | 1 | 30% GF PCR PET | 0.066 | | 0.580 | 0.038 | | 0.000 |
| lever pivot | 1201b | 1 | 15% GF Nylon | 0.012 | | | 0.000 | | 0.000 |
| shuttle | 351 | 1 | 30% GF Acetal | 0.013 | | | 0.000 | | 0.000 |
| shuttle engager | 371 | 1 | 30% GF Nylon | 0.015 | | | 0.000 | | 0.000 |
| shuttle block | 357 | 1 | Hytrel 6356 | 0.002 | | | 0.000 | | 0.000 |
| recline resistance spring | 391 | 1 | Spring Steel | 0.015 | 0.800 | | 0.012 | | 0.000 |
| Base | | | | | | | | | |
| base | 11 | 1 | 33% GF Nylon | 1.298 | 0.650 | | 0.844 | | 0.000 |
| height adjust member | 17 | 1 | Steel & Plastic | 1.045 | 0.820 | | 0.857 | | 0.000 |
| castors and pins | 1010 | 5 | Steel & Nylon | 0.500 | 0.710 | | 0.355 | | 0.000 |
| Arms | | | | | | | | | |
| Structure, arm | 221 | 1 pair | 30% GF PET | 0.796 | | 0.580 | 0.462 | | 0.000 |
| stem, structural | 203 | 1 pair | 30% GF PET | 0.447 | | 0.580 | 0.259 | | 0.000 |
| lever, height adjust | 206 | 1 pair | 30% GF PET | 0.032 | | 0.580 | 0.019 | | 0.000 |
| pad, arm | 209 | 1 pair | PU | 0.041 | | | 0.000 | | 0.000 |
| structure, inner arm pad | 207 | 1 pair | 30% GF PET | 0.188 | | 0.580 | 0.109 | | 0.000 |
| Bearings | 203c | 2 per arm | Hytrel | 0.010 | | | 0.000 | | 0.000 |
| arm post screw K60 | | 1 per arm | Steel | 0.003 | 0.800 | | 0.002 | | 0.000 |
| | | | | 0.098904545 | | Total Recycled Content (kg) | 4.54 | Total Renewably Sourced (kg) | 0.57 |
| | | | Total Weight (kg) | 9.890 | | Total Recycled Content % | 45.88 | Total Renewably Sourced % | 5.79 |

TABLE 2

| PARTS DESCRIPTION | Ref | Material | Recycled content (RC) Renewably sourced (RS) Virgin only (V) |
|---|---|---|---|
| Back | | | |
| back cover | 61 | Hytrel | RS |
| back frame | 25 | Glass filled PET | RC |
| Seat Assembly | | | |
| foam cushion | | Hytrel | RS |
| knitted seat topper/ cushion cover | | Polyester | RC |
| seat structure | 13 | Glass filled PET | RC |

TABLE 2-continued

| PARTS DESCRIPTION | Ref | Material | Recycled content (RC) Renewably sourced (RS) Virgin only (V) |
|---|---|---|---|
| Mechanism & Actuators | | | |
| transom | 21 | Glass filled PET | RC |
| insert, transom | 1101 | Zinc | RC |
| Hytrel over-mould | 93, 95, 91, 94, 96 | Hytrel 6356 | RS |
| puller | 97 | Hytrel 6356 | RS |
| screws K50 | | Steel | RS |
| seat support | 101 | Glass filled PET | RC |

TABLE 2-continued

| PARTS DESCRIPTION | Ref | Material | Recycled content (RC) Renewably sourced (RS) Virgin only (V) |
|---|---|---|---|
| actuator, seat height | 1201 | Glass filled PET | RC |
| detent pin | 307 | Steel | RC |
| detent spring | 311 | Spring Steel | RC |
| detent lever | 305 | Glass filled PET | RC |
| | | Base | |
| base | 11 | Glass filled PET | RC |
| height adjust member | 17 | Steel & Plastic | RC & V |
| Castors/pins | 1010 | Steel & Nylon | RC & V |
| | | Arms | |
| structure | 221 | Glass filled PET | RC |
| stem, structural | 203 | Glass filled PET | RC |
| lever, height adjust | 206 | Glass filled PET | RC |
| pad, arm | 209 | Polyester | RC |
| structure, inner arm pad | 207 | Glass filled PET | RC |
| arm post screw K60 | | Steel | RC |

The above describe two possible preferred embodiment material configurations. The second table describes a configuration that has a higher overall recycled/renewably sourced content than the first table.

It will be appreciated that the materials used in the chair may be varied. However, it will be understood that in preferred embodiments of the chair, a major part of the chair is formed from one or more polymers that contain(s) recycled or renewably sourced content, and that are preferably compatible for recycling.

The above describes preferred forms of the present invention, and modifications can be made thereto without departing from the scope of the present invention. For example, the preferred form features are described and shown with reference to a reclining office chair. However, it will be appreciated that many of the features can readily be incorporated into different types of chairs, such as meeting chairs, vehicle chairs, or theatre chairs for example. The supporting frame could be modified accordingly, so as to be fixed to the ground or a wall panel for example for a theatre chair.

Additionally, a number of the features described herein can be incorporated into chairs having different features. They need not all be incorporated into the same chair. Other example modifications are listed in the "Summary of the Invention" section.

What is claimed is:

1. A chair comprising:

a main transom, a recline mechanism, and a seat portion;

a back portion comprising a one-piece frame of unitary construction having an upper transverse member at an upper portion thereof, and a lower transverse member at a lower portion thereof, the upper transverse member being positioned a greater vertical distance from the seat portion than the lower transverse member, the one-piece frame of unitary construction further comprising at least two spaced apart side members extending between and connecting to the upper transverse member and to the lower transverse member with the upper and lower transverse members extending between the two spaced apart side members, each side member having an inner edge and an outer edge, wherein the inner edges of the side members face towards each other and the outer edges of the side members face away from each other, each side member being generally L-shaped in cross-section and having a main frame portion comprising a front face that faces a seated occupant in use, and a flange positioned at an edge of the side member, the flange extending at least a major portion of the length of the side member and in a direction generally rearwardly from the front face of the main frame portion, wherein each flange is positioned at the outer edge of the respective side member, and wherein the flanges resist a majority of the loading applied to the side members of the frame by a seated occupant, wherein each side member comprises a plurality of attachment features comprising hook features on a forward facing surface of the side member, the hook features comprising an upright that extends in a forward direction from a portion of the side member and an overhang connected to the upright and spaced from said portion of the side member, wherein the overhang extends in a direction that is transverse to the forward direction away from the inner edge of the side member toward the outer edge of the side member, the one piece frame of unitary construction further comprising at least one support member extending from the lower portion thereof and mounted to at least one of the main transom, the recline mechanism, and the seat portion, to support the back portion in the chair; and a compliant support surface comprising a plurality of elongate vertical members and a plurality of elongate horizontal members extending between and supported by the side members, wherein at least some of the elongate vertical members are engaged with the hook features between the elongate horizontal members, the compliant support surface being disposed directly against the front face of the side members.

2. A chair as claimed in claim 1, wherein each flange extends in a direction generally perpendicularly from the front face of the main frame portion.

3. A chair as claimed in claim 1, wherein each flange has substantially parallel walls.

4. A Previously Presented chair as claimed in claim 1, wherein the main frame portion has substantially parallel walls.

5. A chair as claimed in claim 1, wherein the at least two side members are generally serpentine in shape.

6. A chair as claimed in claim 1, wherein the compliant support surface is a body contacting surface of the support.

7. A chair as claimed in claim 1, wherein the compliant support surface is held in tension between the side members, and is suspended between the side members.

8. A chair as claimed in claim 1, wherein the compliant support surface comprises an elastomeric material.

9. A chair as claimed in claim 1, wherein the flanges each have a length extending from the main frame portion in a direction away from the front face, and wherein the length of each flange is longer for a lower portion of the frame than for an upper portion of the frame.

10. A chair as claimed in claim 1, wherein the side members extend upwardly and forwardly from the lower transverse member, and then upwardly and rearwardly to form a forwardly convex lumbar support region, and wherein the side members then extend upwardly and forwardly to form a forwardly concave intermediate region, and wherein the side members then extend upwardly to the upper transverse member, and wherein the side members are resiliently flexible in the intermediate region to provide a flexing movement in a rearward direction of the upper portion relative to the lower portion.

11. A chair as claimed in claim 1, wherein the hook features are provided in the front face of each side member, and wherein a portion of the compliant support surface adjacent the hook features is substantially flush with the front face of the side member to form a substantially smooth contact surface for a seated occupant.

12. A chair comprising:

a seat portion;

a back portion comprising a one-piece frame of unitary construction having an upper transverse member at an upper portion thereof, and a lower transverse member at a lower portion thereof, the upper transverse member being positioned a greater vertical distance from the seat portion than the lower transverse member, the one-piece frame of unitary construction further comprising at least two spaced apart side members extending between and connecting to the upper transverse member and to the lower transverse member with the upper and lower transverse members extending between the two spaced apart side members, each side member having an inner edge and an outer edge, wherein the inner edges of the side members face towards each other and the outer edges of the side members face away from each other, each side member being generally L-shaped in cross-section and having a front face that faces a seated occupant in use, and a flange positioned at the outer edge of the side member, the flange extending at least a major portion of the length of the side member and in a direction generally rearwardly from the front face, wherein each side member comprises a plurality of attachment features comprising hook features on a forward facing surface of the side member, the hook features comprising an upright that extends in a forward direction from a portion of the side member and an overhang connected to the upright and spaced from said portion of the side member, wherein the overhang extends in a direction that is transverse to the forward direction away from the inner edge of the side member toward the outer edge of the side member; and a compliant support surface comprising a plurality of elongate vertical members and a plurality of elongate horizontal members extending between and supported by the side members, wherein at least some of the elongate vertical members are engaged with the hook features between the elongate horizontal members, the compliant support surface being disposed directly against the front face of the side members.

13. A chair comprising:

a main transom, a recline mechanism, and a seat portion;

a back portion comprising a one-piece frame of unitary construction having an upper transverse member at an upper portion thereof, and a lower transverse member at a lower portion thereof, the upper transverse member being positioned a greater vertical distance from the seat portion than the lower transverse member, and at least two spaced apart side members extending between and connected to the upper transverse member and to the lower transverse member with the upper and lower transverse members extending between the two spaced apart side members, each side member having an inner edge and an outer edge, wherein the inner edges of the side members face each other and the outer edges of the side members face away from each other, each side member being generally L-shaped in cross-section and having a front face that faces a seated occupant in use, and a flange positioned at the outer edge of the side member, the flange extending at least a major portion of the length of the side member and in a direction generally rearwardly from the front face, wherein each side member comprises a plurality of attachment features comprising hook features on a forward facing surface of the side member, the hook features comprising an upright that extends in a forward direction from a portion of the side member and an overhang connected to the upright and spaced from said portion of the side member, wherein the overhang extends in a direction that is transverse to the forward direction away from the inner edge of the side member toward the outer edge of the side member, the one-piece frame of unitary construction further comprising at least one support member extending from the lower portion thereof and mounted to at least one of the main transom, the recline mechanism, and the seat portion, to support the back portion in the chair; and a compliant support surface comprising a plurality of elongate vertical members and a plurality of elongate horizontal members extending between and attached to the side members, wherein at least some of the elongate vertical members are engaged with the hook features between the elongate horizontal members, the compliant support surface being disposed directly against the front face of the side members.

14. A chair as claimed in claim 12, wherein the hook features are provided in the front face of each side member, and wherein a portion of the compliant support surface adjacent the hook features is substantially flush with the front face of the side member to form a substantially smooth contact surface for a seated occupant.

* * * * *